US007415231B2

(12) United States Patent
Maeda

(10) Patent No.: US 7,415,231 B2
(45) **Date of Patent: *Aug. 19, 2008**

(54) COLOR IMAGE FORMING APPARATUS AND METHOD

(75) Inventor: Katsuhiko Maeda, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 76 days.

This patent is subject to a terminal disclaimer.

(21) Appl. No.: 11/259,036

(22) Filed: Oct. 27, 2005

(65) Prior Publication Data

US 2006/0045577 A1 Mar. 2, 2006

Related U.S. Application Data

(63) Continuation of application No. 10/785,154, filed on Feb. 25, 2004, now Pat. No. 6,999,708.

(30) Foreign Application Priority Data

Feb. 26, 2003 (JP) ..... 2003-050131
Mar. 3, 2003 (JP) ..... 2003-056433
Dec. 25, 2003 (JP) ..... 2003-431387

(51) Int. Cl.
*G03G 15/01* (2006.01)

(52) U.S. Cl. ..... 399/301

(58) Field of Classification Search ..... 399/38, 399/39, 46, 49, 297, 298, 299, 300, 301
See application file for complete search history.

(56) References Cited

U.S. PATENT DOCUMENTS 5,867,759 A 2/1999 Isobe et al.
5,940,114 A * 8/1999 Kataoka et al. ..... 347/248
6,236,827 B1 5/2001 Hada
6,421,076 B1 * 7/2002 Asaya ..... 347/234
6,701,117 B2 3/2004 Kaji
7,251,055 B2 * 7/2007 Sawada et al. ..... 358/1.9
2005/0191072 A1 * 9/2005 Okano ..... 399/49

FOREIGN PATENT DOCUMENTS

JP 63-286864 11/1988

* cited by examiner

*Primary Examiner*—Hoan H Tran
(74) *Attorney, Agent, or Firm*—Oblon, Spivak, McClelland, Maier & Neustadt, P.C.

(57) ABSTRACT

A color image forming apparatus forming a full color image by superimposing images of individual colors includes a correction possibility determination device to determine whether or not deviations in position and errors in magnification ratio of images of individual colors that are superimposed on top of one another to form a full color image can be correctly performed and a correction device to perform the operation of correcting deviations in position and errors in magnification ratio of individual colors that are superimposed on top of one another to form a full color image. The operation of correcting deviations in position and errors in magnification ratio of individual colors that are superimposed on top of one another to form a full color image is performed by the correction device when the correction possibility determination device has determined that deviations in position and errors in magnification ratio of images of individual colors that are superimposed on top of one another to form a full color image can be correctly corrected.

11 Claims, 33 Drawing Sheets

| |
|---|
| FIG. 11A |
| FIG. 11B |

| FIG. 23A |
| --- |
| FIG. 23B |

| FIG. 25A |
| --- |
| FIG. 25B |

| FIG. 28A |
| --- |
| FIG. 28B |

COLOR IMAGE FORMING APPARATUS AND METHOD

CROSS-REFERENCE TO RELATED DOCUMENTS

The present application is a continuation of U.S. application Ser. No. 10/785,154 filed Feb. 25, 2004 now U.S. Pat. No. 6,999,708, and claims priority and contains subject matter related to Japanese Patent Applications No. 2003-050131, No. 2003-056433, and No. 2003-431387 filed in the Japanese Patent Office on Feb. 26, 2003, Mar. 3, 2003 and Dec. 25, 2003, respectively, and the entire contents of each of which are hereby incorporated herein by reference.

BACKGROUND OF THE INVENTION

1. Field of the Invention

The present invention relates to a color image forming apparatus, such as a color copier, a color printer, a color facsimile apparatus, a color printing apparatus, etc., forming a full color image by superimposing images of individual colors on top of one another, and in particular relates to control of aligning positions of images of individual colors that are superimposed on top of one another to form a full color image.

2. Description of the Background Art

In a color image forming apparatus forming a full color image, images of cyan, magenta, yellow, and black are superimposed on top of one another and thereby a full color image is formed. If positions of images of individual colors (cyan, magenta, yellow, and black) superimposed on top of one another to form a full color image are deviated from each other, colors of a line and a character of the full color image change or irregular colors occur in the full color image, leading to deterioration in image quality. Accordingly, in forming a full color image, it is necessary to align positions of images of individual colors that are superimposed on top of one another to form the full color image with each other as much as possible.

Japanese Patent Laid-open publication No. 63-286864 describes an image forming apparatus forming a full color image by superimposing images of individual colors on top of one another, in which deviations in position of images of individual colors (cyan, magenta, yellow, and black) in a main scanning direction (a direction perpendicular to a direction in which a recording sheet and a transfer belt are conveyed) are corrected. Such deviations in position of images of individual colors occur due to various reasons such as changes in external and internal environmental temperatures and changes in the apparatus over time. In the image forming apparatus, for correcting deviations in position of images of individual colors in the main scanning direction, a full color pattern image of a pattern of straight lines (extending in the main scanning direction) and slanted lines (extending slantingly relative to a transfer belt conveying direction) is formed on the transfer belt by superimposing pattern images of individual colors on top of one another. The straight lines and the slanted lines of the pattern of lines of the pattern image formed on the transfer belt are detected by sensors, values of distances between the straight lines and the slanted lines of the pattern of lines of the pattern image formed on the transfer belt are obtained according to signals from the sensors, and based on the values of distances between the straight lines and the slanted lines of the pattern of lines of the pattern image formed on the transfer belt and reference values stored in a memory, amounts of deviations in the positions of the pattern images of individual colors in the main scanning direction are calculated by a CPU. Based upon a result of such calculation by the CPU, at least start timings of writing images on photoconductors in the main scanning direction or frequencies of writing clocks are corrected. Thus, deviations in position of images of individual colors in the main scanning direction are corrected, and thereby a full color image with no deviation in position of images of individual colors is obtained.

In the above-described color image forming apparatus, a pattern image of a pattern of straight lines and slanted lines of individual colors (cyan, magenta, yellow, and black) is formed on a transfer belt, the straight lines and the slanted lines of the pattern of lines of the pattern image formed on the transfer belt are detected by sensors, and amounts of deviations in position of the pattern images of individual colors are obtained based upon detection signals of the straight lines and the slanted lines of the pattern of lines of the pattern image formed on the transfer belt from the sensors to be fed back to a correction part of the apparatus so that the deviations in position of the pattern images of individual colors are corrected.

Accordingly, a density of the pattern image formed on the transfer belt must be on a sufficient level that each of the straight lines and the slanted lines of the pattern of lines of the pattern image can be detected with the sensors. If the pattern image formed on the transfer belt is blurred or includes a thin spot, that is, if any of the straight lines and the slanted lines of the pattern of lines of the pattern image is blurred or includes a thin spot, it may occur that the amounts of deviations in position of the pattern images of individual colors obtained based upon the detection signals from the sensors are not correct. In this case, naturally, the deviations in position of pattern images of individual colors cannot be correctly corrected, leading to deterioration in image quality. Further, by performing the operation of correcting deviations in position of images of individual colors uselessly, the printing speed of the apparatus is decreased. By performing without condition a process control (control for optimizing image forming conditions of the apparatus by detecting image density, etc.) before executing the operation of correcting deviations in position of images of individual colors, the density of the pattern image formed on the transfer member can be increased so that amounts of deviations in position of pattern images of individual colors can be correctly obtained, and thereby the deviations in position of pattern images of individual colors can be correctly corrected. However, it is more preferable to minimize the time other than the time of printing images to suppress a lowering of the printing speed of the apparatus.

SUMMARY OF THE INVENTION

The present invention has been made in view of the above-discussed and other problems and addresses the above-discussed and other problems.

Preferred embodiments of the present invention provide a novel color image forming apparatus and a novel color image forming method in which deviations in position and errors in magnification ratio of images of individual colors that are superimposed on top of one another to form a full color image can be corrected without decreasing the printing speed of the apparatus.

The preferred embodiments of the present invention further provide a novel color image forming apparatus and a novel color image forming method in which deviations in position and errors in magnification ratio of images of individual colors that are superimposed on top of one another to form a full color image can be reliably corrected.

According to a preferred embodiment of the present invention, a color image forming apparatus forming a full color image by superimposing images of individual colors includes a plurality of image forming devices including image bearing members configured to rotate or to move, development devices, and transfer devices. The image forming devices are configured to form images of individual colors on the image bearing members by illuminating the image bearing members with image light according to image data of individual colors to form latent images of individual colors on the image bearing members and to develop the latent images of individual colors on the image bearing members with toner by the development devices, respectively. The image forming apparatus includes a transfer member driven to rotate or to move, and the images of individual colors on the image bearing members of the plurality of image forming devices are sequentially transferred by the transfer devices of the plurality of image forming devices directly onto a recording sheet being conveyed by the transfer member while being superimposed on top of one another on the recording sheet, and thereby a full color image is formed on the recording sheet, or the images of individual colors on the image bearing members of the plurality of image forming devices are sequentially transferred by the transfer devices of the plurality of image forming devices once onto the transfer member while being superimposed on top of one another on the transfer member and then the images of individual colors superimposed on top of one another are transferred onto a recording sheet, and thereby a full color image is formed on the recording sheet.

The image forming apparatus further includes a detection device, and a correction device configured to perform an operation of correcting deviations in position and errors in magnification ratio of images of individual colors that are superimposed on top of one another to form a full color image. In the operation, a full color pattern image for correcting of a pattern of lines is formed on the transfer member by forming latent pattern images for correcting of individual colors on the image bearing members of the plurality of image forming devices, the latent pattern images for correcting of individual colors on the image bearing members are developed with toner into pattern images for correcting of individual colors by the development devices of the plurality image forming devices, and the pattern images for correcting of individual colors on the image bearing members are transferred with the transfer devices of the plurality of image forming devices while being superimposed one on top of another on the transfer member, and each line of the pattern of lines of the pattern image for correcting formed on the transfer member is detected with the detection device to determine a width of each line of the pattern of lines of the pattern image for correcting on the transfer member.

The image forming apparatus further includes a correction possibility determination device configured to determine whether or not deviations in position and errors in magnification ratio of images of individual colors that are superimposed on top of one another to form a full color image can be correctly corrected, respectively, by forming a color pattern image for checking of a pattern of lines on the transfer member by forming latent pattern images for checking of individual colors on the image bearing members of the plurality of image forming devices, developing the latent pattern images for checking of individual colors on the image bearing members with toner into pattern images for checking of individual colors by the development devices of the plurality of image forming devices, and transferring the pattern images for checking of individual colors on the image bearing members onto the transfer member by the transfer devices of the plurality of image forming devices while being superimposed one on top of another on the transfer member, detecting each line of the pattern of lines of the pattern image for checking formed on the transfer member with the detection device to output a detection signal of each line of the pattern of lines of the pattern image for checking formed on the transfer member, and determining if a width of each line of the pattern of lines of the pattern image for checking formed on the transfer member is equal to or greater than a reference value based on the detection signal of each line of the pattern of lines of the pattern image for checking formed on the transfer member.

The correction possibility determination device determines that deviations in position and errors in magnification ratio of images of individual colors that are superimposed on top of one another to form a full color image can be correctly corrected, respectively, when the width of each line of the pattern of lines of the pattern image for checking formed on the transfer member has been determined to be equal to or greater than the reference value, and that deviations in position and errors in magnification ratio of images of individual colors that are superimposed on top of one another to form a full color image cannot be correctly corrected, respectively, when the width of any one line of the pattern of lines of the pattern image for checking formed on the transfer member has been determined to be not equal to or greater than the reference value. The operation of correcting deviations in position and errors in magnification ratio of images of individual colors that are superimposed on top of one another to form a full color image is performed by the correction device when the correction possibility determination device has determined that the width of each line of the pattern of lines of the pattern image for checking formed on the transfer member is equal to or greater than the reference value, and thereby that deviations in position and errors in magnification ratio of images of individual colors that are superimposed on top of one another to form a full color image can be correctly corrected.

According to another preferred embodiment of the present invention, a novel color image forming apparatus forming a full color image by superimposing images of individual colors includes a plurality of image forming devices including image bearing members configured to rotate or to move, development devices, and transfer devices. The image forming devices are configured to form images of individual colors on the image bearing members by illuminating the image bearing members with image light according to image data of individual colors to form latent images of individual colors on the image bearing members and to develop the latent images of individual colors on the image bearing members with toner by the development devices, respectively. The image forming apparatus further includes a transfer member driven to rotate or to move, and the images of individual colors on the image bearing members are sequentially transferred by the transfer devices of the plurality of image forming devices directly onto a recording sheet being conveyed by the transfer member while being superimposed on top of one another on the recording sheet, and thereby a full color image is formed on the recording sheet, or the images of individual colors on the image bearing members are sequentially transferred by the transfer devices of the plurality of image forming devices once onto the transfer member while being superimposed on top of one another on the transfer member. Then, the images of individual colors superimposed on top of one another on the transfer member are transferred onto a recording sheet, and thereby a full color image is formed on the recording sheet.

The image forming apparatus includes a detection device, and a correction device configured to perform an operation of correcting deviations in position and errors in magnification ratio of images of individual colors that are superimposed on top of one another to form a full color image. In the operation, a full color pattern image of a pattern of lines for correcting is formed on the transfer member by forming latent pattern images for correcting of individual colors on the image bearing members of the plurality of image forming devices, the latent pattern images for correcting of individual colors are developed on the image bearing members with toner into pattern images for correcting of individual colors by the development devices of the plurality image forming devices, and the pattern images for correcting of individual colors on the image bearing members are transferred onto the transfer member by the transfer devices of the plurality of image forming devices while being superimposed one on top of another on the transfer member. Each line of the pattern of lines of the pattern image for correcting formed on the transfer member is detected with the detection device to output a detection signal of each line of the pattern of lines of the pattern image for correcting formed on the transfer member, and a width of each line of the pattern of lines of the pattern image for correcting formed on the transfer member is determined based on the detection signal of each line of the pattern of lines of the pattern image for correcting formed on the transfer member, output from the detection device, and a threshold level, and wherein the threshold level used in determining the width of each line of the pattern of lines of the pattern image for correcting formed on the transfer member can be changed.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1:
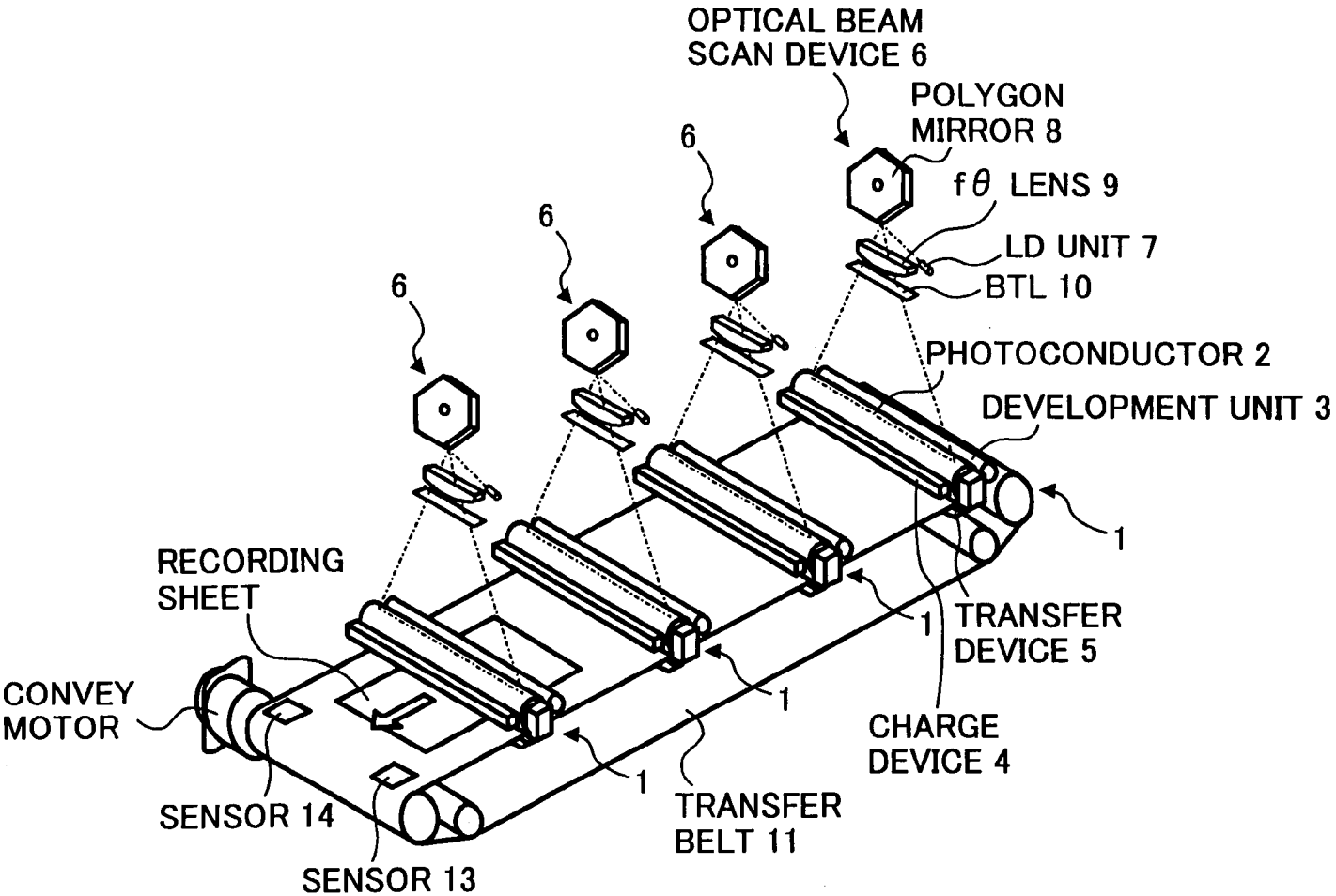
FIG. 1 is an explanatory diagram of a color image forming apparatus of a four-drum system according to a first preferred embodiment of the present invention.

Referring now to the drawings, wherein like reference numerals designate identical or corresponding parts throughout the several views, preferred embodiments of the present invention are described.

FIG. 1 is an explanatory diagram of a color image forming apparatus in which a full color image is formed by superimposing images of individual colors, i.e., yellow (Y), magenta (M), cyan (C), and black (BK), according to the first preferred embodiment of the present invention. For forming images of yellow (Y), magenta (M), cyan (C), and black (BK), the image forming apparatus includes four image forming devices 1 and four optical beam scan devices 6. Each image forming device 1 includes a photoconductor 2 serving as an image bearing member of the present invention, a development unit 3 serving as a development device of the present invention, a charge device 4, a transfer device 5, etc. Each optical beam scan device 6 includes an LD unit 7, a polygon mirror 8, an fθ lens 9, a BTL (barrel toroidal lens) 10, etc. An image in a first color formed by a corresponding image forming device 1 on the photoconductor 2 thereof is transferred onto a recording sheet being conveyed by a transfer belt 11 serving as a transfer member of the present invention in a direction indicated by an arrow in the figure, and subsequently images of a second color, a third color, and a fourth color formed by corresponding image forming devices 1 on respective photoconductor 2 are transferred onto the recording sheet in that order while being superimposed on top of one another on the recording sheet. Thereby, a full color image in which images of individual colors have been superimposed is formed on the recording sheet. The full color image is then fixed onto the recording sheet by a fixing device (not illustrated).

In the image forming device 1, the charge device 4, the development unit 3, the transfer device 5, a cleaning device (not illustrated), and a discharge device (not illustrated) are arranged around the photoconductor 2. The image forming device 1 forms an image on the photoconductor 2 and transfers the image on the photoconductor 2 to a recording sheet with a regular electrophotographic process, i.e., charging, exposure, development, and transferring.

Further, the image forming apparatus includes a first sensor 13 and a second sensor 14 for detecting a pattern image for correcting (described later) formed on the transfer belt 11. The first sensor 13 and the second sensor 14 are reflective optical sensors. An image formation controller (described later) corrects deviations in position in the main scanning and sub-scanning directions and errors in magnification ratio in the main scanning direction of images of individual colors that are superimposed on top of one another to form a full color image based upon a result of detecting the pattern image for correcting formed on the transfer belt 11 with the first sensor 13 and the second sensor 14. A cleaning device (not illustrated) is arranged downstream of the first and second sensors 13 and 14 in the direction in which the transfer belt 11 is conveyed, and the pattern image for correcting formed on the transfer belt 11 is removed by the cleaning device.

The optical beam scan device 6 scans a surface of the photoconductor 2 with a beam modulated according to image data and selectively emitted from the LD unit 7. The beam emitted from the LD unit 7 is deflected by the polygon mirror 8, which is rotated by a polygon motor (not illustrated). The deflected beam passes the fθ lens 9 and the BTL 10, and is reflected by a mirror (not illustrated) to scan the surface of the photoconductor 2. The BTL 10 performs focusing in the sub-scanning direction, i.e., condensing, and position correction in the sub-scanning direction relative to surface tilt, etc. Further, a synchronization detection sensor (not illustrated in FIG. 1), which receives an optical beam deflected by the polygon mirror 8 and outputs a synchronization detection signal for synchronizing start timings of writing images on the photoconductor 2 in the main scanning direction, is arranged in an area outside of an image-writing scan area at the side where writing of an image on the photoconductor 2 starts in the main scanning direction.

Figure 2:
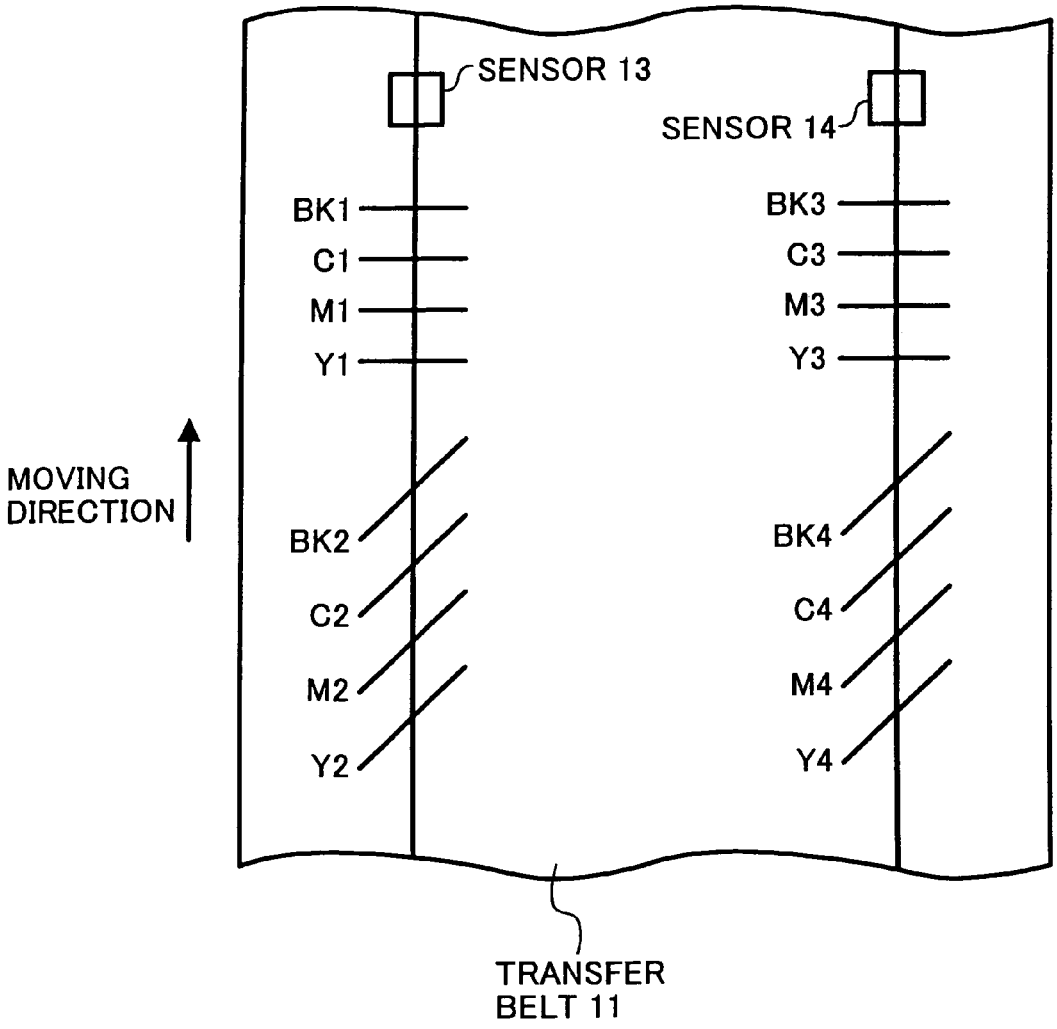
FIG. 2 is a diagram illustrating an example of a pattern image for correcting deviations in position of images of individual colors that are superimposed on top of one another to form a full color image.

FIG. 2 illustrates an example of the pattern image for correcting deviations in position of images of individual colors that are superimposed on top of one another to form a full color image (hereinafter referred to as the pattern image for correcting), formed on the transfer belt 11. As illustrated in FIG. 2, the pattern image for correcting in this example is an image of a pattern of lines in individual colors, i.e., lateral lines BK1 and BK3 and slant lines BK2 and BK4 in black, lateral lines C1 and C3 and slant lines C2 and C4 in cyan, lateral lines M1 and M3 and slant lines M2 and M4 in magenta, and lateral lines Y1 and Y2 and slant lines Y2 and Y4 in yellow. The pattern image for correcting is formed on the transfer belt 11 by superimposing pattern images of correcting of individual colors formed with respective image forming devices 1 one upon another on the transfer belt 11. When the transfer belt 11 moves in the arrow direction indicated in FIG. 2, the lateral lines and the slant lines of the pattern image for correcting formed on the transfer belt 11 are detected by the first sensor 13 and the second sensor 14, detection results of the lines of the pattern image for correcting are sent to a printer controller (described later), and amounts of deviations in position and amounts of errors in magnification ratio of pattern images of cyan, magenta, and yellow relative to a pattern image of black are calculated, respectively, based on the detection results of the lines of the pattern image for correcting. When the position in the main scanning direction or the magnification ratio of the pattern image of a certain color is deviated from that of the pattern image of black, a timing of detecting a slant line in the color of the pattern image formed on the transfer belt 11 changes, and when the position in the sub-scanning direction of the pattern image of a certain color is deviated from that of the pattern image of black, a timing of detecting a lateral line in the color of the pattern image formed on the transfer belt 11 changes.

Specifically, with respect to the main scanning direction, using for a reference time a period of time from when the lateral line BK1 has been detected to when the slant line BK2 has been detected for example, a period of time from when the lateral line C1 has been detected to when the slant line C2 has been detected is compared with the reference time to obtain a deviation amount TBKC12. Further, using for a reference time a period of time from when the lateral line BK3 has been detected to when the slant line BK4 has been detected, a period of time from when the lateral line C3 has been detected to when the slant line C4 has been detected is compared with the reference time to obtain a deviation amount TBKC34. A magnification error amount of the pattern image of cyan relative to the pattern image of black is obtained by a formula: TBKC34−TBKC12, and a frequency of a writing clock with respect to images of cyan is changed by an amount corresponding to the magnification error amount.

Similarly, magnification error amounts of the pattern images of magenta and yellow are obtained and frequencies of writing clocks with respect to images of magenta and yellow are changed. Then, the pattern image for correcting illustrated in FIG. 2 is formed again on the transfer belt 11 using the writing clocks after having been changed in frequency. A deviation amount TBKC12 and a deviation amount TBKC34 are obtained in substantially the same manner as described above with respect to the pattern image of cyan for example, and then, an amount of deviation in position of the pattern image of cyan relative to the pattern image of black in the main scanning direction is obtained by a formula: (TBKC34+TBKC12)/2. A timing to start writing an image of cyan in the main scanning direction is changed by an amount corresponding to the amount of deviation in position of the pattern image of cyan in a unit of one cycle of the writing clock. Deviations in position in the main scanning direction of images of magenta and yellow are corrected in a similar manner.

With respect to the sub-scanning direction, when an ideal time is Tc, a period of time from when the lateral line BK1 has been detected to when the lateral line C1 has been detected is TBKC1, and a period of time from when the lateral line BK3 has been detected to when the lateral line C3 has been detected is TBKC3, an amount of deviation in position of a pattern image of cyan relative to a pattern image of black in the sub-scanning direction is obtained by a formula: (TBKC3+TBKC1)/2−Tc, and a timing to start writing images of cyan in the sub-scanning direction is changed by an amount corresponding to the above-described amount of deviation in position of the pattern image of cyan in a unit of one line. The same applies to images of magenta and yellow.

In the above-described example, detection and correction of errors in magnification ratio of image of individual colors and detection and correction of deviations in position of images of individual colors are separately performed using separate pattern images. However, detection and correction of errors in magnification ratio and deviations in position of images of individual colors can be performed using a single pattern image by obtaining a time change resulting from correction of errors in magnification ratio.

Figure 3A:
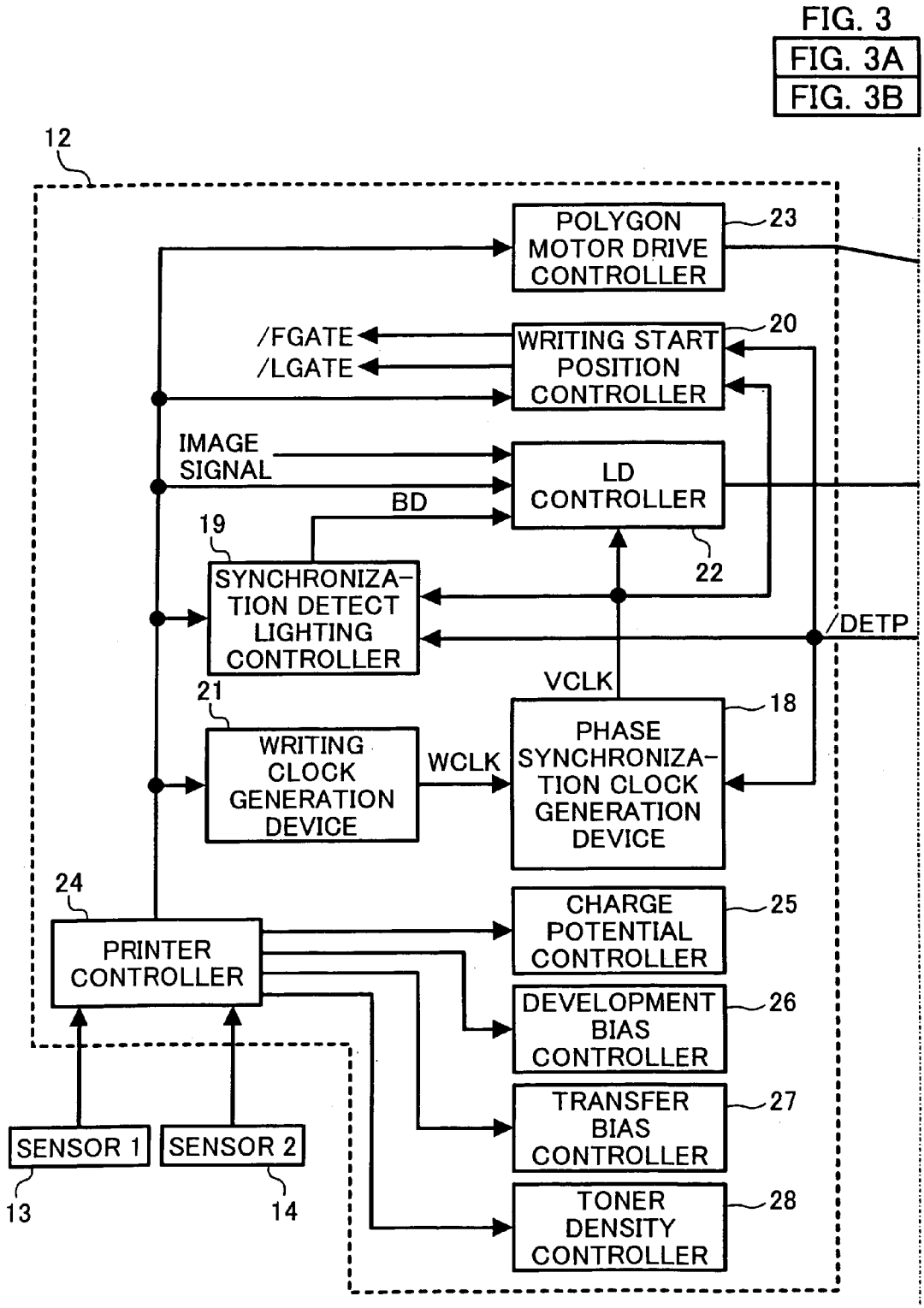
FIG. 3A and FIG. 3B are diagrams illustrating an exemplary construction of an image formation controller of the image forming apparatus, controlling optical beam scan devices, and image forming devices of the apparatus.
Figure 3B:
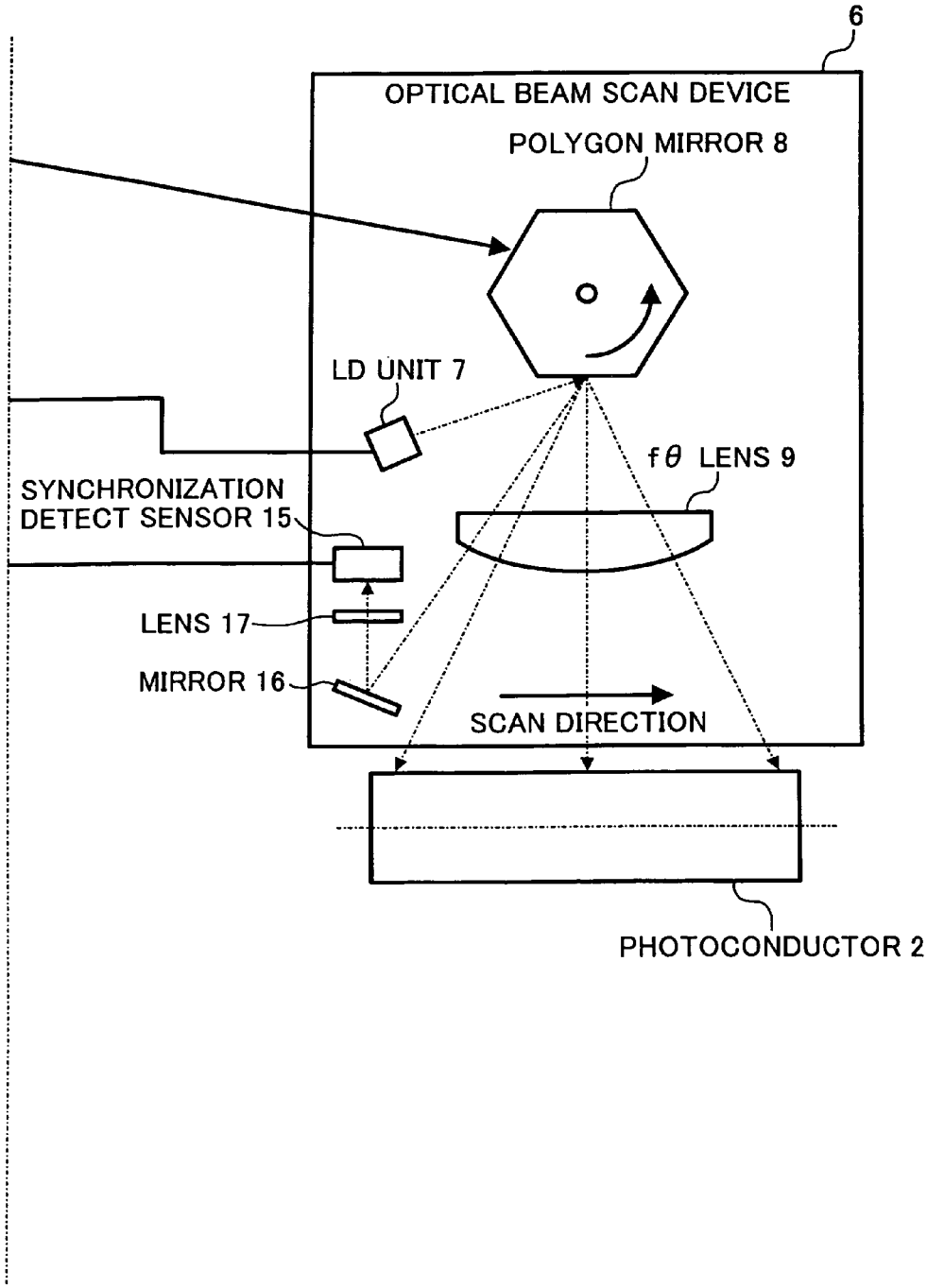

FIG. 3A and FIG. 3B illustrate an exemplary construction of the image formation controller 12 controlling each of the optical beam scan devices 6 and the image forming devices 1. In FIGS. 3A and 3B, only the optical beam scan device 6 and the photoconductor 2 of the image forming device 1 for forming an image of a certain color are illustrated.

As illustrated, in the optical beam scan device 6, a synchronization detection sensor 15, which receives an optical beam deflected by the polygon mirror 8 and outputs a synchronization detection signal for synchronizing start timings of writing images on the photoconductor 2 in the main scanning direction, is arranged at an end part thereof in the main scanning direction at the side where image writing in the main scanning direction starts. A beam that has passed the fθ lens 9 is reflected by a mirror 16 and is condensed by a lens 17 to be incident on the synchronization detection sensor 15. Thus, when a beam passes the synchronization detection sensor 15, a synchronization detection signal /DETP is output from the synchronization detection sensor 15 to be sent to a phase synchronization clock generation device 18, a synchronization detection lighting controller 19, and a writing start position controller 20.

The phase synchronization clock generation device 18 generates a clock VCLK synchronized with the synchronization detection signal /DETP based on a clock WCLK generated by a writing clock generation device 21 and the synchronization detection signal /DETP, and sends the clock VCLK to the synchronization detection lighting controller 19, the writing start position controller 20, and an LD controller 22. The synchronization detection lighting controller 19 first turns on a forced LD lighting signal BD to forcibly turn on an LD (laser diode) in the LD unit 7 for the purpose of detecting the synchronization detection signal /DETP. After detecting the synchronization detection signal /DETP, the synchronization detection lighting controller 19 holds the forced LD lighting signal BD turned on in a state that a flare light will not occur and until the synchronization detection signal /DETP can be detected without fail, with the synchronization detection signal /DETP and the clock VCLK.

The LD controller 22 performs a lighting control of the LD in the LD unit 7 of each optical beam scan device 6 in accordance with a width of a pulse signal generated from an image signal synchronized with the forced LD lighting signal BD and the synchronization detection signal /DETP. Thereby, a laser beam is emitted from the LD of the LD unit 7, and the laser beam is deflected by the polygon mirror 8, passes the fθ lens 9, and scans the surface of the photoconductor 2. A polygon motor drive controller 23 controls the polygon motor to rotate at a specified number of rotations with a control signal from the printer controller 24.

Signals of the pattern image for correcting formed on the transfer belt 11, that have been obtained by the first sensor 13 and the second sensor 14, are sent to the printer controller 24, in which amounts of errors in magnification ratio and deviations in position of pattern images of cyan, magenta, and yellow relative to a pattern image of black are calculated. Correction data for the amounts of deviations in position of pattern images of cyan, magenta, and yellow is sent to the writing start position controller 20 to correct positions of starting writing images of cyan, magenta, and yellow in the main scanning and sub-scanning directions on the photoconductors 2 of respective image forming devices 1 with respective optical beam scan devices 6. The writing start position controller 20 changes timings of a main scanning gate signal /LGATE and a sub-scanning gate signal /FGATE (described below) of images of cyan, magenta, and yellow according to the correction data. Further, the printer controller 24 sends frequency setting data to the writing clock generation device 21 to correct errors in magnification ratio of pattern images of cyan, magenta, and yellow, and the writing clock generation device 21 changes a frequency of the clock WCLK for each of images of cyan, magenta, and yellow according to the frequency setting data. A charge potential controller 25, a development bias controller 26, a transfer bias controller 27, and a toner density controller 28 are connected with the printer controller 24, and these controllers 25, 26, 27 and 28 perform specified controls relative to each image forming device 1 according to instructions from the printer controller 24.

Figure 4:
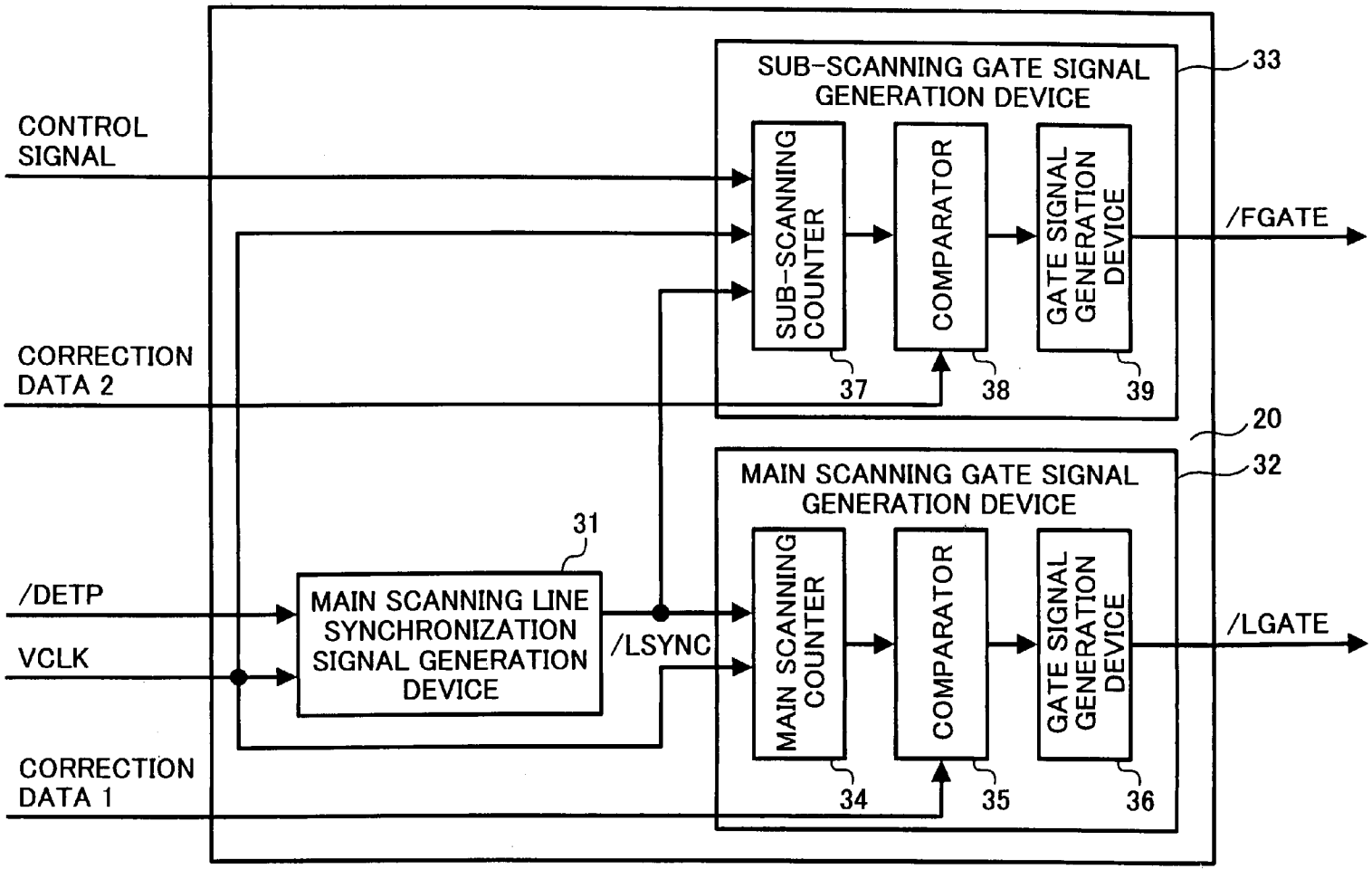
FIG. 4 is a diagram illustrating an exemplary construction of a writing start position controller of the image formation controller.

FIG. 4 illustrates an exemplary construction of the writing start position controller 20. As illustrated in FIG. 4, the writing start position controller 20 includes a main scanning line synchronization signal generation device 31, a main scanning gate signal generation device 32, and a sub-scanning gate signal generation device 33. The main scanning line synchronization signal generation device 31 generates a signal /LSYNC for operating a main scanning counter 34 in the main scanning gate signal generation device 32 and a sub-scanning counter 37 in the sub-scanning gate signal generation device 33. The main scanning gate signal generation device 32 generates the main scanning gate signal /LGATE for determining timings of capturing image signals, such as a timing to start writing an image in the main scanning direction. The sub-scanning gate signal generation device 33 generates the sub-scanning gate signal /FGATE for determining timings of capturing image signals, such as a timing to start writing an image in the sub-scanning direction. The main scanning gate signal generation device 32 includes the main scanning counter 34 which is operated by the signal /LSYNC and the clock VCLK, a comparator 35 which compares a value of the main scanning counter 34 and correction data 1 obtained from the printer controller 24 and outputs a result thereof, and a gate signal generation device 36 which generates the main scanning gate signal /LGATE based on the result from the comparator 35.

The sub-scanning gate signal generation device 33 includes the sub-scanning counter 37 which is operated by a control signal from the printer controller 24, the signal /LSYNC, and the clock VCLK, a comparator 38 which compares a value of the sub-scanning counter 37 and correction data 2 obtained from the printer controller 24 and outputs a result thereof, and a gate signal generation device 39 which generates the sub-scanning gate signal /FGATE based on the result from the comparator 38.

With the above-described configuration, the writing start position controller 20 lt corrects writing start positions of images of cyan, magenta, and yellow in units of one cycle of the clock VCLK, i.e., in units of one dot, with respect to the main scanning direction, and in units of one cycle of the signal /LSYNC, i.e., in units of one line, with respect to the sub-scanning direction.

Figure 5:
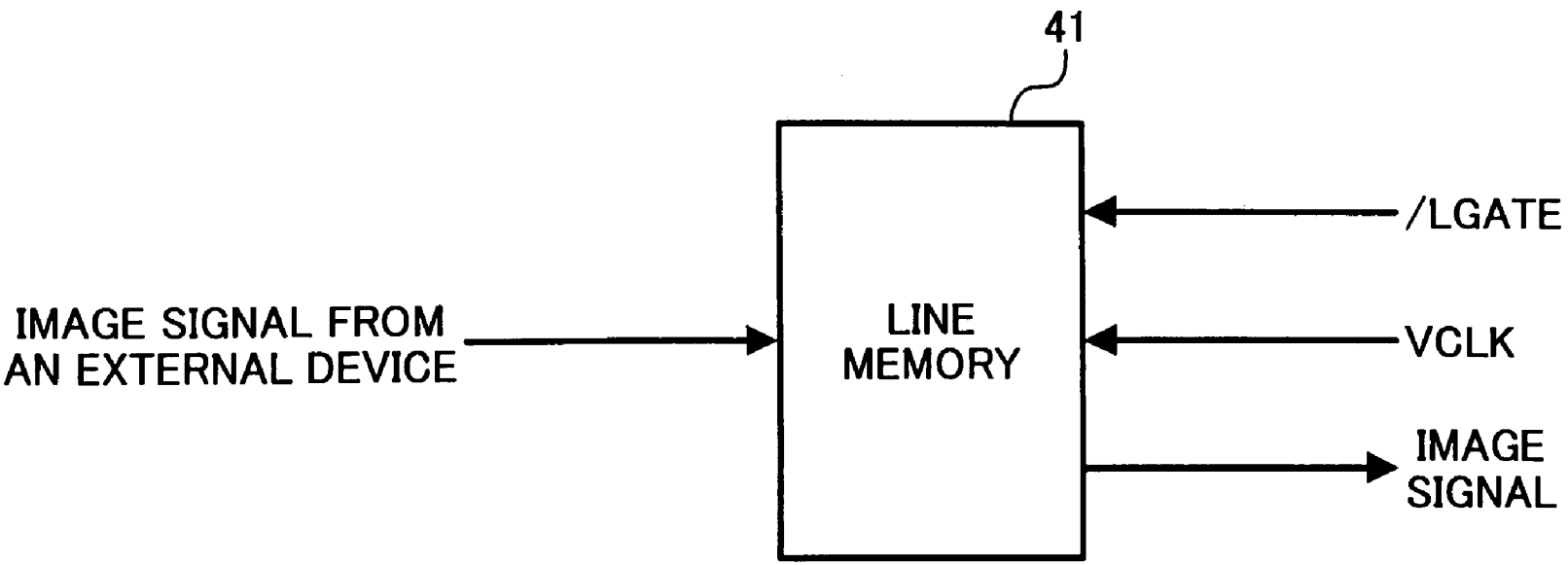
FIG. 5 is a diagram illustrating an exemplary construction of a front part of the image formation controller.

FIG. 5 illustrates an exemplary construction of a front part of the image formation controller 12 illustrated in FIG. 3. As illustrated in FIG. 5, the front part of the image formation controller 12 includes a line memory 41, and is configured to output an image signal, that has been captured at a timing of the sub-scanning gate signal /FGATE from an external device such as a frame memory and a scanner, for an interval of "L" of the main scanning gate signal /LGATE in synchronism with the clock VCLK. The output image signal is sent to the LD controller 22 (see FIG. 3A), and the LD of the LD unit 7 of the optical beam scan device 6 corresponding to the image signal is turned on at a timing of the image signal.

Accordingly, by changing correction data which is set by the printer controller 24 at the comparators 35 and 38 (see FIG. 4), timings of the main scanning gate signal /LGATE and the sub-scanning gate signal /FGATE change, and thereby a timing of an image signal changes, so that image writing start positions in the main scanning and sub-scanning directions change.

Figure 6:
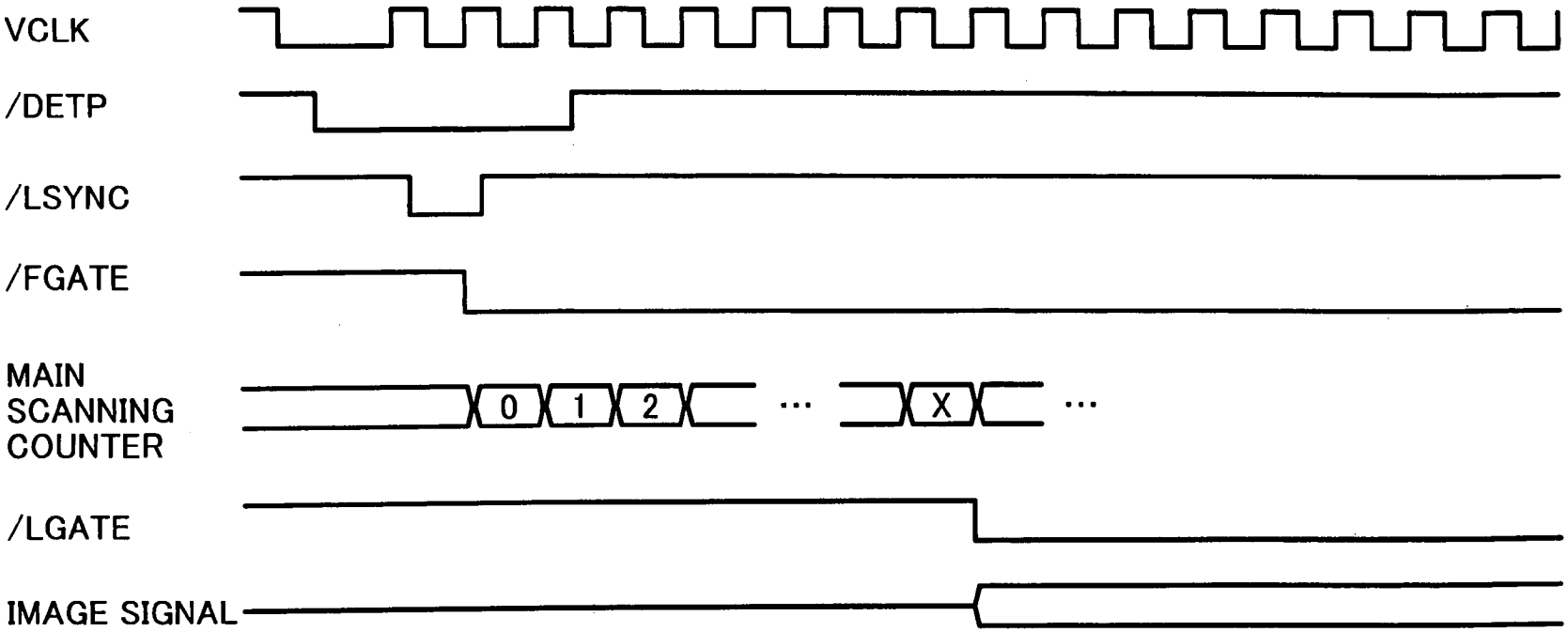
FIG. 6 is a diagram illustrating a timing chart of the writing start position controller.

FIG. 6 illustrates a timing chart of the writing start position controller 20 (see FIG. 3A and FIG. 4). As illustrated in FIG. 6, the main scanning counter 34 is reset with the signal /LSYNC and is counted up with the clock VCLK. When a counter value of the main scanning counter 34 has reached the correction data 1 (in this case "X") set by the printer controller 24, a comparison result is output from the comparator 35, and the main scanning gate signal /LGATE is made "L" (effective) by the gate signal generation device 36. The main scanning gate signal /LGATE is a signal that is "L" for the width of an image in the main scanning direction. With respect to the sub-scanning direction, the sub-scanning counter 37 is counted up with the signal /LSYNC instead of the clock VCLK, and the rest is the same as in the main scanning direction.

Figure 7:
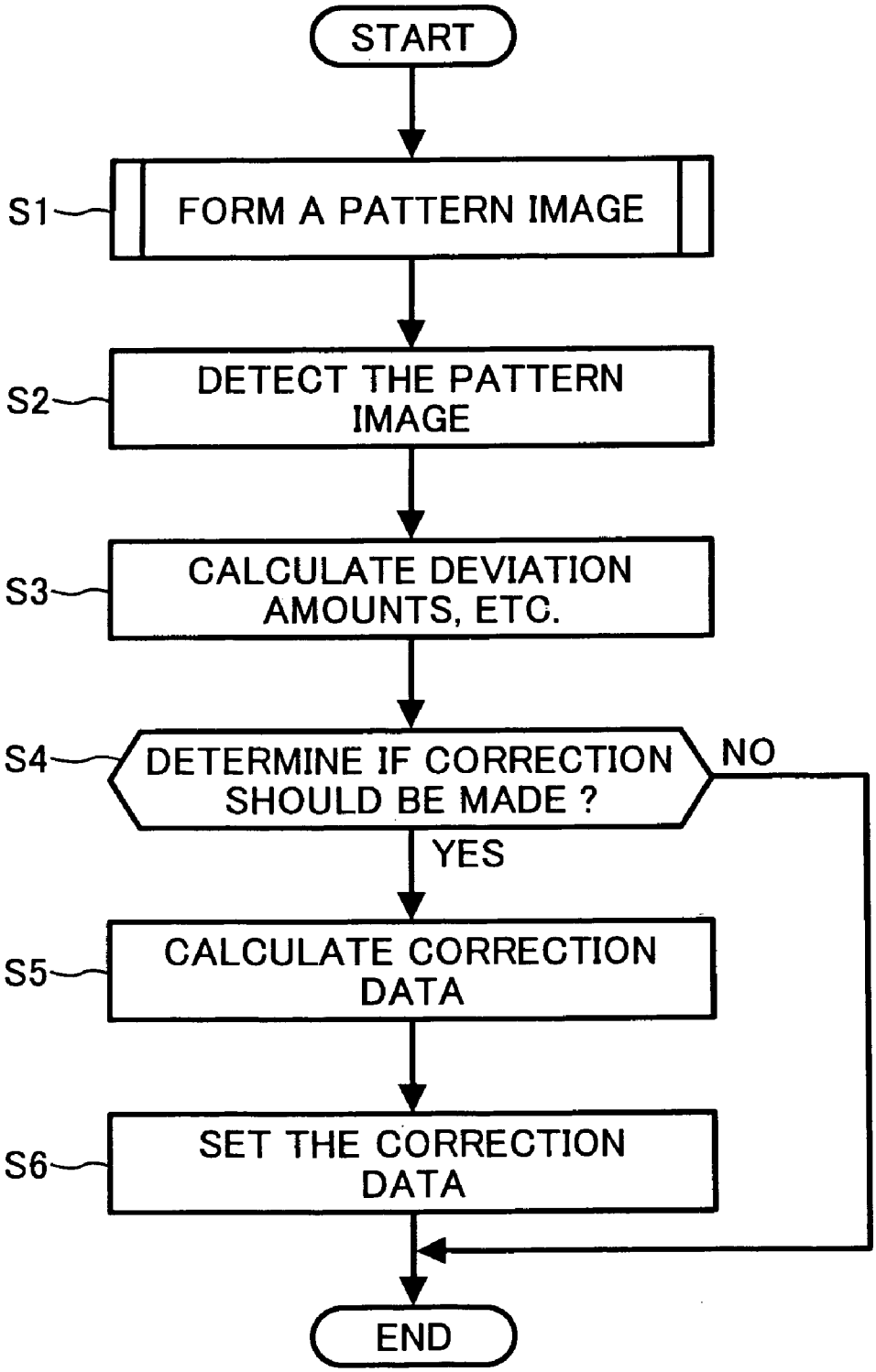
FIG. 7 is a flowchart of an operation of correcting deviations in position and errors in magnification ratio of images of individual colors that are superimposed on top of one another to form a full color image in the image forming apparatus.

FIG. 7 illustrates an operation flow of an operation of correcting deviations in position and errors in magnification ratio of images of individual colors that are superimposed on top of one another to form a full color image. This operation is performed when it is determined in a process of determining whether or not deviations in position and errors in magnification ratio of images of individual colors that are superimposed on top of one another to form a full color image can be correctly corrected (described later).

First, the pattern image for correcting illustrated in FIG. 2 is formed on the transfer belt 11 as described above under control of the image formation controller 12 (S1). The first sensor 13 and the second sensor 14 detect the pattern image for correcting formed on the transfer belt 11 (S2). The printer controller 24 of the image formation controller 12 calculates as described above amounts of deviations in position in the main scanning and sub-scanning directions and amounts of errors in magnification ratio in the main scanning direction of pattern images of individual colors relative to a pattern image of black (S3). The printer controller 24 then determines if calculated amounts of deviations in position and errors in magnification ratio of pattern images of individual colors are at levels that correction should be made, respectively (S4).

In this example, correction of a deviation in position of an image of a color is made in units of one dot in the main scanning direction and in units of one line in the sub-scanning direction. That is, when the amount of a deviation in position in the main scanning direction of an image of a color is ½ dot or greater, it is determined that correction should be made, and when the amount of a deviation in position in the sub-scanning direction of an image of a color is ½ line or greater, it is determined that correction should be made. Thus, when it is determined with respect to an image of a certain color that the amount of a deviation in position in the main scanning direction and/or the amount of a deviation in position in the sub-scanning direction is at the level that correction should be made (Yes in S4), correction data for correcting the deviation in position in the main scanning direction (i.e., the correction data 1) and/or correction data for correcting the deviation in position in the sub-scanning direction (i.e., the correction data 2) are calculated (S5). The correction data 1 is set at the main scanning gate signal generation device 32 and the correction data 2 is set at the sub-scanning gate signal generation device 33 (S6), and thereby the main scanning gate signal /LGATE and the sub-scanning gate signal /FGATE are generated.

With respect to correction of an error in magnification ratio in the main scanning direction of an image of a certain color, similarly, the printer controller 24 determines according to a predetermined accuracy for correction of errors in magnification ratio whether or not the calculated amount of an error in magnification ratio of an image of a certain color is at a level that correction should be made (S4). When correcting the error in magnification ratio, the printer controller 24 calculates a setting value of a frequency of the clock WCLK necessary for correcting the error in magnification ratio (S5), sets the calculated setting value at the writing clock generation device 21 (S6), and thereby the clock WCLK is generated.

Thus, by using the main scanning gate signal /LGATE, the sub-scanning gate signal/FGATE, and the clock WCLK generated for each of images of individual colors as described above, outputting of a full color image in which deviations in position and errors in magnification ratio of images of individual colors have been corrected is enabled.

Figure 8:
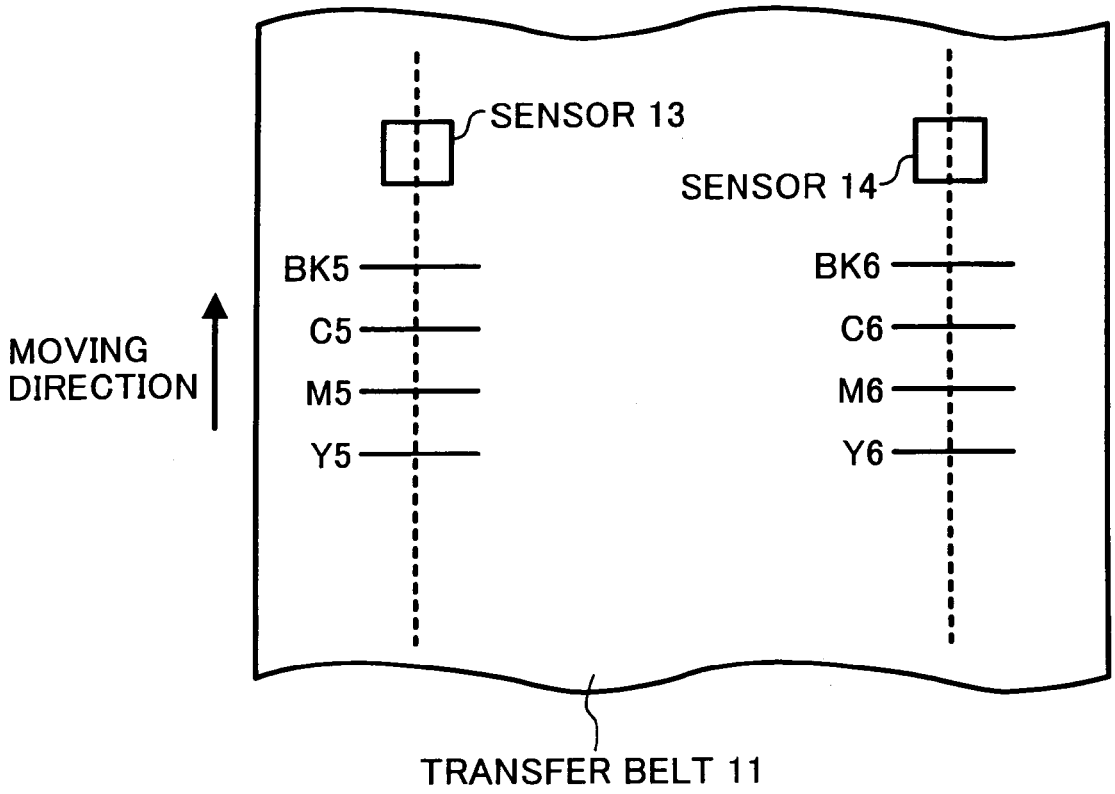
FIG. 8 is a diagram illustrating an exemplary pattern image for checking whether or not deviations in position and errors in magnification ratio of images of individual colors that are superimposed on top of one another to form a full color image can be correctly corrected.

FIG. 8 illustrates an exemplary pattern image for checking whether or not deviations in position and errors in magnification ratio of images of individual colors that are superimposed on top of one another to form a full color image can be correctly corrected (hereinafter referred to as the pattern image for checking). As illustrated, the pattern image for checking is an image of a pattern of lines in individual colors, i.e., lateral lines BK5 and BK6 in black, lateral lines C5 and C6 in cyan, lateral lines M5 and M6 in magenta, and lateral lines Y5 and Y6 in yellow. In this example, lateral lines are used; however the slant lines may be used. The pattern image for checking is formed on the transfer belt 11 at a part of the transfer belt 11 between parts thereof conveying recording sheets, respectively, (i.e., between a part of the transfer belt 11 conveying a recording sheet on which an image of a page has been formed, and a part of the transfer belt 11 conveying a recording sheet on which an image of the next page has been formed) before starting the operation of calculating and setting correction data for correcting deviations in position and errors in magnification ratio of images of individual colors illustrated in FIG. 7. The first sensor 13 and the second sensor 14 detect the pattern image for checking formed on the transfer belt 11, and based upon a result thereof, the printer controller 24 functioning as a correction possibility determination device of the present invention determines whether or not deviations in position and errors in magnification ratio of images of individual colors that are superimposed on top of one another can be correctly corrected. In this example, a detection device of the present invention is realized by the first sensor 13 and the second sensor 14.

Figure 9:
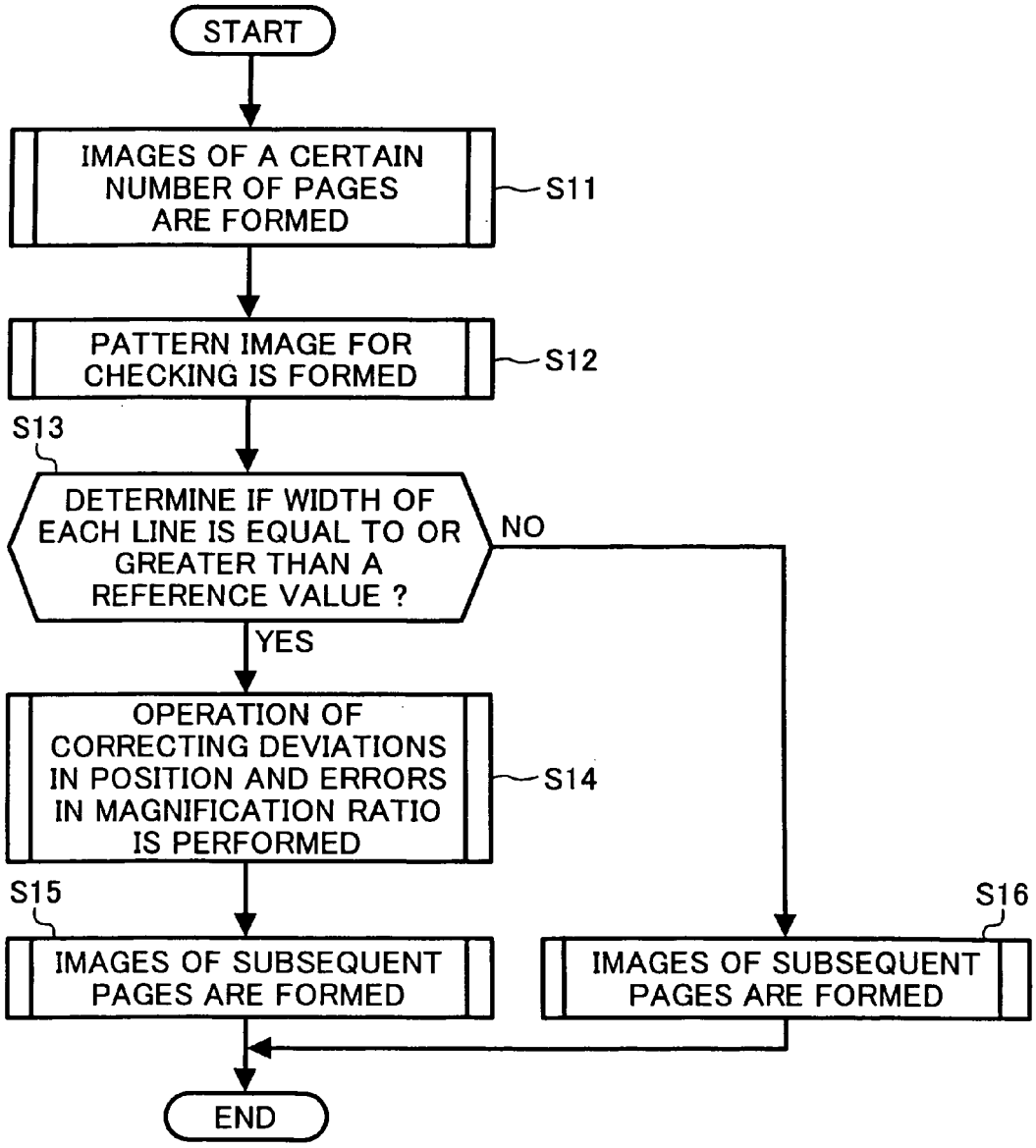
FIG. 9 is a flowchart of an operation of correcting deviations in position and errors in magnification ratio of images of individual colors that are superimposed on top of one another to form a full color image, according to the first preferred embodiment of the present invention.

FIG. 9 illustrates an operation flow of an operation of correcting deviations in position and errors in magnification ratio of images of individual colors that are superimposed on top of one another to form a full color image, according to the first embodiment of the present invention. The operation is executed at a specified timing, e.g., every time when images for 100 pages have been formed.

After forming images of a certain number of pages (in this example, 100 pages) since the operation of correcting deviations in position and errors in magnification ratio of images of individual colors that are superimposed on top of one another to form a full color image has been performed last (S11), the pattern image for checking illustrated in FIG. 8 is formed on the transfer belt 111 as described above, at a part of the transfer belt 11 between parts of the transfer belt 11 conveying recording sheets, respectively, i.e., between a part of the transfer belt 11 conveying a recording sheet on which an image of the last page of the certain number of pages (in this example, an image of the 100th page of 100 pages) has been formed, and a part of the transfer belt 11 conveying a recording sheet on which an image of the next page has been formed (S12).

The pattern image for checking formed on the transfer belt 11 is detected by the first sensor 13 and the second sensor 14, and the printer controller 24 determines if the width of each line of the pattern of lines of the pattern image for checking formed on the transfer belt 11 is equal to or greater than a reference value (S13). When the width of a line in a color of the pattern of lines of the pattern image for checking formed on the transfer belt 11 is smaller than the reference value, it indicates that the line of the color is blurred or includes a thin spot. In this case, even when the operation of correcting deviations in position and errors in magnification ratio of images of individual colors illustrated in FIG. 7 is executed, amounts of a deviation in position and/or an error in magnification ratio of a pattern image for correcting of the color, calculated in the operation, may not be correct, so that the deviation in position and/or the error in magnification ratio of the pattern image for correcting of the color cannot be correctly corrected. Thus, whether or not deviations in position and errors in magnification ratio of images of individual colors that are superimposed on top of one another can be correctly corrected is determined based upon the width of each line of the pattern of lines of the pattern image for checking formed on the transfer belt 11.

When the width of each line of the pattern of lines of the pattern image for checking formed on the transfer belt 11 is equal to or greater than the reference value (Yes in S13), it is determined that deviations in position and errors in magnification ratio of images of individual colors that are superimposed on top of one another to form a full color image can be correctly corrected, and the operation of calculating and setting correction data for correcting deviations in position and errors in magnification ratio of images of individual colors illustrated in FIG. 7 is executed (S14). When the next page after the last page of a certain number of pages (in this example, after the 100th page of 100 pages) for which an operation of forming an image has not been started exists, the operation of correcting deviations in position and errors in magnification ratio of images of individual colors of step S14 is executed after interrupting the operation of forming the image of the next page, and when the operation of forming the image of the next page has been already started, the operation of correcting deviations in position and errors in magnification ratio of images of individual colors of step S14 is executed after the image of the next page has been formed. Thereafter, images of subsequent pages (including the image of the next page which has been interrupted) are formed in a state that correction data for correcting deviations in position and errors in magnification ratio of images of individual colors is set (S15).

When the width of any one line of the pattern of lines of the pattern image for checking formed on the transfer belt 11 is smaller than the reference value (No in S13), it is determined that deviations in position and errors in magnification ratio of images of individual colors that are superimposed on top of one another cannot be correctly performed, and without performing the operation of correcting deviations in position and errors in magnification ratio of images of individual colors illustrated in FIG. 7, images of subsequent pages are formed (S16).

Figure 10:
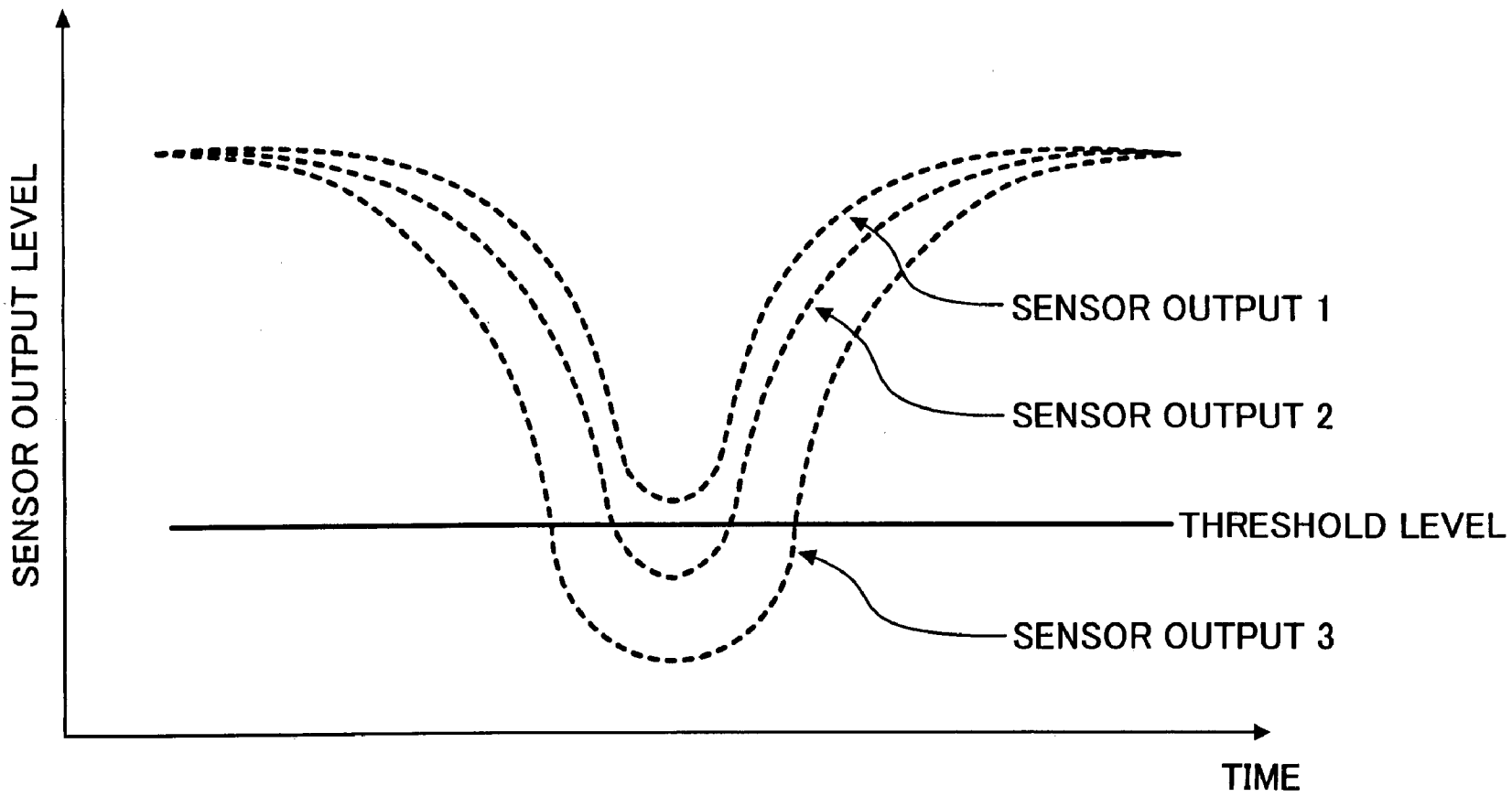
FIG. 10 is a diagram illustrating output signals of a first sensor and a second sensor detecting the pattern image for checking formed on a transfer belt of the apparatus.

FIG. 10 illustrates output signals of the first sensor 13 and the second sensor 14 detecting the pattern image for checking formed on the transfer belt 11. As described above, the printer controller 24 determines whether or not deviations in position and errors in magnification ratio of images of individual colors that are superimposed on top of another can be correctly corrected based upon the width of each line of the pattern of lines of the pattern image for checking formed on the transfer belt 11. The printer controller 24 calculates the width of each line of the pattern of lines of the pattern image for checking formed on the transfer belt 11 based upon a detection signal of each line of the pattern of lines of the pattern image for checking, output from the first sensor 13 and the second sensor 14, and a threshold level set in advance.

In FIG. 10, a sensor output signal 1 does not reach the threshold level, so that the printer controller 24 determines that a corresponding line has not been detected. A sensor output signal 2 reaches the threshold level, so that the width of a corresponding line can be calculated. However, because the sensor output signal 2 is close to the threshold level, when the operation of correcting deviations in position and errors in magnification ratio of images of individual colors of step S14 is subsequently performed, there is a possibility that a sensor output signal relative to a line of a certain color of the pattern of lines of the pattern image for correcting formed on the transfer belt 11 at that time does not reach the threshold level. In such a case, the deviation in position and/or the error in magnification ratio of the pattern image for correcting of the color cannot be corrected. A sensor output signal 3 sufficiently reaches the threshold level, that is, the width of a corresponding line of the pattern of lines of the pattern image for checking is large enough. In this case, when the operation of correcting deviations in position and errors in magnification ratio of images of individual colors of step S14 is subsequently performed, amounts of deviations in position and errors in magnification ratio of pattern images for correcting of individual colors cannot be correctly calculated. Accordingly, it is necessary that the reference value for determining the width of each line of the pattern of lines of the pattern image for checking in the operation flow of FIG. 9 is determined slightly on the safe side considering the operation of correcting deviations in position and errors in magnification ratio of images of individual colors, that is subsequently performed.

Thus, in the above-described image forming apparatus according to the first preferred embodiment of the present invention, before executing the operation of correcting deviations in position and errors in magnification ratio of images of individual colors that are superimposed on top of one another to form a full color image, whether or not deviations in position and errors in magnification ratio of images of individual colors that are superimposed on top of one another to form a full color image can be correctly corrected is determined by forming the pattern image for checking on the transfer belt 11 and by determining if the width of each line of the pattern of lines of the pattern image for checking formed on the transfer belt 11 is equal to or greater than the reference value. When it has been determined that deviations in position and errors in magnification ratio of images of individual colors that are superimposed on top of one another to form a full color image cannot be correctly corrected, the operation of correcting deviations in position and errors in magnification ratio of images of individual colors is not performed, and thereby lowering of the printing speed of the apparatus due to the time otherwise consumed for uselessly performing the operation of correcting deviations in position and errors in magnification ratio of images of individual colors can be avoided.

Now, a second preferred embodiment of the present invention is described. The constructions of an image forming apparatus and an image formation controller of this embodiment are substantially the same as those of the first embodiment. Also, a pattern image for correcting deviations in position and errors in magnification ratio of images of individual colors that are superimposed on top of one another to form a full color image and a pattern image for checking whether or not deviations in position and errors in magnification ratio of images of individual colors that are superimposed on top of one another to form a full color image can be correctly corrected of this embodiment are substantially the same as those of the first embodiment.

Figures 11, 11A:
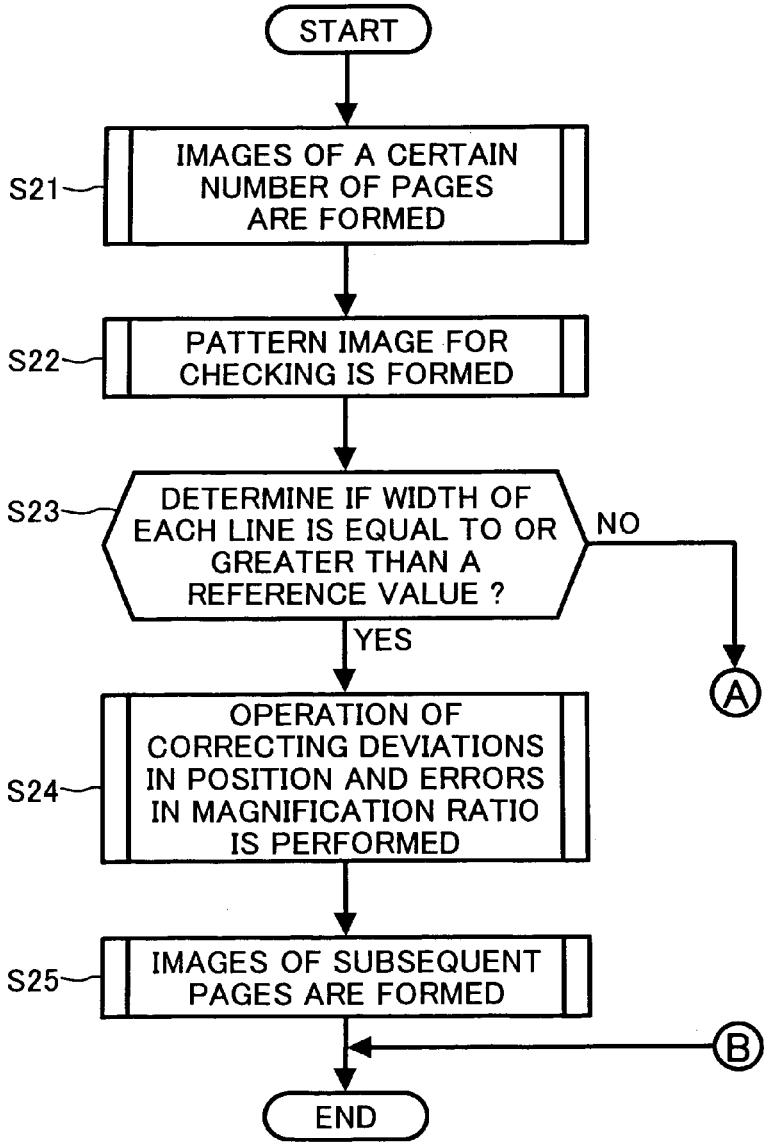
FIG. 11A and FIG. 11B are flowcharts of an operation of correcting deviations in position and errors in magnification ratio of images of individual colors that are superimposed on top of one another to form a full color image, according to a second preferred embodiment of the present invention.
Figure 11B:
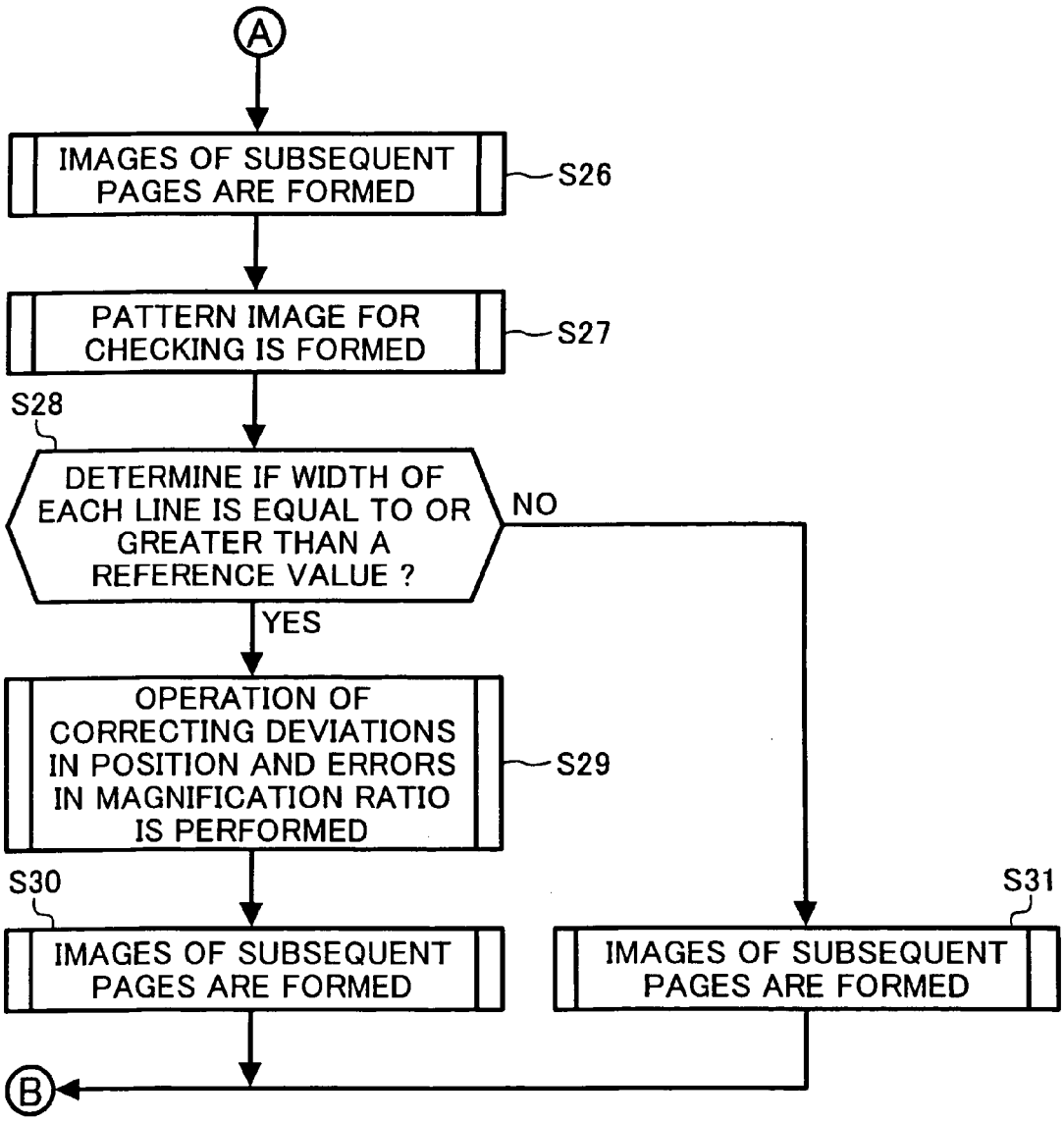

FIG. 11A and FIG. 11B illustrate an operation flow of an operation of correcting deviations in position and errors in magnification ratio of images of individual colors that are superimposed on top of one another to form a full color image, according to the second embodiment. The operation differs from that of the previous embodiment in that when it has been determined that deviations in position and errors in magnification ratio of images of individual colors that are superimposed on top of one another to form a full color image cannot be correctly corrected, after forming images of a predetermined quantity, whether or not deviations in position and errors in magnification ratio of images of individual colors can be correctly corrected is determined again by forming the pattern image for checking and by determining if the width of each line of the pattern of line of the pattern image for checking is equal to or greater than the reference value. Image forming conditions of the apparatus sometimes change with replenishment of toner, etc. during an operation of forming images. Therefore, in this embodiment, after an operation of forming images of a predetermined quantity has been performed, the pattern image for checking is formed again on the transfer belt 11 to determine if the width of each line of the pattern of lines of the pattern image for checking formed on the transfer belt 11 is equal to or greater than the reference value.

In this embodiment, after forming images of a certain number of pages (in this example, 100 pages) since the operation of correcting deviations in position and errors in magnification ratio of images of individual colors has been performed last (S21), the pattern image for checking illustrated in FIG. 8 is formed on the transfer belt 11 at a part of the transfer belt 11 between parts of the transfer belt 11, conveying recording sheets, respectively, as in the first embodiment (S22). The pattern image for checking is detected by the first sensor 13 and the second sensor 14, and the printer controller 24 determines if the width of each line of the pattern of lines of the pattern image for checking is equal to or greater than a reference value (S23).

When the width of each line of the pattern of lines of the pattern image for checking formed on the transfer belt 11 is equal to or greater than the reference value (Yes in S23), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S24). When the next page after the last page of a certain number of pages (in this example, after the 100th page of 100 pages) for which an operation of forming an image has not been started exists, the operation of correcting deviations in position and errors in magnification ratio of images of individual colors of step S24 is executed after interrupting the operation of forming the image of the next page. When the operation forming the image of the next page has been already started, the operation of correcting deviations in position and errors in magnification of images of individual colors of step S24 is executed after the image of the next page has been formed. Thereafter, images of subsequent pages (including the image of the next page which has been interrupted) are formed in a state that correction data for correcting deviations in position and errors in magnification ratio of images of individual colors is set (S25).

When the width of any one line of the pattern of lines of the pattern image for checking formed on the transfer belt 11 is smaller than the reference value (No in S23), it is determined that deviations in position and errors in magnification ratio of images of individual colors that are superimposed on top of one another to form a full color image cannot be correctly corrected, and without performing the operation of correcting deviations in position and errors in magnification ratio of images of individual colors illustrated in FIG. 7, images of subsequent pages are formed (S26). After images of a predetermined number of pages have been formed, the pattern image for checking is formed again on the transfer belt 11 substantially in the same manner as in step S22 (S27). The pattern image for checking formed on the transfer belt 11 is detected by the first sensor 13 and the second sensor 14, and it is determined if the width of each line of the pattern of lines of the pattern image for checking formed on the transfer belt 11 is equal to or greater than the reference value (S28).

When it is determined that the width of each line of the pattern of lines of the pattern image for checking on the transfer belt 11 is equal to or greater than the reference value (Yes is S28), then it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed as in step S24 (S29). Thereafter, images of subsequent pages are formed in a state that correction data for correcting deviations in position and errors in magnification ratio of images of individual colors is set (S30).

When the width of any one line of the pattern of lines of the pattern image for checking formed on the transfer belt 11 is still smaller than the reference value (No in S28), it is determined that deviations in position and errors in magnification ratio of images of individual colors that are superimposed on top of one another to form a full color image cannot be correctly corrected, and without performing the operation of correcting deviations in position and errors in magnification ratio of images of individual colors illustrated in FIG. 7, images of subsequent pages are formed (S31).

Thus, in this embodiment, when it is determined that deviations in position and errors in magnification ratio of images of individual colors that are superimposed on top of one another to form a full color image cannot be correctly corrected, after forming images of a predetermined number of pages, whether or not deviations in position and errors in magnification ratio of images of individual colors that are superimposed on top of one another to form a full color image can be correctly corrected is determined again, and if it has been determined that deviations in position and errors in magnification ratio of images of individual colors that are superimposed on top of one another to form a full color image can be corrected correctly, the operation of correcting deviations in position and errors in magnification ratio of images of individual colors of FIG. 7 is performed. Therefore, deterioration of image quality can be avoided as much as possible. In this embodiment, whether or not deviations in position and errors in magnification ratio of images of individual colors that are superimposed on top of one another to form a full color image can be correctly corrected is determined twice, however, it can be determined any number of times.

Next, a third preferred embodiment of the present invention is described. The constructions of an image forming apparatus and an image formation controller of this embodiment, and a pattern image for correcting deviations in position and errors in magnification ratio of images of individual colors that are superimposed on top of one another to form a full color image, and a pattern image for checking whether or not deviations in position and errors in magnification ratio of images of individual colors that are superimposed on top of one another to form a full color image can be correctly corrected of this embodiment are substantially the same as those of the first embodiment.

Figure 12:
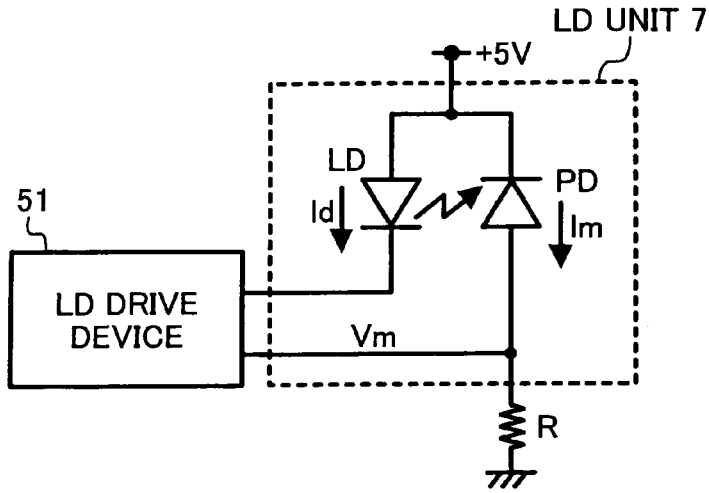
FIG. 12 is a diagram illustrating an exemplary construction of an LD unit of the apparatus, according to a third preferred embodiment of the present invention.

FIG. 12 illustrates an exemplary construction of the LD unit 7 of each optical beam scan device 6 according to this embodiment. The LD unit 7 includes an LD (laser diode) and a PD (photodiode). An LD drive device 51 (of the LD controller 22 of the image formation controller 22) illustrated in FIG. 12 controls an LD current Id such that a monitor voltage Vm of the PD is kept constant in order to light the LD with a light quantity instructed from the printer controller 24. Such an operation of the LD drive device 51 to light the LD with an instructed light quantity is called an APC (automatic power control) operation. When changing the light quantity of the LD, a setting value of the monitor voltage Vm of the PD is changed according to an instruction from the printer controller 24, and the LD current Id is controlled such that the monitor voltage Vm is kept at the changed setting value.

Figure 13:
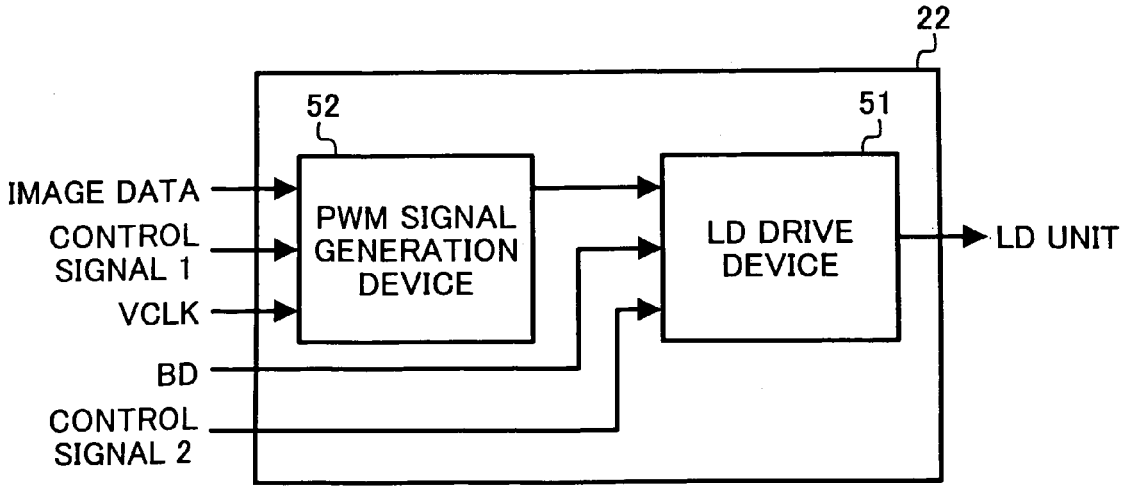
FIG. 13 is a diagram illustrating an exemplary construction of an LD controller of the third preferred embodiment.

FIG. 13 illustrates an exemplary construction of the LD controller 22 according to the third embodiment. The LD controller 22 includes the LD drive device 51 configured to control the light quantity of the LD of each optical beam scan device 6 and a PWM (pulse width modulation) signal generation device 52 configured to control the lighting timing of the LD. The PWM signal generation device 52 outputs a PWM signal to the LD drive device 51 according to image data and a control signal 1 input from the printer controller 24, and the LD drive device 51 lights the LD of a corresponding optical scan device 6 for a period of time corresponding to the PWM signal. Further, by inputting the forced LD lighting signal BD from the synchronization detect lighting controller 19 into the LD drive device 51, the LD is lit for a period of time corresponding to the forced LD lighting signal BD. A value for setting a light quantity of the LD when the LD is lit is set in a register at the LD drive device 51 by a control signal 2 from the printer controller 24.

Image data may be constructed by 1-bit or a plurality of bits (2-bit or greater). When image data is constructed by 1-bit, the PWM signal generation device 52 may be configured to generate the PWM signal in a predetermined pulse width or to generate the PWM signal in a pulse width selected according to the control signal 1 (select signal) from the printer controller 24. When image data is configured by a plurality of bits, the PWM signal generation device 52 may be configured to generate the PWM signal in a pulse width corresponding to the image data, or to generate the PWM signal while changing a pulse width of the PWM signal to the one corresponding to the image data according to the control signal 1 (select signal) from the printer controller 24.

Figure 14:
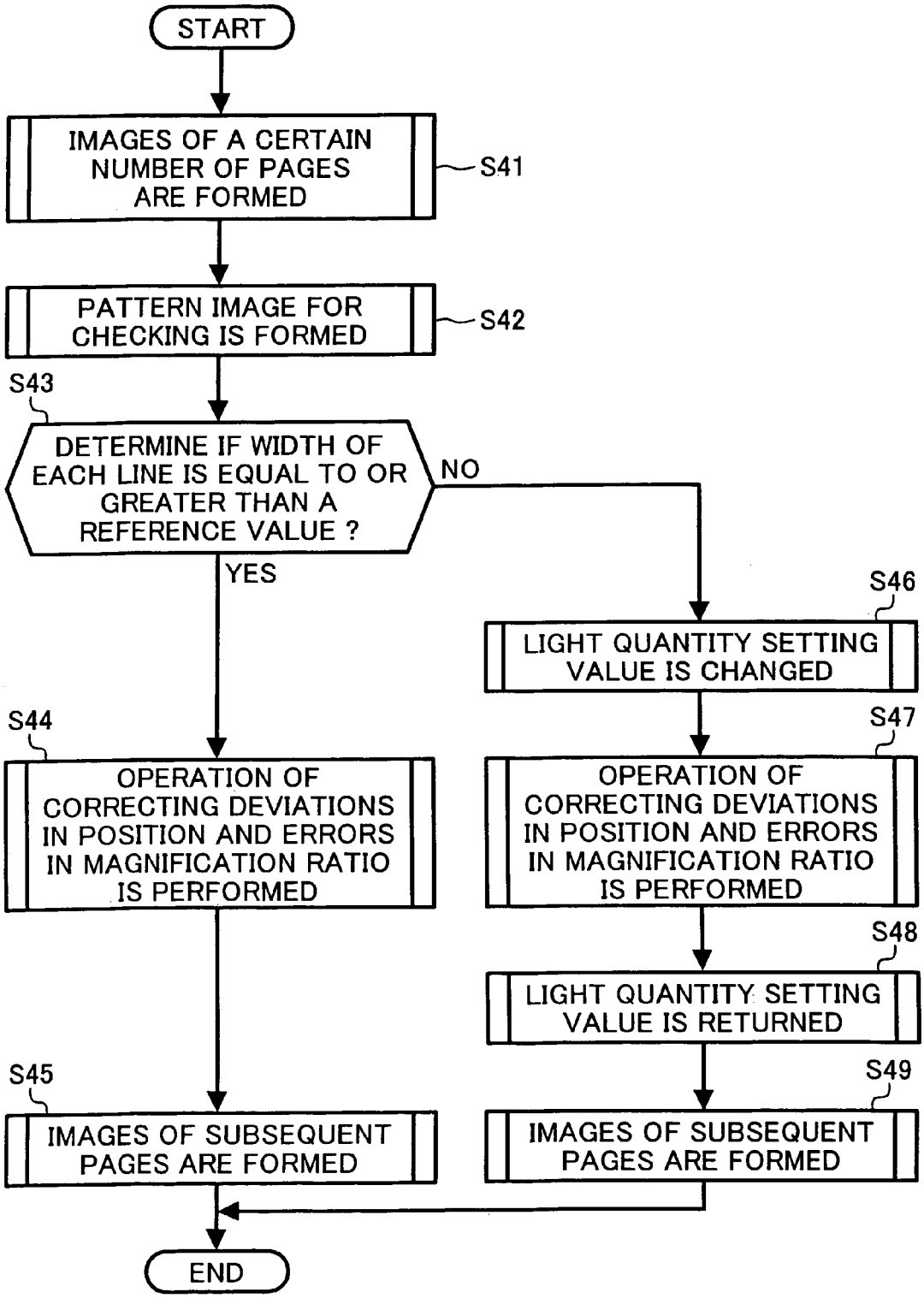
FIG. 14 is a flowchart of an operation of correcting deviations in position and errors in magnification ratio of images of individual colors that are superimposed on top of one another to form a full color image, according to the third preferred embodiment.

FIG. 14 illustrates an operation flow of an operation of correcting deviations in position and errors in magnification ratio of images of individual colors that are superimposed on top of one another to form a full color image, according to the third embodiment. The operation differs from that of the first embodiment in that when the width of any one line of the pattern of lines of the pattern image for checking formed on the transfer belt 11 has been determined as smaller than the reference value, the value for setting the light quantity of the LD of the optical scan device 6, with which a line of the pattern of lines of the pattern image for checking on the transfer belt 11, the width of which has been determined as smaller than the reference value, has been formed, is changed, and thereafter the operation of correcting deviations in position and errors in magnification ratio of images of individual colors of FIG. 7 is performed, the value for setting the light quantity of the LD of the optical scan device 6 is returned to the one before having been changed, and then images of subsequent pages are formed. In this embodiment, thus, the light quantity of the LD of each optical beam scan device 6 as an image forming condition of the corresponding image forming device 1 can be changed.

Referring to FIG. 14, after forming images of a certain number of pages (in this example, 100 pages) since the operation of correcting deviations in position and errors in magnification ratio of images of individual colors has been performed last (S41), the pattern image for checking illustrated in FIG. 8 is formed on the transfer belt 11 at a part of the transfer belt 11 between parts of the transfer belt 11, conveying recording sheets, respectively, as in the first embodiment. The pattern image for checking formed on the transfer belt 11 is detected by the first sensor 13 and the second sensor 14, and the printer controller 24 determines if the width of each line of the pattern of lines of the pattern image for checking formed on the transfer belt 11 is equal to or greater than a reference value (S43).

When the width of each line of the pattern of lines of the pattern image for checking formed on the transfer belt 11 is equal to or greater than the reference value (Yes in S43), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S44). When the next page after the last page of a certain number of pages (in this example, after the 100th page of 100 pages) for which an operation of forming an image has not been started exists, the operation of correcting deviations in position and errors in magnification ratio of images of individual colors of step S44 is executed after interrupting the operation of forming the image of the next page. When the operation of forming the image of the next page has been already started, the operation of correcting deviations in position and errors in magnification of images of individual colors of step S44 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S45).

When the width of any one line of the pattern of lines of the pattern image for checking formed on the transfer belt 11 is smaller than the reference value (No in S43), it is determined that deviations in position and errors in magnification ratio of images of individual colors that are superimposed on top of one another to form a full color image cannot be correctly corrected, and the value for setting the light quantity of the LD of the optical beam scan device 6, with which a line of the pattern of lines of the pattern image for checking on the transfer belt 11, the width of which has been determined as smaller than the reference value, has been formed, is changed (S46). When an operation of forming an image of the next page has been already started, the value for setting the light quantity of the LD is changed after the image of the next page has been formed. Then, the operation of correcting deviations in position and errors in magnification ratio of images of individual colors illustrated in FIG. 7 is executed (S47). The value of setting the light quantity of the LD is returned to the one before having been changed (S48), and images of subsequent pages are formed (S49).

Figure 15:
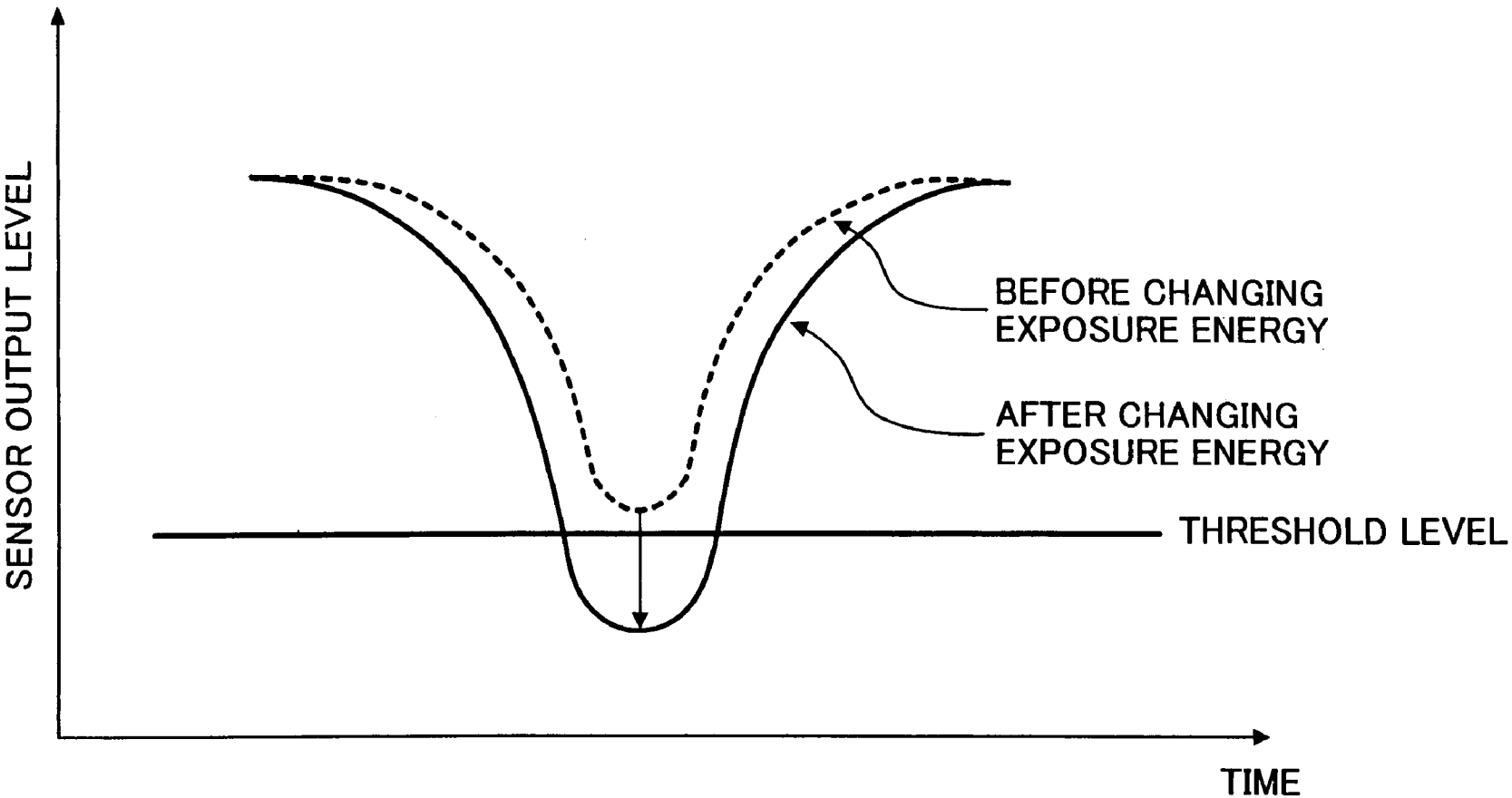
FIG. 15 is a diagram illustrating output signals of the first sensor and the second sensor in the third preferred embodiment.

FIG. 15 illustrates output signals of the first sensor 13 and the second sensor 14 detecting the pattern image for checking formed on the transfer belt 11 in this embodiment. Due to environmental changes, changes in the apparatus over time, and/or accidental abnormal conditions in the apparatus, there is a possibility that a line of the pattern of lines of the pattern image for checking formed on the transfer belt 11 is thin or blurred or includes a white spot. In such a case, a signal not reaching the threshold level as illustrated in FIG. 15 by a dotted line may be output. Therefore, in this embodiment, the exposure energy of the LD of each optical beam scan device 6, in this case the light quantity of the LD, can be increased, so that density of the pattern image for checking (quantity of toner adhering to the pattern image) formed on the transfer belt 11 is increased and thereby output signals of the first sensor 13 and the second sensor 14 detecting the pattern image for checking on the transfer belt 11 sufficiently exceed the threshold level. In this case, when images are formed, if the exposure energy of the LD is excessively large, the images may be crashed or destroyed. Therefore, the exposure energy of the LD is set large only when the operation of correcting deviations in position and errors in magnification ratio of images of individual colors of FIG. 7 is performed in step S67. As described above, the pattern image for correcting is an image of a pattern of lines having no gradation, so that even when the exposure energy of the LD is increased, no problem is caused.

An optimum light quantity of the LD, that is suitable for increasing a width of a line of the pattern of lines of the pattern image for checking formed on the transfer belt 11, that has been determined as smaller than the reference value, to exceed the reference value, can be selected, in response to a detection level of the line of the pattern of lines of the pattern image for checking on the transfer belt 11 that has been determined as smaller than the reference value at that time, from among ones obtained in advance by investigating to what extent the light quantity of the LD must be increased when a width of a line of the pattern of lines of the pattern image for checking formed on the transfer belt 11 is smaller than the reference value for various cases.

Thus, according to this embodiment, when a width of a line of the pattern of lines of the pattern image for checking formed on the transfer belt 11 is smaller than the reference value and it is determined that deviations in position and errors in magnification ratio of images of individual colors that are superimposed on top of one another to form a full color image cannot be correctly corrected, before forming the pattern image for correcting, the light quantity of the LD of the optical beam scan device 6, with which the line of the pattern of lines of the pattern image for checking on the transfer belt 11, the width of which has been determined as smaller than a reference value, has been formed, can be changed so that when the pattern image for correcting is subsequently formed on the transfer belt 11 for correcting deviations in position and errors in magnification ratio of images of individual colors, the width of each line of the pattern of lines of the pattern image for correcting formed on the transfer belt 11 is increased. Thereby, the operation of correcting deviations in position and errors in magnification ratio of images of individual colors can be reliably performed.

Now, a fourth preferred embodiment of the present invention is described. The fourth embodiment differs from the third embodiment in that the lighting timing (PWM value) of the LD of each optical beam scan device 6 as an image forming condition of the corresponding image forming device 1 is changed instead of the light quantity of the LD. As in the third embodiment, an optimum lighting timing (PWM value), that is suitable for increasing a width of a line of the pattern of lines of the pattern image for checking formed on the transfer belt 11, that has been determined as smaller than the reference value, to exceed the reference value, is selected, in response to a detection level of the line of the pattern of lines of the pattern image for checking on the transfer belt 11 that has been determined as smaller than the reference value at that time, from among ones obtained in advance by investigating to what extent the lighting timing (PWM value) of the LD must be increased when a width of a line of the pattern of lines of the pattern image for checking formed on the transfer belt 11 is smaller than the reference value for various cases.

Figure 16:
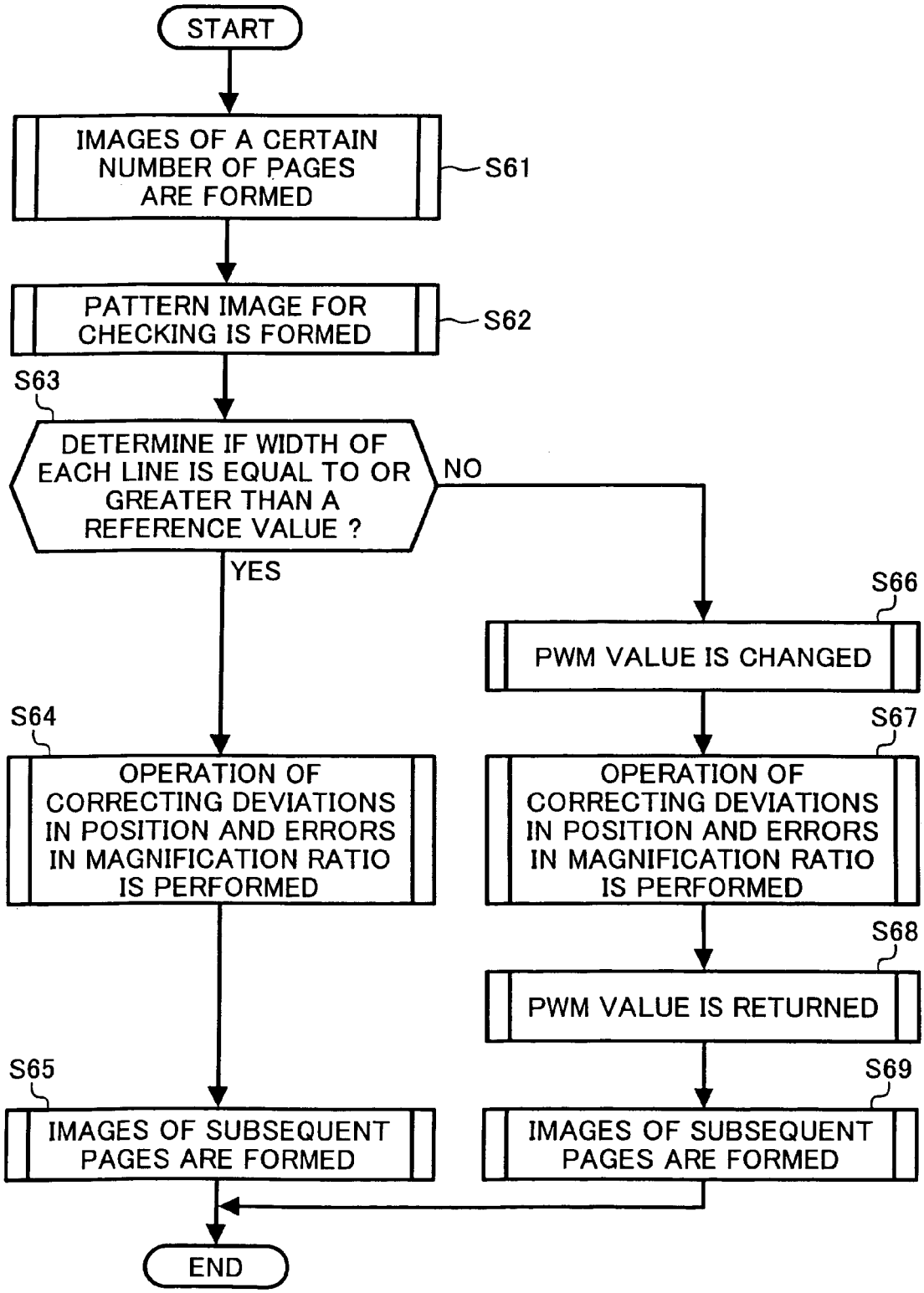
FIG. 16 is a flowchart of an operation of correcting deviations in position and errors in magnification ratio of images of individual colors that are superimposed on top of one another to form a full color image, according to a fourth preferred embodiment of the present invention.

FIG. 16 is an exemplary operation flow of an operation of correcting deviations in position and errors in magnification ratio of images of individual colors that are superimposed on top of one another to form a full color image, according to the fourth embodiment. After forming images of a certain number of pages (in this example, 100 pages) since the operation of correcting deviations in position and errors in magnification ratio of images of individual colors has been performed last (S61), the pattern image for checking illustrated in FIG. 8 is formed on the transfer belt 11 at a part of the transfer belt 11 conveying recording sheets, respectively, as in the first embodiment (S62). The pattern image for checking is detected by the first sensor 13 and the second sensor 14, and the printer controller 24 determines if the width of each line of the pattern of lines of the pattern image for checking formed on the transfer belt 11 is equal to or greater than a reference value (S63).

When the width of each line of the pattern of lines of the pattern image for checking is equal to or greater than the reference value (Yes in S63), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S64). When the next page after the last page of a certain number of pages (in this example, after the 100th page of 100 pages) for which an operation of forming an image has not been started exists, the operation of correcting deviations in position and errors in magnification ratio of images of individual colors of step S64 is executed after interrupting the operation of forming the image of the next page, and when the operation of forming the image of the next page has been already started, the operation of correcting deviations in position and errors in magnification of images of individual colors of step S64 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S65).

When the width of any one line of the pattern of lines of the pattern image for checking formed on the transfer belt 11 is smaller than the reference value (No in S63), it is determined that deviations in position and errors in magnification ratio of images of individual colors that are superimposed on top of one another to form a full color image cannot be correctly corrected, and the lighting timing (PWM value) of the LD of the optical beam scan device 6, with which a line of the pattern of lines of the pattern image for checking on the transfer belt 11, the width of which has been determined as smaller than the reference value, has been formed, is changed (S66). When an operation of forming an image of the next page has been already started, the lighting timing (PWM value) is changed after the image of the next page has been formed. Then, the operation of correcting deviations in position and errors in magnification ratio of images of individual colors illustrated in FIG. 7 is executed (S67). The lighting timing (PWM value) of the LD is returned to the one before having been changed (S68), and images of subsequent pages are formed (S69).

Thus, according to this embodiment, when a width of a line of the pattern of lines of the pattern image for checking formed on the transfer belt 11 is smaller than the reference value and it is determined that deviations in position and errors in magnification ratio of images of individual colors that are superimposed on top of one another to form a full color image cannot be correctly corrected, before forming the pattern image for correcting, the lighting timing (PWM value) of the LD of each optical beam scan device 6, with which a line of the pattern of lines of the pattern image for checking on the transfer belt 11, the width of which has been determined as smaller than the reference value, has been formed, can be changed so that when the pattern image for correcting is subsequently formed on the transfer belt 11 for correcting deviations in position and errors in magnification ratio of images of individual colors, the width of each line of the pattern of lines of the pattern image for correcting formed on the transfer belt 11 is increased. Thereby, the operation of correcting deviations in position and errors in magnification ratio of images of individual colors can be reliably performed.

The light quantity and the lighting timing (PWM value) of the LD can be both changed. Further, when the light quantity of the LD cannot be increased so much in relation to a maximum rated light quantity of the LD, the lighting timing (PWM value) may be changed, and when the lighting timing (PWM value) cannot be increased for the reason that the PWM value is already relatively large, the light quantity may be changed.

Now, a fifth preferred embodiment of the present invention is described. The constructions of an image forming apparatus and an image formation controller of this embodiment, and a pattern image for correcting deviations in position and error in magnification ratio of images of individual colors that are superimposed on top of one another to form a full color image, and a pattern image for checking whether or not deviations in position and errors in magnification ratio of images of individual colors that are superimposed on top of one another to form a full color image can be correctly corrected of this embodiment are substantially the same as those of the first embodiment.

Figure 17:
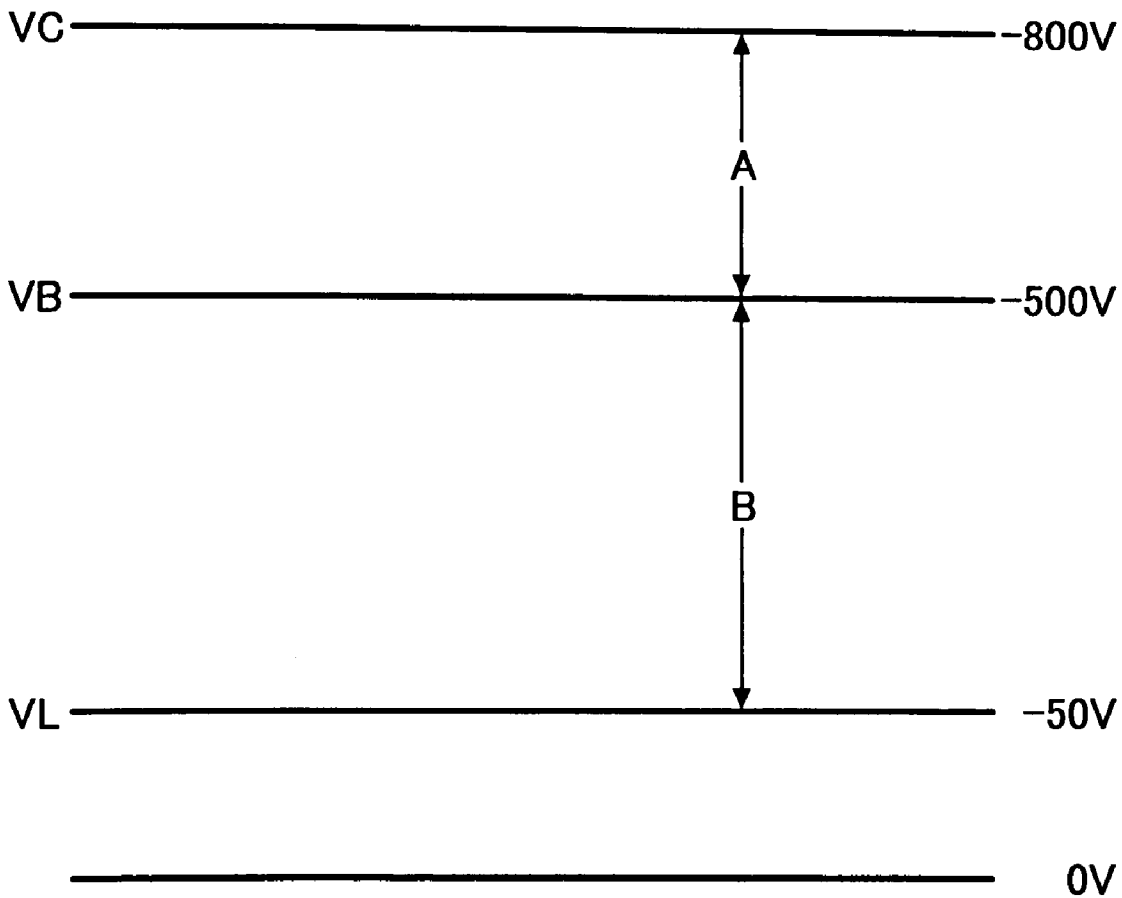
FIG. 17 is a diagram illustrating a relation of a photoconductor and a development device of an image forming apparatus according to a fifth preferred embodiment of the present invention.

FIG. 17 illustrates a relation of the photoconductor 2 and the development unit 3 of the image forming apparatus in this embodiment. In FIG. 17, "VC" represents a charge potential of the photoconductor 2, "VB" represents a bias voltage of a development roller of the development unit 3, and "VL" represents a potential of the photoconductor 2 (a potential of an exposed part of the photoconductor 2). Here, an upper limit of the charge potential VC of the photoconductor 2 is fixed in relation to deterioration of the photoconductor 2, and when the value of "B" in FIG. 17 is increased, image density increases, and when the value of "A" is decreased, a problem such as background soiling occurs. Therefore, in this embodiment, for example, the charge potential VC of the photoconductor 2 when forming images normally is optimized at −800V, the bias voltage VB of the development roller is optimized at −500V, and the potential VL of the photoconductor 2 is optimized at −50V. However, in detecting the pattern image for correcting formed on the transfer belt 11, even when background soiling slightly exists, detection of each line of the pattern of lines of the pattern image for correcting is not influenced by such background soiling.

Therefore, the value of B can be increased, that is, the bias voltage VB of the development roller can be increased to be more than −500V (for example, to −600V). Thereby, image density of the pattern image for correcting is increased, so that a detection margin of each line of the pattern of lines of the pattern image for correcting relative to the threshold level is increased.

Figure 18:
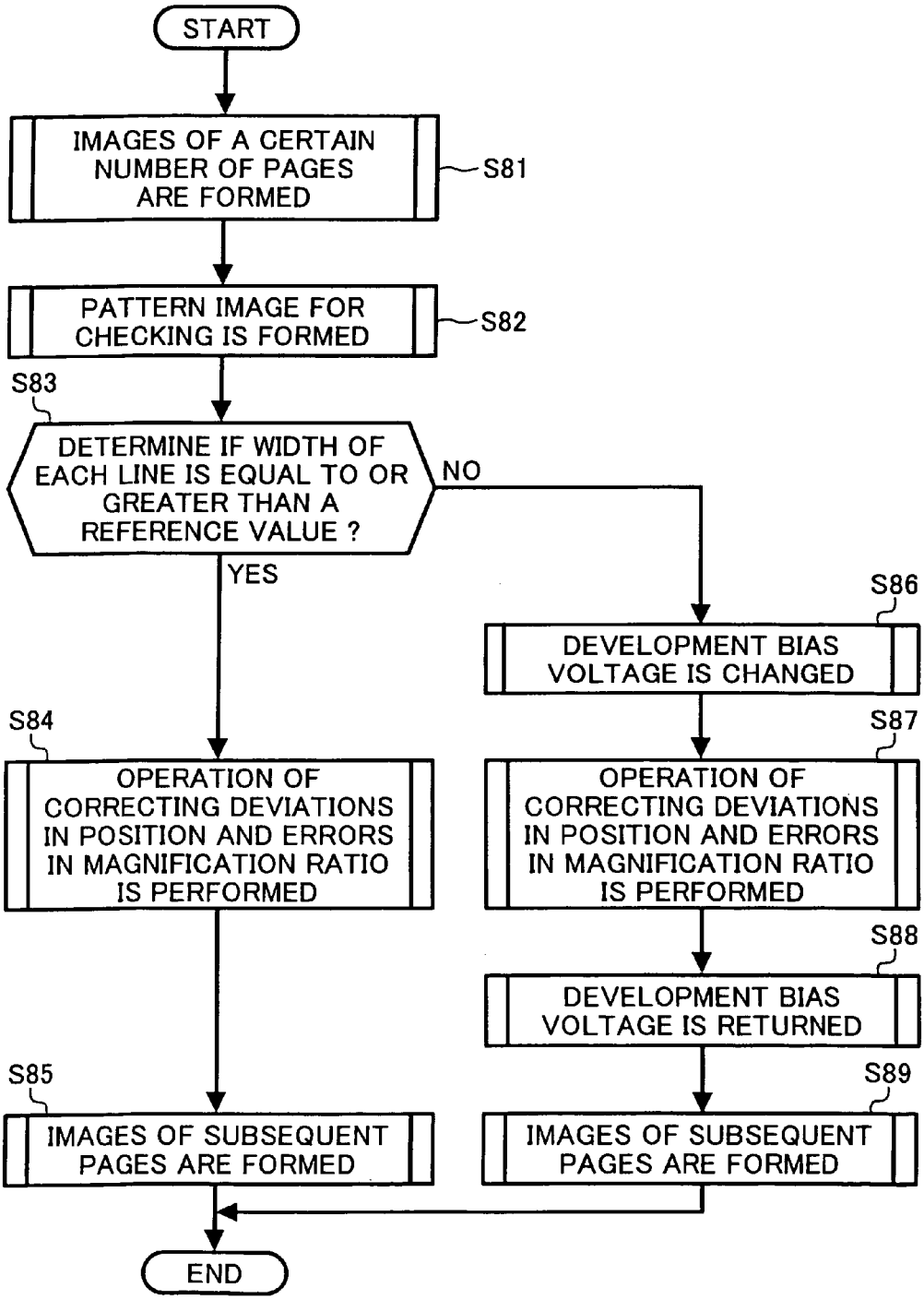
FIG. 18 is a flowchart of an operation of correcting deviations in position and errors in magnification ratio of images of individual colors that are superimposed on top of one another to form a full color image, according to the fifth preferred embodiment.

FIG. 18 illustrates an exemplary operation flow of an operation of correcting deviations in position and errors in magnification ratio of images of individual colors that are superimposed on top of one another to form a full color image, according to a fifth embodiment of the present invention. The fifth embodiment differs from the third embodiment in that a development bias voltage of the development unit 3 of each image forming device 1 as an image forming condition of the image forming device 1 is changed instead of the light quantity of the LD. That is, in this embodiment, an optimum development bias voltage of the development unit 3, that is suitable for increasing a width of a line of the pattern of lines of the pattern image for checking formed on the transfer belt 11, that has been determined as smaller than the reference value, to exceed the reference value, is selected, in response to a detection level of the line of the pattern of lines of the pattern image for checking on the transfer belt 11 that has been determined as smaller than the reference value at that time, from among ones obtained in advance by investigating to what extent the development bias voltage of the development unit 3 must be increased when a width of a line of the pattern of lines of the pattern image for checking formed on the transfer belt 11 is smaller than the reference value for various cases.

In this embodiment, after forming images of a certain number of pages (in this example, 100 pages) since an operation of correcting deviations in position and errors in magnification ratio of images of individual colors has been performed last (S81), the pattern image for checking illustrated in FIG. 8 is formed on the transfer belt 11 at a part of the transfer belt 11 between parts of the transfer belt 11, conveying recording sheets, respectively, as in the first embodiment (S82). The pattern image for checking formed on the transfer belt 11 is detected by the first sensor 13 and the second sensor 14, and the printer controller 24 determines if the width of each line of the pattern of lines of the pattern image for checking formed on the transfer belt 11 is equal to or greater than a reference value (S83).

When the width of each line of the pattern of lines of the pattern image for checking formed on the transfer belt 11 is equal to or greater than the reference value (Yes in S83), it is determined that deviations in position and errors in magnification ratio of images of individual colors that are superimposed on top of one another can be correctly corrected, and the operation of correcting deviations in position and errors in magnification ratio of images of individual colors illustrated in FIG. 7 is executed (S84). When the next page after the last page of a certain number of pages (in this example, after the 100th page of 100 pages) for which an operation of forming an image has not been started exists, the operation of correcting deviations in position and errors in magnification ratio of images of individual colors of step S84 is executed after interrupting the operation of forming the image of the next page, and when the operation of forming the image of the next page has been already started, the operation of correcting deviations in position and errors in magnification of images of individual colors of step S84 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S85).

When the width of any one line of the pattern of lines of the pattern image for checking formed on the transfer belt 11 is smaller than the reference value (No in S83), it is determined that deviations in position and errors in magnification ratio of images of individual colors that are superimposed on top of one another to form a full color image cannot be correctly corrected, and the printer controller 24 changes a development bias voltage of the development unit 3 of each image forming device 1, with which a line of the pattern of lines of the pattern image for checking on the transfer belt 11, the width of which has been determined as smaller than the reference value, has been formed, with the development bias controller 26 (S86). When an operation of forming an image of the next page has been already started, the development bias voltage is changed after the image of the next page has been formed. Then, the operation of correcting deviations in position and errors in magnification ratio of images of individual colors illustrated in FIG. 7 is executed (S87). The development bias voltage of the development unit 3 is returned to the one before having been changed (S88), and images of subsequent pages are formed (S89).

Thus, according to this embodiment, when a width of a line of the pattern of lines of the pattern image for checking formed on the transfer belt 11 is smaller than the reference value and it is determined that deviations in position and errors in magnification ratio of images of individual colors that are superimposed on top of one another cannot be correctly corrected, before forming the pattern image for correcting, the development bias voltage of the development unit 3 of each image forming device 1, with which a line of the pattern of lines of the pattern image for checking on the transfer belt 11, the width of which has been determined as smaller than the reference value, has been formed, can be changed so that when the pattern image for correcting is subsequently formed on the transfer belt 11 for correcting deviations in position and errors in magnification ratio of images of individual colors, the width of each line of the pattern of lines of the pattern image for correcting formed on the transfer belt 11 is increased. Thereby, the operation of correcting deviations in position and errors in magnification ratio of images of individual colors can be reliably performed.

Now, a sixth preferred embodiment of the present invention is described. The constructions of an image forming apparatus and an image formation controller of this embodiment, and a pattern image for correcting deviations in position and errors in magnification ratio of images of individual colors that are superimposed on top of one another to form a full color image, and a pattern image for checking whether or not deviations in position and errors in magnification ratio of images of individual colors that are superimposed on top of one another to form a full color image can be correctly corrected of this embodiment are substantially the same as those of the first embodiment.

Figure 19:
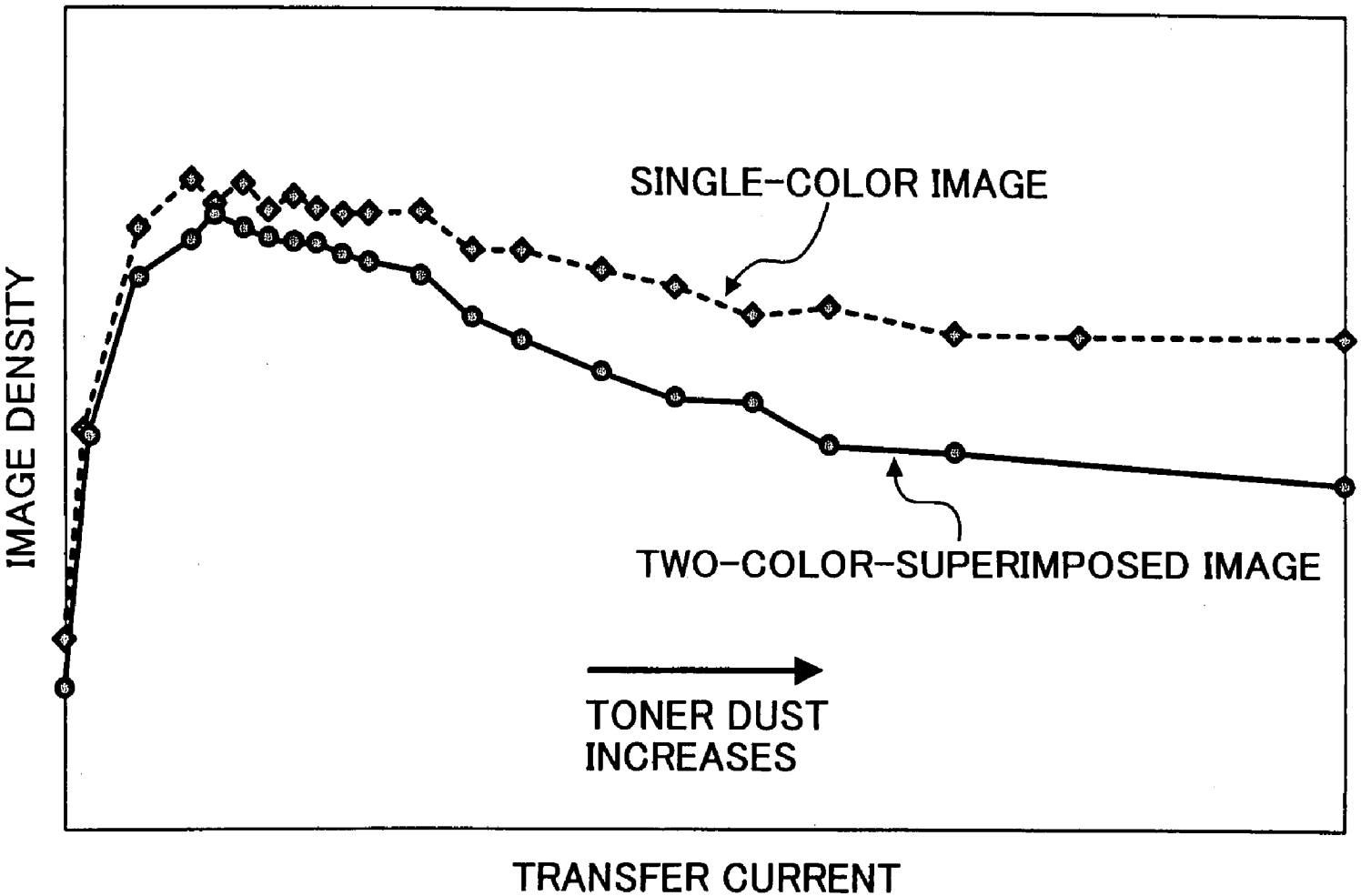
FIG. 19 is a diagram illustrating a graph indicating image densities of a single-color image and a two-color-superimposed image relative to a certain range of values of the transfer current of a transfer device of each image forming device.

FIG. 19 illustrates a graph indicating image densities of a single-color image and a two-color-superimposed image relative to a certain range of values of the transfer current of the transfer device 5 of each image forming device 1. As indicated by the graph, while image density of the single-color image is relatively stable, image density of the two-color-superimposed image rapidly decreases when the transfer current is excessively increased. Further, peak points of the image densities slightly differ from each other. The pattern image for correcting corresponds to a single-color image because the lines in individual colors of respective pattern images for correcting of individual colors are not superimposed with each other when the pattern image for correcting is formed on the transfer belt 11 by superimposing the pattern images of individual colors on top of one another on the transfer belt 11. However, when forming a color image, generally the image is a full color image, so that superimposing of images of individual colors, such as images of two colors, three colors and four colors, must be considered. Further, optimum transfer conditions differ between when transferring an image onto a recording sheet and when transferring an image onto the transfer belt 11.

Generally, image density of an image increases as the transfer current for transferring the image is increased to a certain degree. Therefore, in this embodiment, when forming the pattern image for correcting on the transfer belt 11, instead of changing the light quantity of the LD as in the third embodiment, the transfer current of the transfer device 5 of the image forming device 1 as an image forming condition of the image forming device 1 is increased more than when forming images. At this time, although a problem such as toner dust may easily arise, because detection of each line of the pattern of lines of the pattern image for correcting formed on the transfer belt 11 is not influenced even when toner dust slightly exists on the pattern image for correcting, no problem is caused by increasing the transfer current of the transfer device 5 to increase the image density of the pattern image for correcting that is subsequently formed on the transfer belt 11. By increasing the image density of the pattern image for correcting that is subsequently formed on the transfer belt 11, a detection margin of the pattern image for correcting formed on the transfer belt 11 relative to the threshold level is increased.

Figure 20:
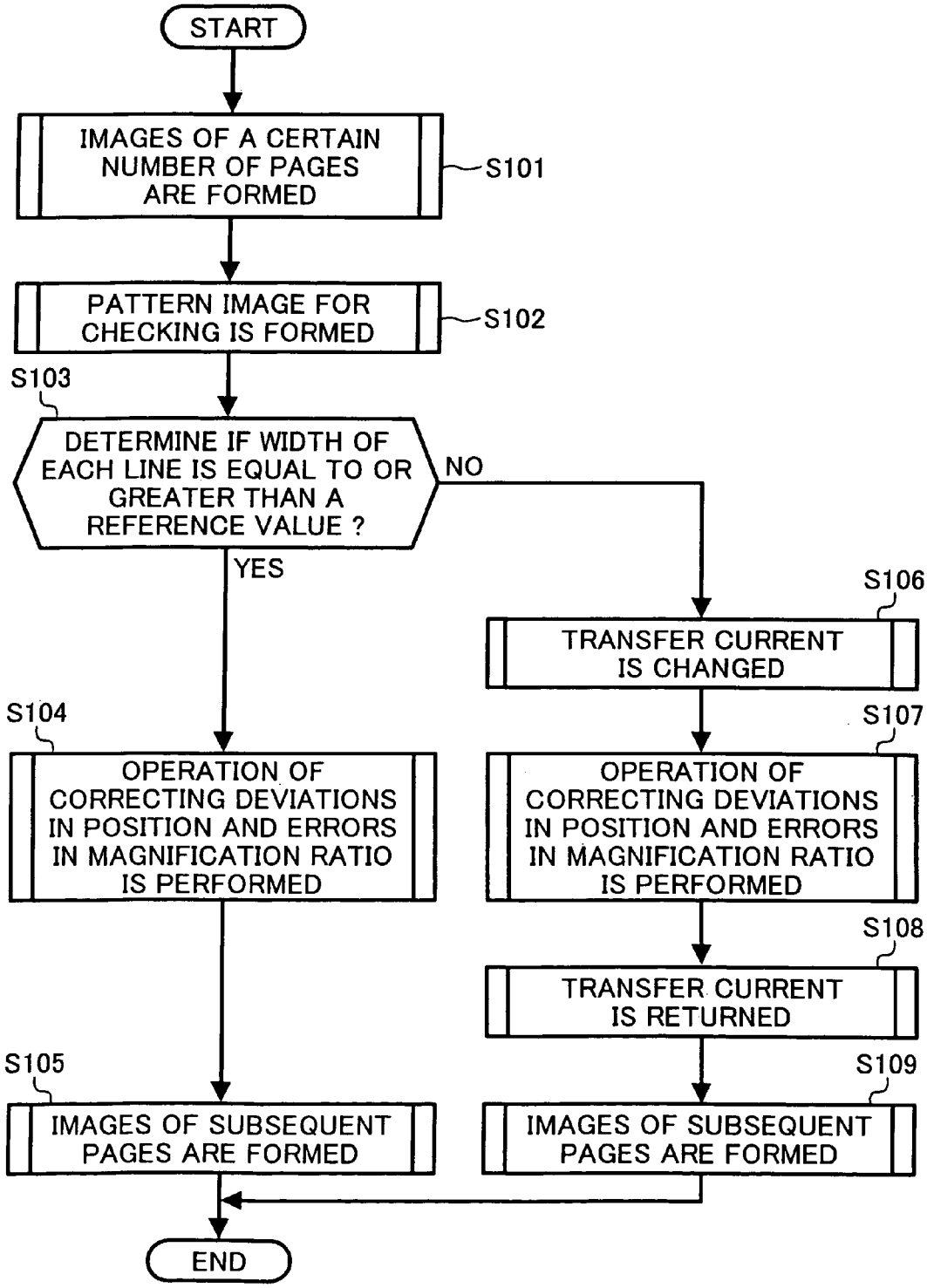
FIG. 20 is a flowchart of an operation of correcting deviations in position and errors in magnification ratio of images of individual colors that are superimposed on top of one another to form a full color image, according to a sixth preferred embodiment of the present invention.

FIG. 20 illustrates an exemplary operation flow of an operation of correcting deviations in position and errors in magnification ratio of images of individual colors that are superimposed on top of one another to form a full color image, according to this embodiment. The sixth embodiment differs from the third embodiment in that a transfer current of the transfer device 5 of the image forming device 1 is changed instead of the light quantity of the LD. That is, in this embodiment, an optimum transfer current of the transfer device 5 of each image forming device 1, that is suitable for increasing a width of a line of the pattern of lines of the pattern image for checking formed on the transfer belt 11, that has been determined as smaller than the reference value, to exceed the reference value, is selected, in response to a detection level of the line of the pattern of lines of the pattern image for checking on the transfer belt 11 that has been determined as smaller than the reference value at that time, from among ones obtained in advance by investigating to what extent the transfer current of the transfer device 5 must be increased when a width of a line of the pattern of lines of the pattern image for checking formed on the transfer belt 11 is smaller than the reference value for various cases.

In this embodiment, after forming images of a certain number of pages (in this example, 100 pages) since the operation of correcting deviations in position and errors in magnification ratio of images of individual colors has been performed last (S101), the pattern image for checking illustrated in FIG. 8 is formed on the transfer belt 11 at a part of the transfer belt 11 between parts of the transfer belt 11 conveying recording sheets, respectively, as in the first embodiment (S102). The pattern image for checking formed on the transfer belt 11 is detected by the first sensor 13 and the second sensor 14, and the printer controller 24 determines if a width of each line of the pattern of lines of the pattern image for checking formed on the transfer belt 11 is equal to or greater than a reference value (S103).

When the width of each line of the pattern of lines of the pattern image for checking formed on the transfer belt 11 is equal to or greater than the reference value (Yes in S103), it is determined that deviations in position and errors in magnification ratio of images of individual colors that are superimposed on top of one another to form a full color image can be correctly performed, and the operation of correcting deviations in position and errors in magnification ratio of images of individual colors illustrated in FIG. 7 is executed (S104). When the next page after the last page of a certain number of pages (in this example, after the 100th page of 100 pages) for which an operation of forming an image has not been started exists, the operation of correcting deviations in position and errors in magnification ratio of images of individual colors of step S104 is executed after interrupting the operation of forming the image of the next page, and when the operation of forming the image of the next page has been already started, the operation of correcting deviations in position and errors in magnification of images of individual colors of step S104 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S105).

When the width of any one line of the pattern of lines of the pattern image for checking formed on the transfer belt 11 is smaller than the reference value (No in S103), it is determined that deviations in position and errors in magnification ratio of images of individual colors that are superimposed on top of one another to form a full color image cannot be correctly corrected, and the printer controller 24 changes a transfer current of the transfer device 5 of each image forming device 1, with which a line of the pattern of lines of the pattern image for checking on the transfer belt 11, the width of which has been determined as smaller than the reference value, has been formed, with the transfer bias controller 27 (S106). When an operation of forming an image of the next page has been already started, the transfer current is changed after the image of the next page has been formed. Then, the operation of correcting deviations in position and errors in magnification ratio of images of individual colors illustrated in FIG. 7 is executed (S107). The transfer current is returned to the one before having been changed (S108), and images of subsequent pages are formed (S109).

Thus, according to this embodiment, when a width of a line of the pattern of lines of the pattern image for checking formed on the transfer belt 11 is smaller than the reference value and it is determined that deviations in position and errors in magnification ratio of images of individual colors that are superimposed on top of one another to form a full color image cannot be correctly corrected, before forming the pattern image for correcting on the transfer belt 11, the transfer current of the transfer device 5 of each image forming device 1, with which a line of the pattern of lines of the pattern image for checking on the transfer belt 11, the width of which has been determined as smaller than the reference value, has been formed, can be changed so that when the pattern image for correcting is subsequently formed on the transfer belt 11 for correcting deviations in position and errors in magnification ratio of images of individual colors, the width of each line of the pattern of lines of the pattern image for correcting formed on the transfer belt 11 is increased. Thereby, the operation of correcting deviations in position and errors in magnification ratio of images of individual colors can be reliably performed.

Now, a seventh preferred embodiment of the present invention is described. The constructions of an image forming apparatus and an image formation controller of this embodiment are substantially the same as those of the first embodiment. Also, a pattern image for correcting deviations in position and errors in magnification ratio of images of individual colors that are superimposed on top of one another to form a full color image and a pattern image for checking whether or not deviations in position and errors in magnification ratio of images of individual colors that are superimposed on top of one another to form a full color image of this embodiment are substantially the same as those of the first embodiment.

Figure 21:
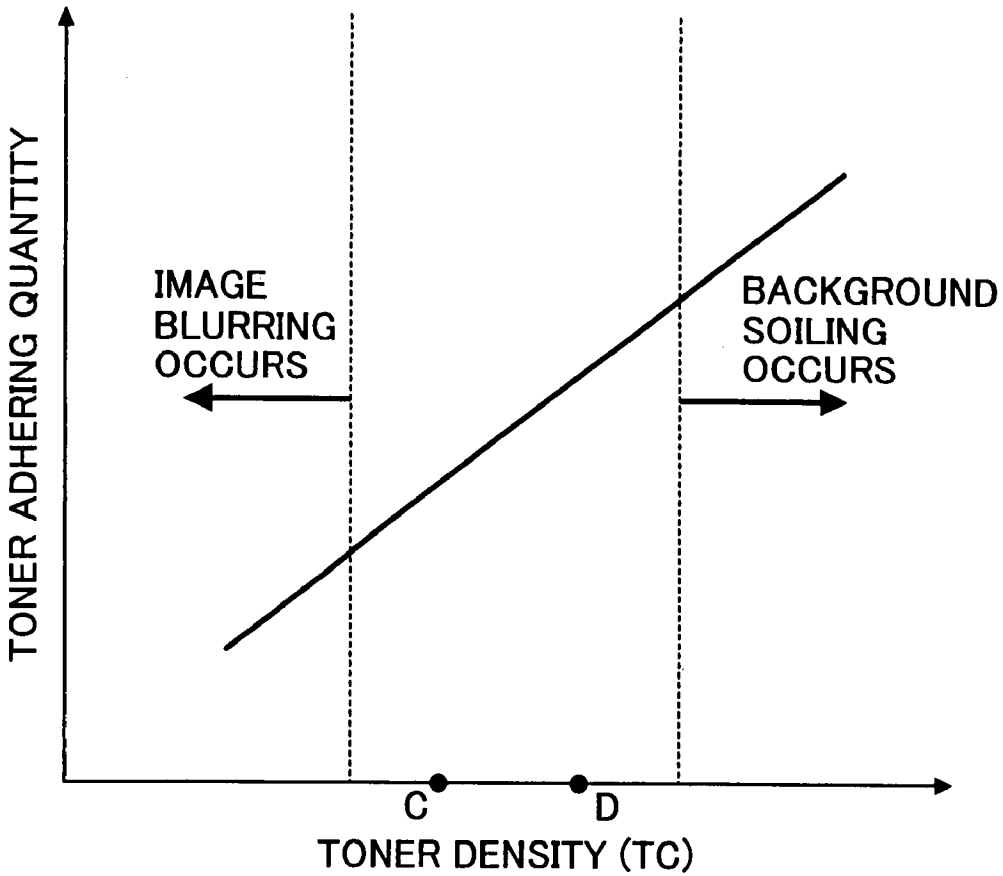
FIG. 21 is a diagram illustrating a graph indicating a relation between toner density of the development device of the image forming device and a toner adhering quantity of an image developed with the development device, according to a seventh preferred embodiment of the present invention.

FIG. 21 illustrates a graph indicating a relation between toner density of the development unit 3 and a toner adhering quantity of an image developed with the development unit 3. If toner density of the development unit 3 is excessively decreased, an image developed with the development unit 3 is blurred or becomes thin, and if the toner density is excessively increased, background soiling occurs in the image. Generally, the toner density of the development unit 3 is controlled to be between toner density points "C" and "D" in FIG. 21. When the toner density of the development unit 3 is near the toner density point C, it may occur that the toner density is slightly below the point C. In such a case, the image density of the pattern image for checking formed on the transfer belt 11 may be decreased to a level undetectable with the first sensor 13 and the second sensors 14.

Accordingly, in this embodiment, when a width of a line of the pattern of lines of the pattern image for checking formed on the transfer belt 11 is smaller than the reference value and it is determined that deviations in position and errors in magnification ratio of images of individual colors that are superimposed on top of one another to form a full color image cannot be correctly corrected, before forming the pattern image for correcting on the transfer belt 11 for correcting deviations in position and errors in magnification ratio of images of individual colors, the development unit 3 of each image forming device 1, with which a line of the pattern of lines of the pattern image for checking on the transfer belt 11, the width of which has been determined as smaller than the reference value, has been formed, is replenished with toner so that when the pattern image for correcting is subsequently formed on the transfer belt 11 for correcting deviations in position and errors in magnification ratio of images of individual colors, the width of each line of the pattern of lines of the pattern image for correcting formed on the transfer belt 11 is increased. In this case, even if the toner density of the development unit 3 exceeds the toner density point D as a result of replenishing toner to the development unit 3 and thereby background soiling is slightly caused on the pattern image for correcting formed on the transfer belt 11, detection of each line of the pattern of lines of the pattern image for correcting formed on the transfer belt 11 with the first and second sensor 13 and 14 is not influenced by such background soiling on the pattern image for correcting. Thus, by increasing density of the pattern image for correcting that is subsequently formed on the transfer belt 11 for correcting deviations in position and errors in magnification ratio of images of individual colors, a detection margin of the pattern image for correcting formed on the transfer belt 11 relative to the threshold level can be increased.

Figure 22:
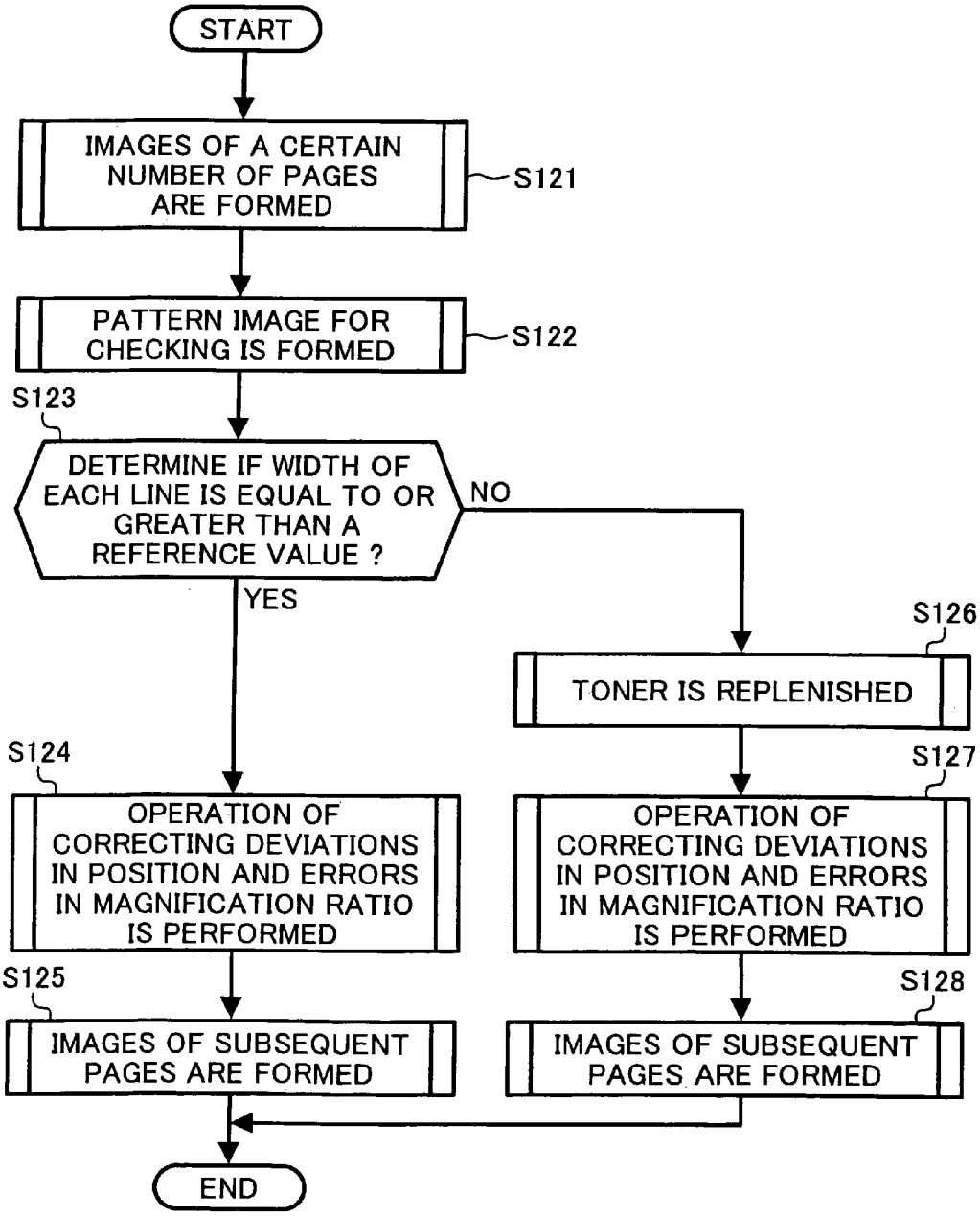
FIG. 22 is a flowchart of an operation of correcting deviations in position and errors in magnification ratio of images of individual colors that are superimposed on top of one another to form a full color image, according to the seventh preferred embodiment.

FIG. 22 illustrates an exemplary operation flow of an operation of correcting deviations in position and errors in magnification ratio of images of individual colors that are superimposed on top of one another to form a full color image, according to this embodiment. The seventh embodiment differs from the third embodiment in that an operation of replenishing the development unit 3 of the image forming device 1 with toner is performed instead of changing the light quantity of the LD. That is, in this embodiment, an optimum quantity of toner to be replenished to the development unit 3, that is suitable for increasing a width of a line of the pattern of lines of the pattern image for checking formed on the transfer belt 11, that has been determined as smaller than the reference value, to exceed the reference value, is selected, in response to a detection level of the line of the pattern of lines of the pattern image for checking on the transfer belt 11 that has been determined as smaller than the reference value at that time, from among ones obtained in advance by investigating to what extent the quantity of toner of the development unit 3 must be increased when a width of a line of the pattern of lines of the pattern image for checking formed on the transfer belt 11 is smaller than the reference value for various cases. In determining the optimum replenishing quantity of toner, for avoiding influencing images formed after performing the operation of correcting deviations in position and errors in magnification ratio of images of individual colors, a quantity of toner necessary for forming the pattern image for correcting on the transfer belt 11 and a margin between the toner density point D and a toner density point where background soiling occurs in the pattern image for correcting when the pattern image for correcting is formed on the transfer belt 11 are considered.

In this embodiment, after forming images of a certain number of pages (in this example, 100 pages) since the operation of correcting deviations in position and errors in magnification ratio of images of individual colors has been performed last (S121), the pattern image for checking illustrated in FIG. 8 is formed on the transfer belt 11 at a part of the transfer belt 11 between parts of the transfer belt 11, conveying recording sheets, respectively, as in the first embodiment (S122). The pattern image for checking formed on the transfer belt 11 is detected by the first sensor 13 and the second sensor 14, and the printer controller 24 determines if the width of each line of the pattern of lines of the pattern image for checking formed on the transfer belt 11 is equal to or greater than a reference value (S123).

When the width of each line of the pattern of lines of the pattern image for checking formed on the transfer belt 11 is equal to or greater than the reference value (Yes in S123), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S124). When the next page after the last page of a certain number of pages (in this example, after the 100th page of 100 pages) for which an operation of forming an image has not been started exists, the operation of correcting deviations in position and errors in magnification ratio of images of individual colors of step S124 is executed after interrupting the operation of forming the image of the next page, and when the operation of forming the image of the next page has been already started, the operation of correcting deviations in position and errors in magnification of images of individual colors of step S124 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S125).

When the width of any one line of the pattern of lines of the pattern image for checking formed on the transfer belt 11 is smaller than the reference value (No in S123), it is determined that deviations in position and errors in magnification ratio of images of individual colors that are superimposed on top of one another to form a full color image cannot be correctly corrected, and the development unit 3 of each image forming device 1, with which a line of the pattern of lines of the pattern image for checking on the transfer belt 11, the width of which has been determined as smaller than the reference value, has been formed, is replenished with toner (S126). When an operation of forming an image of the next page has been already started, the development unit 3 is replenished with toner after the image of the next page has been formed. Then, the operation of correcting deviations in position and errors in magnification ratio of images of individual colors illustrated in FIG. 7 is executed (S127). Thereafter, images of subsequent pages are formed (S128).

Thus, according to this embodiment, when a width of a line of the pattern of lines of the pattern image for checking formed on the transfer belt 11 is smaller than the reference value and it is determined that deviations in position and errors in magnification ratio of images of individual colors that are superimposed on top of one another to form a full color image cannot be correctly corrected, before forming the pattern image for correcting on the transfer belt 11 for correcting deviations in position and errors in magnification ratio of images of individual colors, the development unit 3 of each image forming device 1, with which a line of the pattern of lines of the pattern image for checking on the transfer belt 11, the width of which has been determined as smaller than the reference value, has been formed, is replenished with toner so that when the pattern image for correcting is formed on the transfer belt 11 for correcting deviations in position and errors in magnification ratio of images of individual colors that are superimposed on top of one another to form a color image, the width of each line of the pattern of lines of the pattern image for correcting formed on the transfer belt 11 is increased. Thereby, the operation of correcting deviations in position and errors in magnification ratio of images of individual colors that are superimposed on top of one another to form a color image can be reliably performed.

Now, an eighth preferred embodiment of the present invention is described. The constructions of an image forming apparatus and an image formation controller of this embodiment are substantially the same as those of the first embodiment. Also, a pattern image for correcting deviations in position and errors in magnification ratio of images of individual colors that are superimposed on top of one another to form a color image, and a pattern image for checking whether or not deviations in position and errors in magnification ratio of images of individual colors that are superimposed on top of one another to form a color image of this embodiment are substantially the same as those of the first embodiment.

Figures 23, 23A:
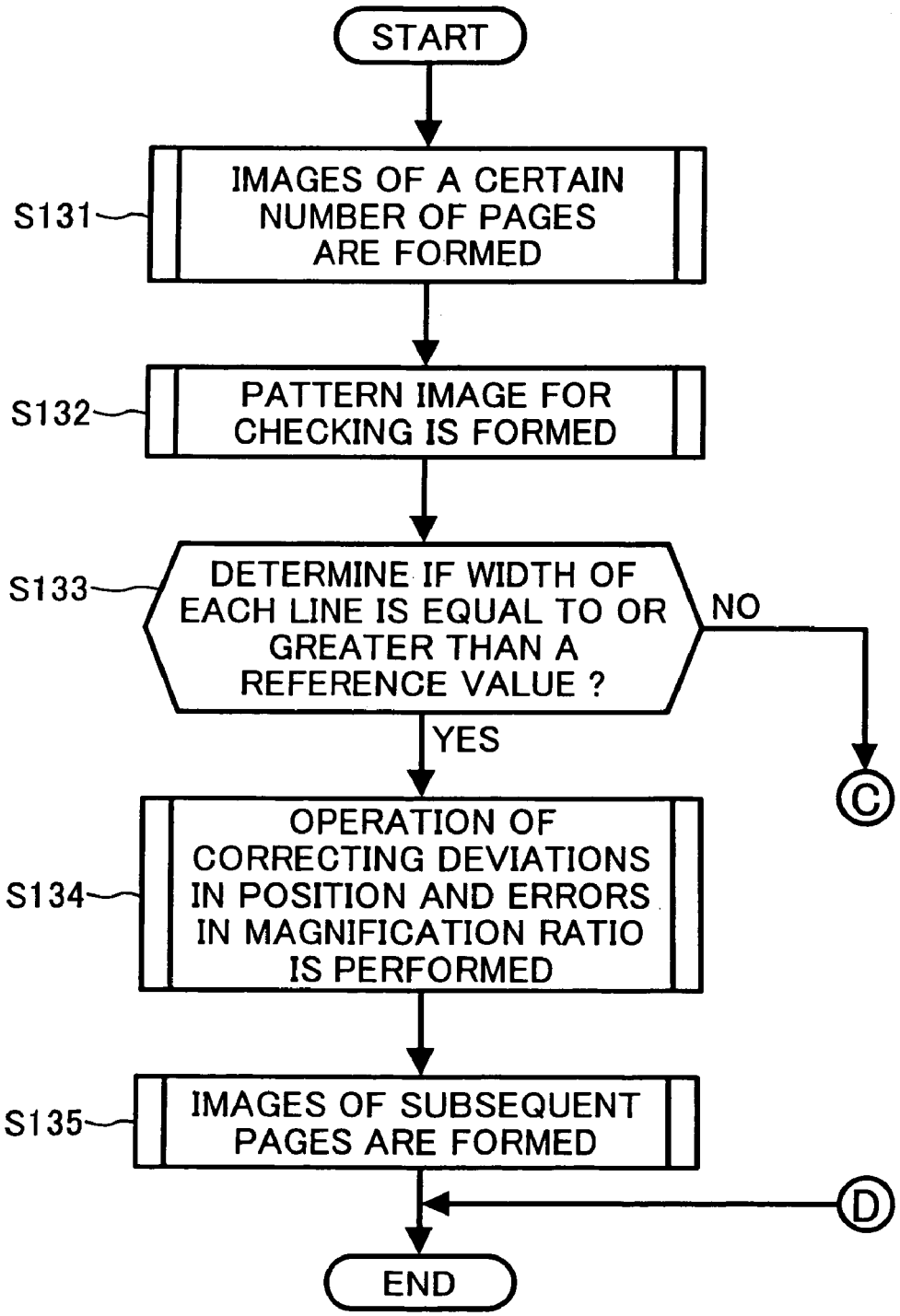
FIG. 23A and FIG. 23B are flowcharts of an operation of correcting deviations in position and errors in magnification ratio of images of individual colors that are superimposed on top of one another to form a full color image, according to an eighth preferred embodiment of the present invention.
Figure 23B:
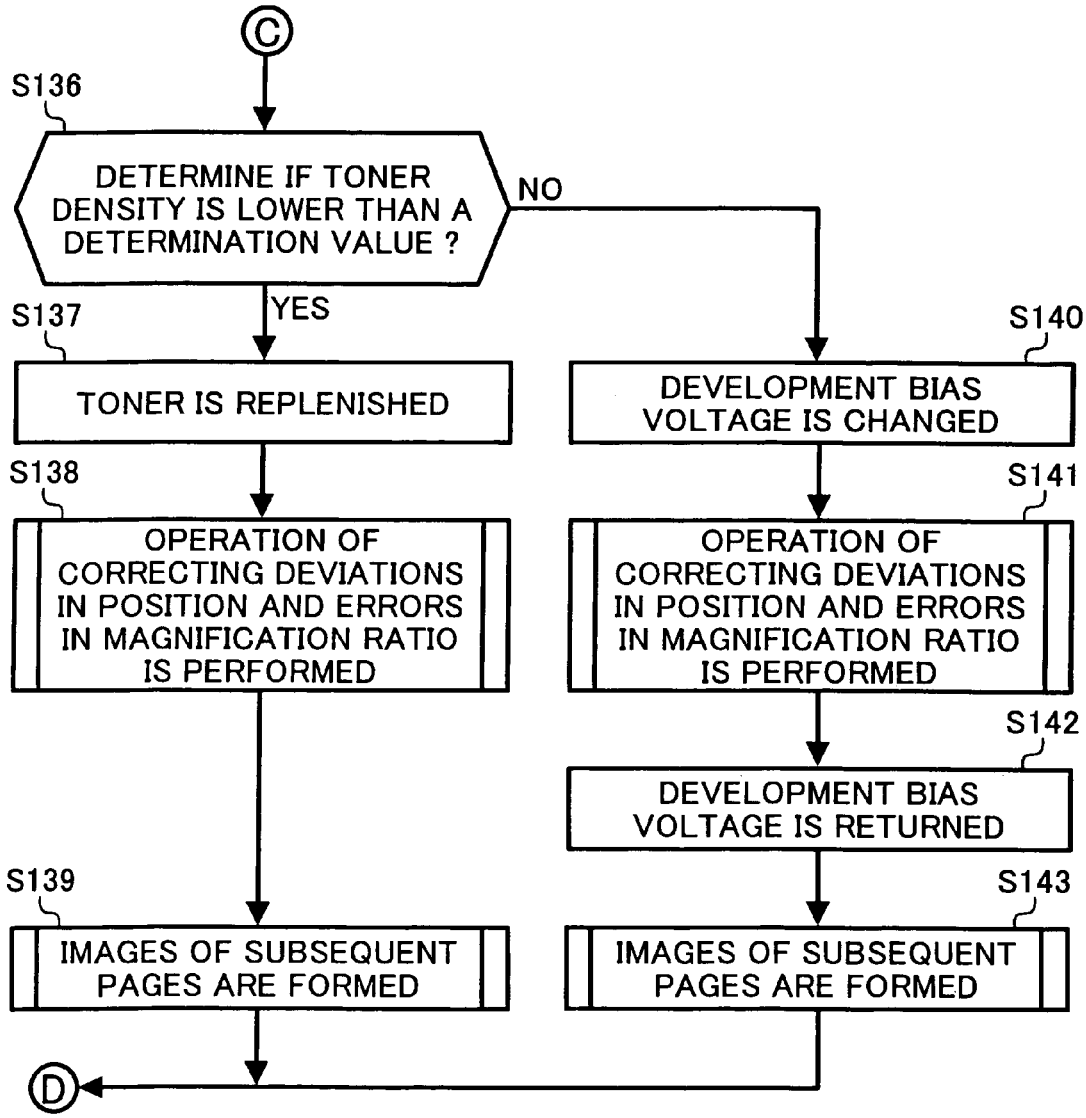

FIG. 23A and FIG. 23B illustrate an exemplary operation flow of an operation of correcting deviations in position and errors in magnification ratio of images of individual colors that are superimposed on top of one another to form a full color image, according to this embodiment. The eighth embodiment differs from the seventh embodiment in that checking of present toner density of the development unit 3 is performed before replenishing the development unit 3 with toner. When the present toner density of the development unit 3 is lower than a predetermined determination value, then the development unit 3 is replenished toner. In the example of FIG. 23A and FIG. 23B, a toner density value E between the toner density points C and D indicated in FIG. 21 is used for the determination value for avoiding images formed after performing the operation of correcting deviations in position and errors in magnification ratio of images of individual colors from being influenced. Further, when the present toner density of the development unit 3 is higher than the determination value, the development unit 3 is not replenished with toner, and instead, the other image forming condition is changed. For example, as described with respect to the fifth embodiment, the development bias voltage of the development unit 3 may be changed. Thereby, the operation of correcting deviations in position and errors in magnification ratio of images of individual colors can be reliably performed.

In this embodiment, after forming images of a certain number of pages (in this example, 100 pages) since the operation of correcting deviations in position and errors in magnification ratio of images of individual colors has been performed last (S131), the pattern image for checking illustrated in FIG. 8 is formed on the transfer belt 11 at a part of the transfer belt 11 between parts of the transfer belt 11 conveying recording sheets, respectively, as in the first embodiment (S132). The pattern image for checking formed on the transfer belt 11 is detected by the first sensor 13 and the second sensor 14 and the printer controller 24 determines if the width of each line of the pattern of lines of the pattern image for checking formed on the transfer belt 11 is equal to or greater than a reference value (S133).

When the width of each line of the pattern of lines of the pattern image for checking formed on the transfer belt 11 is equal to or greater than the reference value (Yes in S133), it is determined that deviations in position and errors in magnification ratio of images of individual colors that are superimposed on top of one another can be correctly corrected, and the operation of correcting deviations in position and errors in magnification ratio of images of individual colors illustrated in FIG. 7 is executed (S134). When the next page after the last page of a certain number of pages (in this example, after the 100th page of 100 pages) for which an operation of forming an image has not been started exists, the operation of correcting deviations in position and errors in magnification ratio of images of individual colors of step S134 is executed after interrupting the operation of forming the image of the next page, and when the operation of forming the image of the next page has been already started, the operation of correcting deviations in position and errors in magnification of images of individual colors of step S134 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S135).

When the width of any one line of the pattern of lines of the pattern image for checking formed on the transfer belt 11 is smaller than the reference value (No in S133), it is determined that deviations in position and errors in magnification ratio of images of individual colors that are superimposed on top of one another to form a full color image cannot be correctly corrected, and whether or not a toner density TC of the development unit 3 of each image forming device 1, with which a line of the pattern of lines of the pattern image for checking on the transfer belt 11, the width of which has been determined as smaller than the reference value, has been formed, is smaller than the determination value E is determined (S136). When an operation of forming an image of the next page has been already started, whether or not the toner density TC of the development unit 3 is smaller than the determination value E is determined after the image of the next page has been formed. When it is determined that the toner density TC of the development unit 3 is smaller than the determination value E (Yes is S136), the development unit 3 is replenished with toner (S137), and the operation of correcting deviations in position and errors in magnification ratio of images of individual colors illustrated in FIG. 7 is executed (S138), and images of subsequent pages are formed (S139).

When it is determined that the toner density TC is not smaller than the determination value E (No in S136), the development bias voltage of the development unit 3 is changed (S140) as described above. The operation of correcting deviations in position and errors in magnification ratio of images of individual colors illustrated in FIG. 7 is executed (S141), the development bias voltage of the development unit 3 is returned to the one before having been changed (S142), and images of subsequent pages are formed (S143).

In the above-described operation flow, when it is determined that the toner density TC of the development unit 3 is not lower than the determination value E (No in S136), the development bias voltage of the development unit 3 is changed (S140). However, instead of changing the development bias voltage of the development unit 3, either or both of the transfer bias of the transfer device 5 and the rotating speed of the photoconductor 2 may be changed. Alternatively, first the amount of exposure energy of image light illuminating the photoconductor 2 of the image forming device 1 is changed within a predetermined range, and thereafter if it is still determined that deviations in position and errors in magnification ratio of images of individual colors that are superimposed on top of one another to form a color image cannot be correctly corrected, when the toner density of the development unit 3 is lower than a predetermined value, the toner density of the development unit 3 is changed, and when the toner density of the development unit 3 is not lower than the predetermined value, at least one or more of the development bias voltage of the development unit 3, the transfer bias current of the transfer device 5, and the rotation speed of the photoconductor 2 may be changed.

Now, a ninth preferred embodiment of the present invention is described. The constructions of an image forming apparatus and an image formation controller of this embodiment are substantially the same as those in the first embodiment. Also, a pattern image for correcting deviations in position and errors in magnification ratio of images of individual colors that are superimposed on top of one another to form a full color image and a pattern image for checking whether or not deviations in position and errors in magnification ratio of images of individual colors that are superimposed on top of one another to form a full color image of this embodiment are substantially the same as those of the first embodiment.

The ninth embodiment differs from the third embodiment in that the rotation speed of the photoconductor 2 of the image forming device 1 as an image forming condition of the image forming device 1 is changed instead of the light quantity of the LD. When the rotation speed of the photoconductor 2 is decreased relative to that when forming images, the writing density in the sub-scanning direction on the photoconductor 2 is increased by a ratio of the change in the rotation speed of the photoconductor 2, and the exposure energy of image light illuminating the photoconductor 2 per a unit area of the photoconductor 2 increases accordingly. Therefore, image density of the pattern image for correcting formed on the transfer belt 11 for correcting deviations in position and errors in magnification ratio of images of individual colors increases, so that a detection margin of the pattern image for correcting formed on the transfer belt 11 relative to the threshold level is increased.

Figure 24:
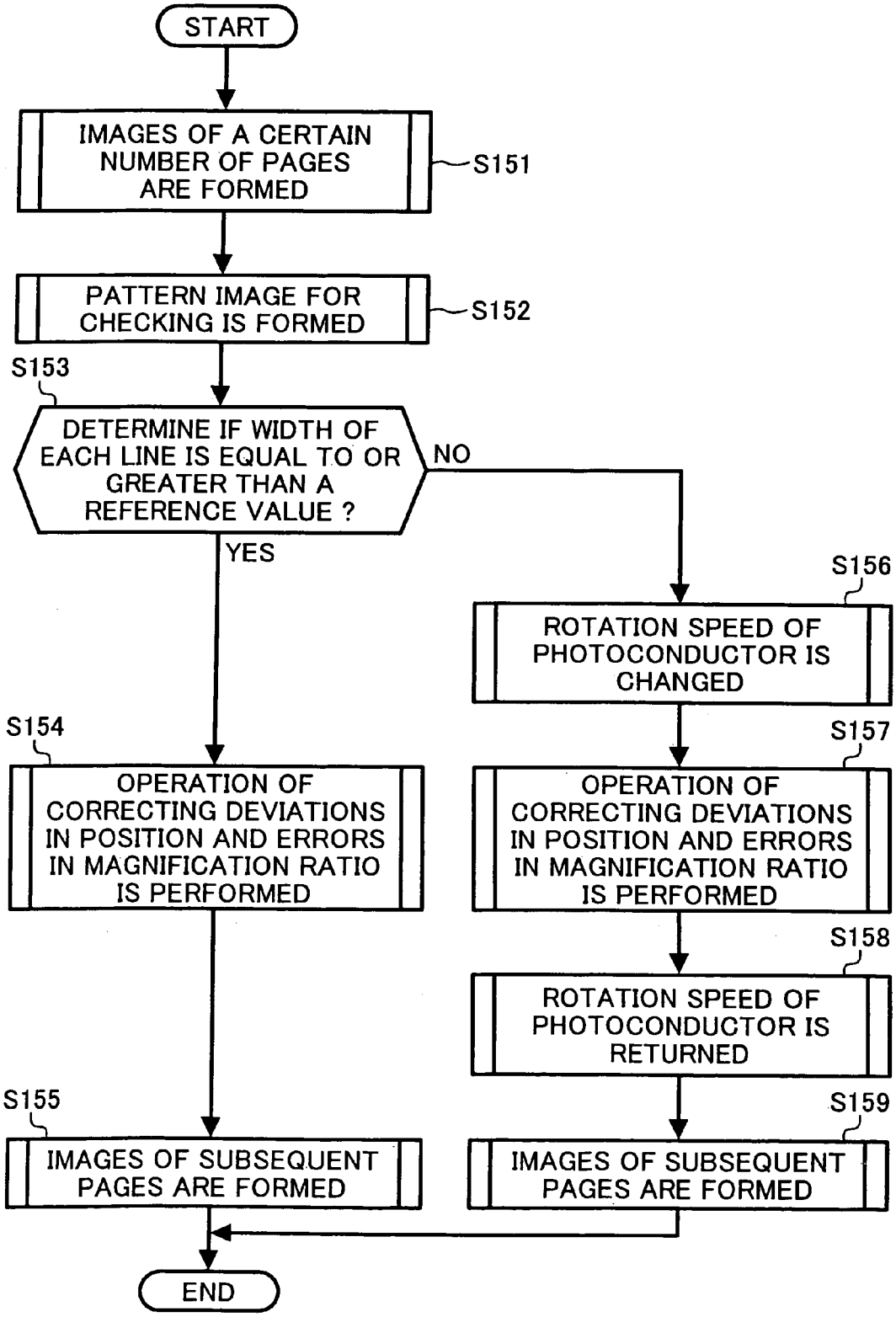
FIG. 24 is a flowchart of an operation of correcting deviations in position and errors in magnification ratio of images of individual colors that are superimposed on top of one another to form a full color image, according to a ninth preferred embodiment of the present invention.

FIG. 24 illustrates an exemplary operation flow of an operation of correcting deviations in position and errors in magnification ratio of images of individual colors that are superimposed on top of one another to form a full color image, according to this embodiment. In this embodiment, an optimum rotation speed of the photoconductor 2, that is suitable for increasing a width of a line of the pattern of lines of the pattern image for checking formed on the transfer belt 11, that has been determined as smaller than the reference value, to exceed the reference value, is selected, in response to a detection level of the line of the pattern of lines of the pattern image for checking on the transfer belt 11 that has been determined as smaller than the reference value at that time, from among ones obtained in advance by investigating to what extent the rotation speed of the photoconductor 2 must be changed when a width of a line of the pattern of lines of the pattern image for checking formed on the transfer belt 11 is smaller than the reference value for various cases.

In this embodiment, after forming images of a certain number of pages (in this example, 100 pages) since the operation of correcting deviations in position and errors in magnification ratio of images of individual colors has been performed last (S151), the pattern image for checking illustrated in FIG. 8 is formed on the transfer belt 11 at a part of the transfer belt 11 between parts of the transfer belt 11 conveying recording sheets, respectively, as in the first embodiment (S152). The pattern image for checking formed on the transfer belt 11 is detected by the first sensor 13 and the second sensor 14, and the printer controller 24 determines if the width of each line of the pattern of lines of the pattern image for checking formed on the transfer belt 11 is equal to or greater than a reference value (S153).

When the width of each line of the pattern of lines of the pattern image for checking formed on the transfer belt 11 is equal to or greater than the reference value (Yes in S153), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S154). When the next page after the last page of a certain number of pages (in this example, after the 100th page of 100 pages) for which an operation of forming an image has not been started exists, the operation of correcting deviations in position and errors in magnification ratio of images of individual colors of step S154 is executed after interrupting the operation of forming the image of the next page, and when the operation of forming the image of the next page has been already started, the operation of correcting deviations in position and errors in magnification of images of individual colors of step S154 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S155).

When the width of any one line of the pattern of lines of the pattern image for checking formed on the transfer belt 11 is smaller than the reference value (No in S153), it is determined that deviations in position and errors in magnification ratio of images of individual colors that are superimposed on top of one another to form a full color image cannot be correctly corrected, and the printer controller 24 controls the rotating speed of a photoconductor motor of each image forming device 1 rotating the photoconductor 2, with which a line of the pattern of lines of the pattern image for checking on the transfer belt 11, the width of which has been determined as smaller than the reference value, has been formed, to change the rotation speed of the photoconductor 2 (S156). When an operation of forming an image of the next page has been already started, the rotation speed of the photoconductor 2 is changed after the image of the next page has been formed. Then, the operation of correcting deviations in position and errors in magnification ratio of images of individual colors illustrated in FIG. 7 is executed (S157). The rotation speed of the photoconductor 2 is returned (S158), and images of subsequent pages are formed (S159).

Thus, according to this embodiment, when a width of a line of the pattern of lines of the pattern image for checking formed on the transfer belt 11 is smaller than the reference value and it is determined that deviations in position and errors in magnification ratio of images of individual colors that are superimposed on top of one another to form a full color image cannot be correctly corrected, before forming the pattern image for correcting on the transfer belt 11 for correcting deviations in position and errors in magnification ratio of images of individual colors, the rotation speed of the photoconductor 2 of each image forming device 1, with which a line of the pattern of lines of the pattern image for checking on the transfer belt 11, the width of which has been determined as smaller than the reference value, has been formed, is decreased so that when the pattern image for correcting is subsequently formed on the transfer belt 11 for correcting deviations in position and errors in magnification ratio of images of individual colors that are superimposed on top of one another to form a color image, the width of each line of the pattern of line of the pattern image for correcting formed on the transfer belt 11 is increased. Thereby, the operation of correcting deviations in position and errors in magnification ratio of images of individual colors can be reliably performed.

According to a tenth preferred embodiment of the present invention, the constructions of an image forming apparatus and an image formation controller and also a pattern image for correcting deviations in position and errors in magnification ratio of images of individual colors that are superimposed on top of one another to form a full color image and a pattern image for checking whether or not deviations in position and errors in magnification ratio of images of individual colors that are superimposed on top of one another to form a full color image are substantially the same as those of the first embodiment, and various methods of changing the image forming condition of each image forming device 1 to increase the width of each line of the pattern of lines of the pattern image for correcting, that is formed on the transfer belt 11 for correcting deviations in position and errors in magnification ratio of individual colors, described in the above-described third to ninth embodiments, are combined. Thereby, the operation of correcting deviations in position and errors in magnification ratio of images of individual colors can be more reliably performed. The operation flow of an operation of correcting deviations in position and errors in magnification ratio of images of individual colors that are superimposed on top of one another to form a full color image according to this embodiment is realized by combining those of the third embodiment through the ninth embodiment, and therefore description thereof is omitted.

Now, an eleventh preferred embodiment of the present invention is described. In this embodiment, the threshold level illustrated in FIG. 10, that is set relative to the output signals of the first sensor 13 and the second sensor 14 to determine the width of each line of the pattern of lines of the pattern image for correcting formed on the transfer belt 11, can be changed when it is determined that deviations in position and errors in magnification ratio of images of individual colors that are superimposed on top of one another to form a color image cannot be correctly corrected. The constructions of an image forming apparatus and an image formation controller and a pattern image for correcting deviations in position and errors in magnification ratio of images of individual colors that are superimposed on top of one another to form a full color image are substantially the same as those of the first embodiment.

Figures 25, 25A:
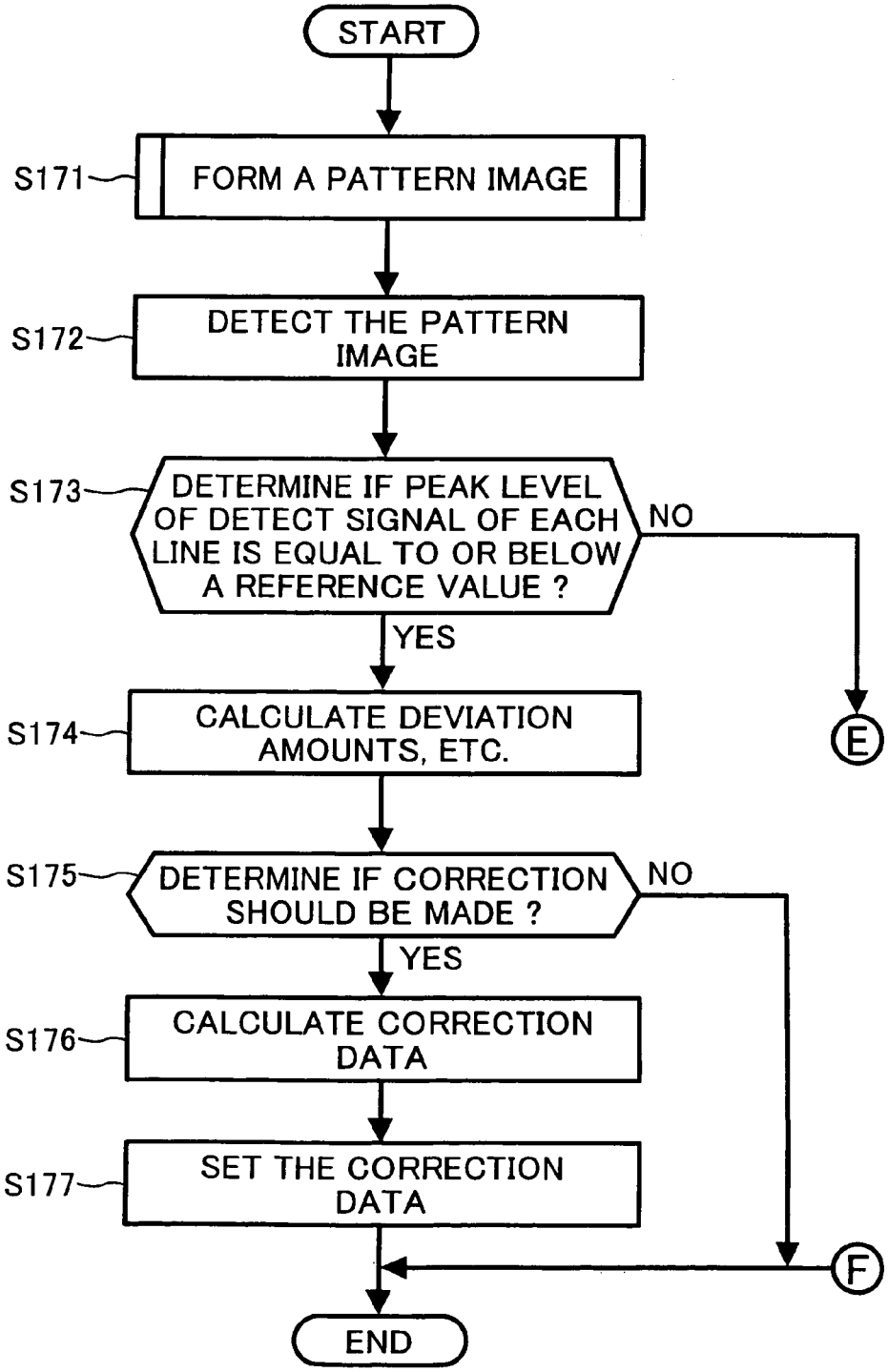
FIG. 25A and FIG. 25B are flowcharts of an operation of correcting deviations in position and errors in magnification ratio of images of individual colors that are superimposed on top of one another to form a full color image, according to an eleventh preferred embodiment of the present invention.
Figure 25B:
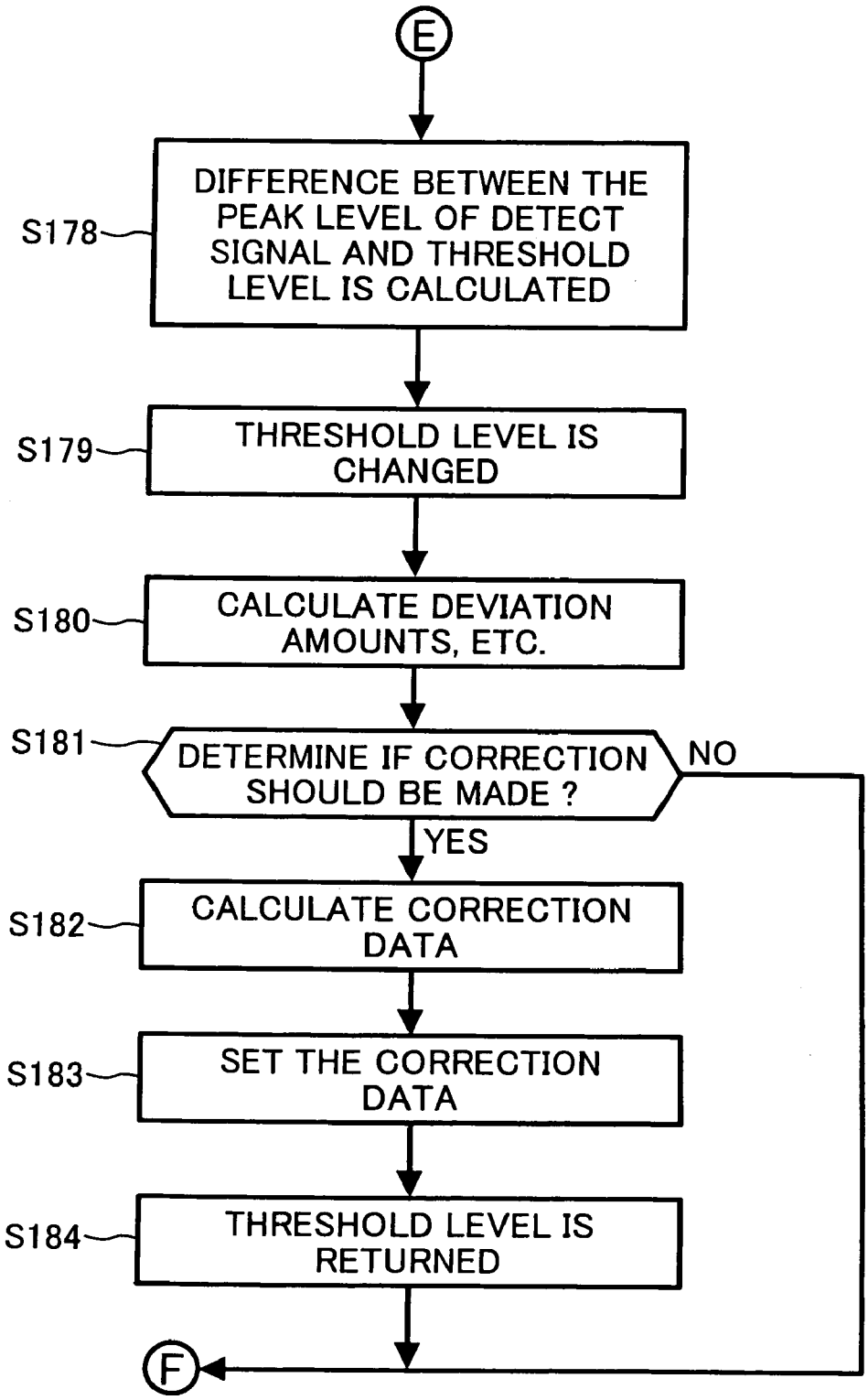

FIG. 25A and FIG. 25B illustrate an exemplary operation flow of an operation of correcting deviations in position and errors in magnification ratio of images of individual colors that are superimposed on top of one another to form a full color image, according to this embodiment. First, the pattern image for correcting is formed on the transfer belt 11 (S171). The pattern image for correcting formed on the transfer belt 11 is detected with the first sensor 13 and the second sensor 14 to output a detection signal of each line of the pattern of lines of the pattern image for correcting (S172). The printer controller 24 determines whether or not a peak level of the detection signal of each line of the pattern of lines of the pattern image for correcting formed on the transfer belt 11, output from the first and second sensors 13 and 14, is equal to or below a predetermined reference value (S173).

When the peak level of the detection signal of each line of the pattern of lines of the pattern image for correcting formed on the transfer belt 11 is equal to or below the reference value (Yes in S173), it is determined that deviations in position and errors in magnification ratio of images of individual colors that are superimposed on top of one another to form a full color image can be correctly corrected, and amounts of deviations in position in the main scanning and sub-scanning directions and amounts of errors in magnification ratio in the main scanning direction of pattern images for correcting of individual colors relative to a pattern image for correcting of black are calculated (S174).

Then, the printer controller 24 determines if calculated amounts of deviations in position and errors in magnification ratio of pattern images for correcting of individual colors are at levels that correction should be made, respectively (S175). In this example, correction of a deviation in position of an image of a color is made in units of one dot in the main scanning direction and in units of one line in the sub-scanning direction. That is, when the amount of a deviation in position in the main scanning direction of an image of a color is ½ dot or greater, it is determined that correction should be made, and when the amount of a deviation in position in the sub-scanning direction of the image is ½ line or greater, it is determined that correction should be made.

Thus, when it is determined with respect to an image of a certain color that an amount of a deviation in position in the main scanning direction and/or an amount of a deviation in position in the sub-scanning direction is at the level that correction should be made (Yes in S175), correction data for correcting the deviation in position in the main scanning direction (i.e., the correction data 1) and/or correction data for correcting the deviation in position in the sub-scanning direction (i.e., the correction data 2) is calculated (S176). The correction data 1 is set at the main scanning gate signal generation device 32 and the correction data 2 is set at the sub-scanning gate signal generation device 33 (S177), and thereby the main scanning gate signal /LGATE and the sub-scanning gate signal /FGATE are generated.

With respect to correction of errors in magnification ratio in the main scanning direction, similarly, the printer controller 24 determines according to a predetermined accuracy for correction of a magnification ratio error whether or not a calculated amount of an error in magnification ratio is at a level that correction should be made (S175). When correcting the error in magnification ratio, the printer controller 24 calculates a setting value of a frequency of the clock WCLK necessary for correcting the error in magnification ratio (S176), sets the calculated setting value at the writing clock generation device 21 (S177), and thereby the clock WCLK is generated.

When the peak level of the detection signal of each line of the pattern of lines of the pattern image for correcting formed on the transfer belt 11 is not equal to or below the reference value (No in S173), a difference between the peak level of the detection signal of each line of the pattern of lines of the pattern image for correcting, that has been determined as not equal to or below the reference value, and the threshold level is calculated (S178), and the threshold level is automatically changed according to the calculated difference (S179). An optimum amount of change, that is suitable to be made to the threshold level for increasing the peak level of the detection signal of each line of the pattern of lines of the pattern image for correcting formed on the transfer belt 11, that has been determined as not equal to or below the reference value, to exceed the reference value, may be selected, in response to a detection level of each line of the pattern of lines of the pattern image for checking on the transfer belt 1 that has been determined as not equal to or below than the reference value at that time, from among ones obtained in advance by investigating to what extent the threshold level must be changed when a peak level of the detection signal of each line of the pattern of lines of the pattern image for checking formed on the transfer belt 11 is not equal to or below than the reference value for various cases and stored in a table.

Thereafter, amounts of deviations in position in the main scanning and sub-scanning directions and amounts of errors in magnification ratio in the main scanning direction of pattern images for correcting of individual colors relative to a pattern image for checking of black are calculated (S180). Then, the printer controller 24 determines if calculated amounts of deviations in position and errors in magnification ratio of pattern images for correcting of individual colors are at levels that correction should be made, respectively (S181).

When it is determined with respect to a pattern image for correcting of a certain color that an amount of a deviation in position in the main scanning direction and/or an amount of a deviation in position in the sub-scanning direction is at the level that correction should be made (Yes in S181), correction data for correcting the deviation in position in the main scanning direction (i.e., the correction data 1) and/or correction data for correcting the deviation in position in the sub-scanning direction (i.e., the correction data 2) is calculated (S182). The correction data 1 is set at the main scanning gate signal generation device 32 and the correction data 2 is set at the sub-scanning gate signal generation device 33 (S183), and thereby the main scanning gate signal /LGATE and the sub-scanning gate signal /FGATE are generated.

With respect to correction of errors in magnification ratio in the main scanning direction, similarly, the printer controller 24 determines according to a predetermined accuracy for correction of errors in magnification ratio whether or not a calculated amount of an error in magnification ratio of an image of a certain color is at a level that correction should be made (S181). When correcting the error in magnification ratio, the printer controller 24 calculates a setting value of a frequency of the clock WCLK necessary for correcting the error in magnification ratio (S182), sets the calculated setting value at the writing clock generation device 21 (S183), and thereby the clock WCLK is generated. Then, the threshold level is returned to the one before having been changed (S184).

Thus, according to the eleventh embodiment, depending upon a peak level of the detection signal of each line of the pattern of lines of the pattern image for correcting formed on the transfer belt 11, the detection signal having been output from the first sensor 13 and the second sensor 14, the threshold level is automatically changed, and thereafter amounts of deviations in position in the main scanning and sub-scanning directions and amounts of errors in magnification ratio in the main scanning direction of pattern images for correcting of individual colors relative to a pattern image for correcting of black are calculated. Thereby, deviations in position and errors in magnification ratio of images of individual colors that are superimposed on top of one another to form a full color image can be correctly corrected, so that color images of high quality having no deviation in position among images of individual colors superimposed on top of one another are always obtained.

After setting the correction data 1 at the main scanning gate signal generation device 32 and the correction data 2 at the sub-scanning gate signal generation device 33 and the calculated setting value at the writing clock generation device 21 in the step of S183, the threshold level is returned to the one before having been changed. This is because a possibility of erroneously detecting an output of the sensors 13 and 14 caused by noise is increased in a state that the threshold level has been changed and the threshold level may not need to be changed when performing the operation of correcting deviations in position and errors in magnification ratio of images of individual colors that are superimposed on top of one another to form a full color image a next time.

Figure 26A:
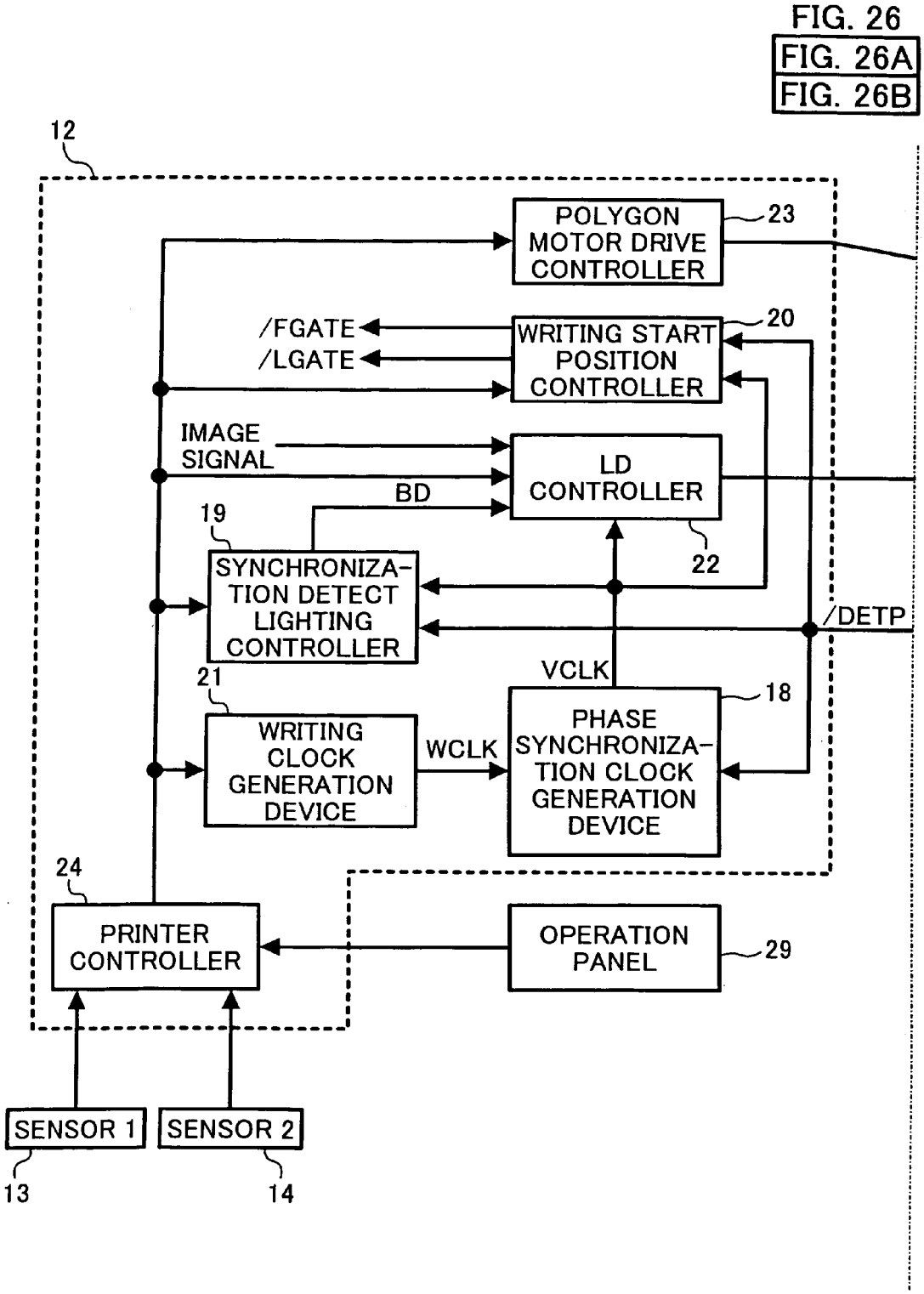
FIG. 26A and FIG. 26B are diagrams illustrating an exemplary construction of an image formation controller according to a twelfth preferred embodiment of the present invention.
Figure 26B:
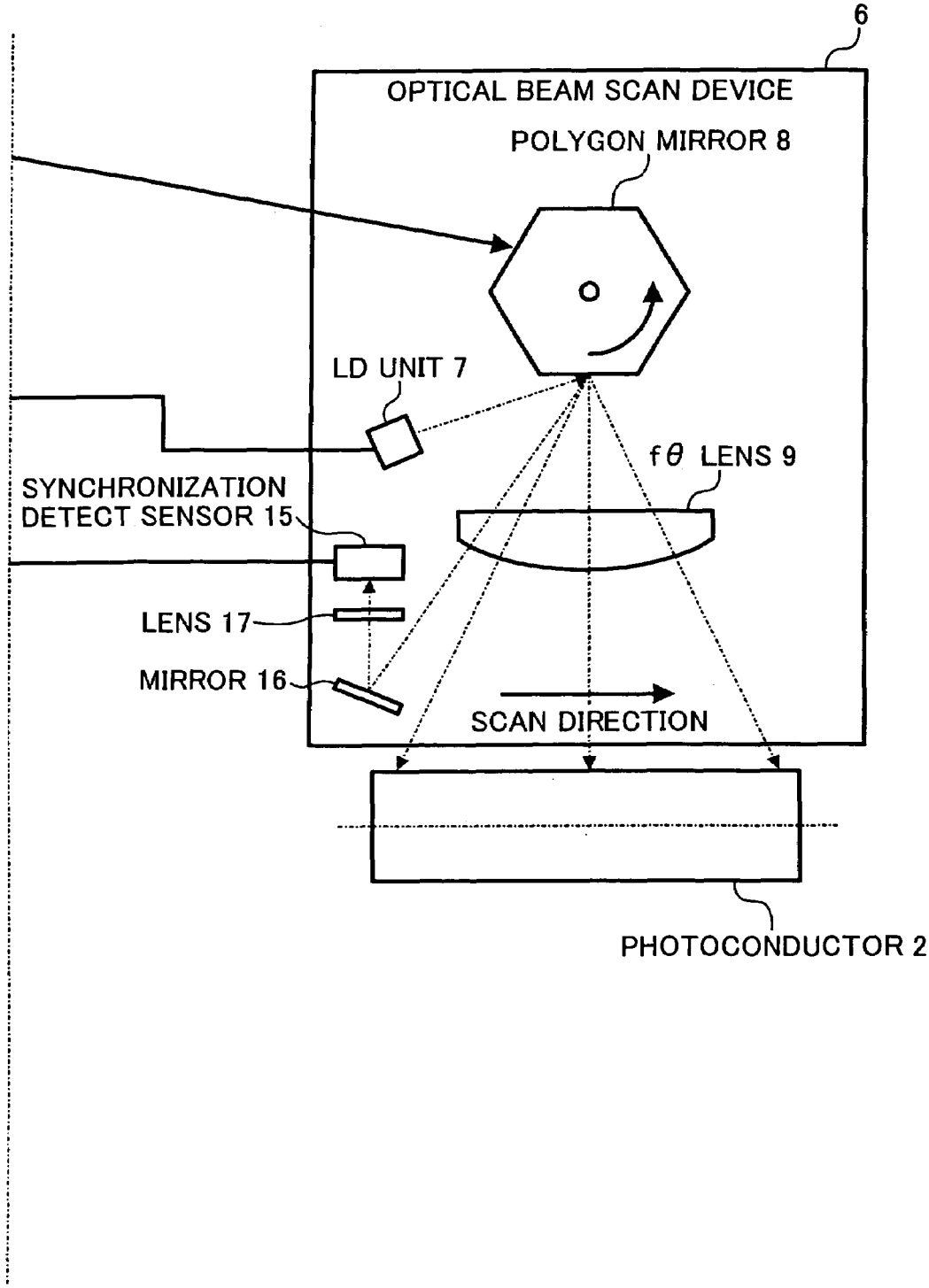

Next, a twelfth preferred embodiment of the present invention is described. FIG. 26A and FIG. 26B illustrate an exemplary construction of an image formation controller according to the twelfth preferred embodiment. As illustrated in FIG. 26A, an operation panel 29 serving as an operation device of the present invention is connected with the printer controller 24. The construction of an image forming apparatus is substantially the same as that of the first embodiment except that the operation panel 29 is provided, and the pattern image for correcting deviations in position and errors in magnification errors of images of individual colors that are superimposed on top of one another to form a full color image is also the same as that of the first embodiment. Further, the operation flow of an operation of correcting deviations in position and errors in magnification ratio of images of individual colors that are superimposed on top of one another to form a full color image according to this embodiment is substantially the same as that of the eleventh embodiment, and therefore description thereof is omitted.

As illustrated in FIG. 26A, the operation panel 29 is connected with the printer controller 24, and the threshold level can be changed by manipulation of the operation panel 29.

When the peak level of the detection signal of each line of the pattern of lines of the pattern image for correcting formed on the transfer belt 11 is not equal to or below the reference value and thereby it is determined that deviations in position and errors in magnification ratio of images of individual colors that are superimposed on top of one another to form a full color image cannot be correctly corrected, by causing an error message to be displayed on the operation panel 29, the threshold level can be changed by the user of the apparatus by manipulation of the operation panel 29. After the operation of correcting deviations in position and errors in magnification ratio of images of individual colors that are superimposed on top of one another to form a full color image has been successfully performed, the threshold level may be automatically returned to the one before having been changed. Thereby, erroneously detecting an output of the sensors 13 and 14 caused by noise, etc. may be avoided.

Now, a thirteenth preferred embodiment of the present invention is described. The constructions of an image forming apparatus and an image formation controller and the pattern image for correcting deviations in position and errors in magnification ratio of images of individual colors that are superimposed on top of one another to form a full color image of this embodiment are substantially the same as those of the eleventh embodiment. Further, the pattern image for checking illustrated in FIG. 8 is formed on the transfer belt 11 at a part of the transfer belt 11 between parts thereof conveying recording sheets, respectively, as in the first embodiment, for determining whether or not deviations in position and errors in magnification ratio of images of individual colors that are superimposed on top of one another to form a color image can be correctly corrected, before performing the operation of correcting deviations in position and errors in magnification ratio of images of individual colors that are superimposed on top of one another to form a full color image.

Figure 27:
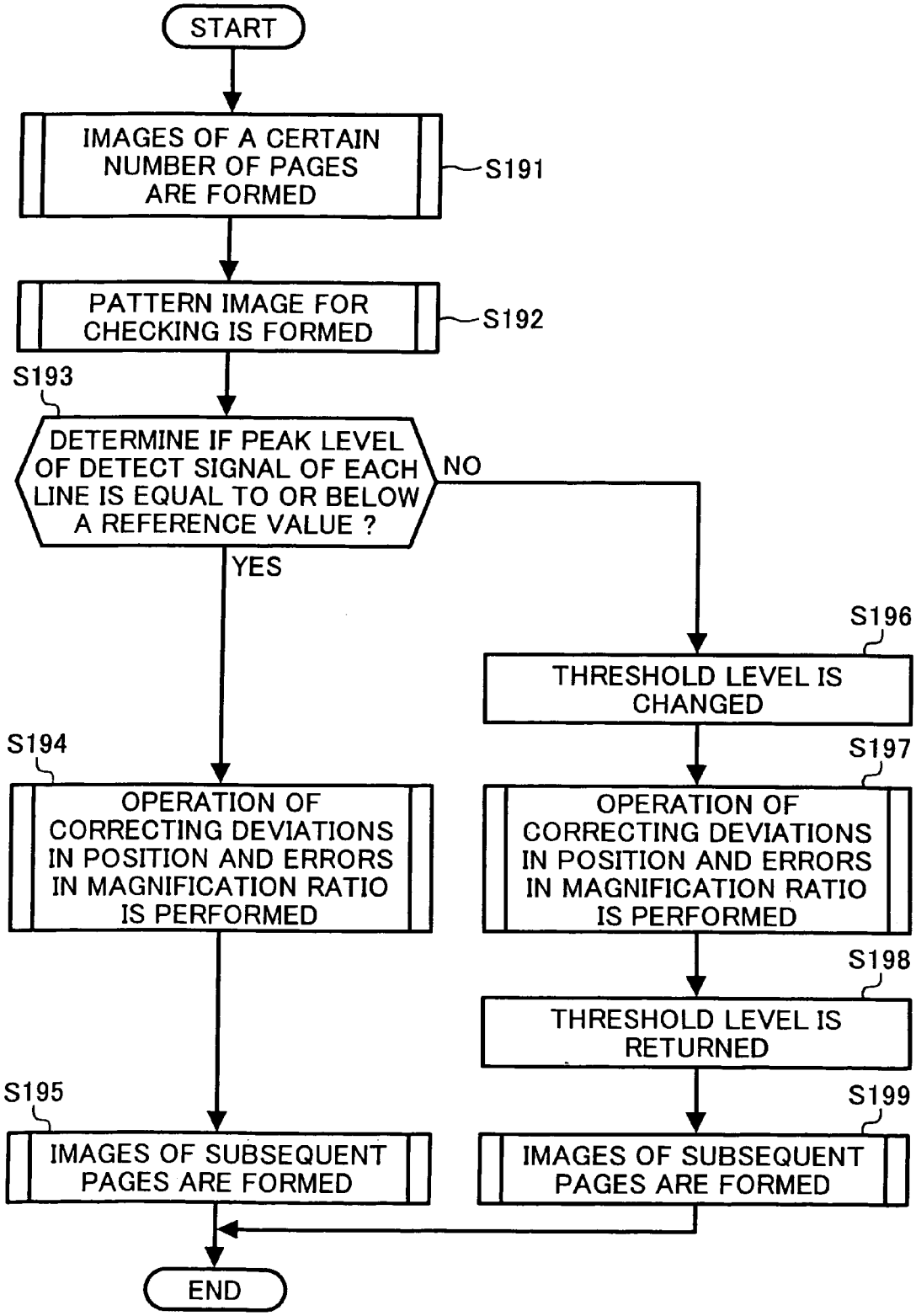
FIG. 27 is a flowchart of an operation of correcting deviations in position and errors in magnification ratio of images of individual colors that are superimposed on top of one another to form a full color image, according to a thirteenth preferred embodiment of the present invention.

FIG. 27 illustrates an exemplary operation flow of an operation of correcting deviations in position and errors in magnification ratio of images of individual colors that are superimposed on top of one another to form a full color image according to this embodiment. After forming images of a certain number of pages (in this example, 100 pages) since the operation of correcting deviations in position and errors in magnification ratio of images of individual colors has been performed last (S191), the pattern image for checking illustrated in FIG. 8 is formed on the transfer belt 11 at a part of the transfer belt 11 between parts of the transfer belt 11 conveying recording sheets, respectively, as in the first embodiment (S192). The pattern image for checking formed on the transfer belt 11 is detected by the first sensor 13 and the second sensor 14 to output a detection signal of each line of the pattern of lines of the pattern image for checking, and the printer controller 24 determines if a peak level of the detection signal of each line of the pattern of lines of the pattern image for checking formed on the transfer belt 11 is equal to or below a predetermined reference value (S193).

When the peak level of the detection signal of each line of the pattern of lines of the pattern image for checking formed on the transfer belt 11 is equal to or below the reference value (Yes in S193), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S194). When the next page after the last page of a certain number of pages (in this example, after the 100th page of 100 pages) for which an operation of forming an image has not been started exists, the operation of correcting deviations in position and errors in magnification ratio of images of individual colors of step S194 is executed after interrupting the operation of forming the image of the next page, and when the operation of forming the image of the next page has been already started, the operation of correcting deviations in position and errors in magnification of images of individual colors of step S194 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S195).

When the peak level of the detection signal of any one line of the pattern of lines of the pattern image for checking formed on the transfer belt 11 is not equal to or below the reference value (No in S193), it is determined that deviations in position and errors in magnification ratio of images of individual colors that are superimposed on top of one another to form a full color image cannot be correctly corrected, and the threshold level is changed (S196). When an operation of forming an image of the next page has been already started, the threshold level is changed after the image of the next page has been formed. Then, the operation of correcting deviations in position and errors in magnification ratio of images of individual colors illustrated in FIG. 7 is executed (S197). The threshold level is returned (S198), and images of subsequent pages are formed (S199).

Thus, according to this embodiment, when the peak level of the detection signal of any one line of the pattern of lines of the pattern image for checking formed on the transfer belt 11 is not equal to or below the predetermined reference value and thereby it is determined that deviations in position and errors in magnification ratio of images of individual colors that are superimposed on top of one another to form a full color image cannot be correctly corrected, the threshold level is automatically changed, and thereafter the pattern image for correcting is formed on the transfer belt 11 for correcting deviations in position and errors in magnification ratio of individual colors that are superimposed on top of one another to form a full color image. Thereby, amounts of deviations in position in the main scanning and sub-scanning directions and amounts of errors in magnification ratio in the main scanning direction of pattern images for correcting of individual colors relative to a pattern image for correcting of black are correctly calculated. Accordingly, deviations in position and errors in magnification ratio of images of individual colors that are superimposed on top of one another to form a full color image can be correctly corrected, so that color images of high quality having no deviation in position among images of individual colors superimposed on top of one another are always obtained.

Now, a fourteenth preferred embodiment of the present invention is described. The construction of an image forming apparatus and an image formation controller, the pattern image for correcting deviations in position and errors in magnification ratio of images of individual colors that are superimposed on top of one another to form a full color image and the pattern image for checking whether or not deviations in position and errors in magnification ratio of images individual colors that are superimposed on top of one another to form a full color image of this embodiment are substantially the same as those of the thirteenth embodiment.

Figures 28, 28A:
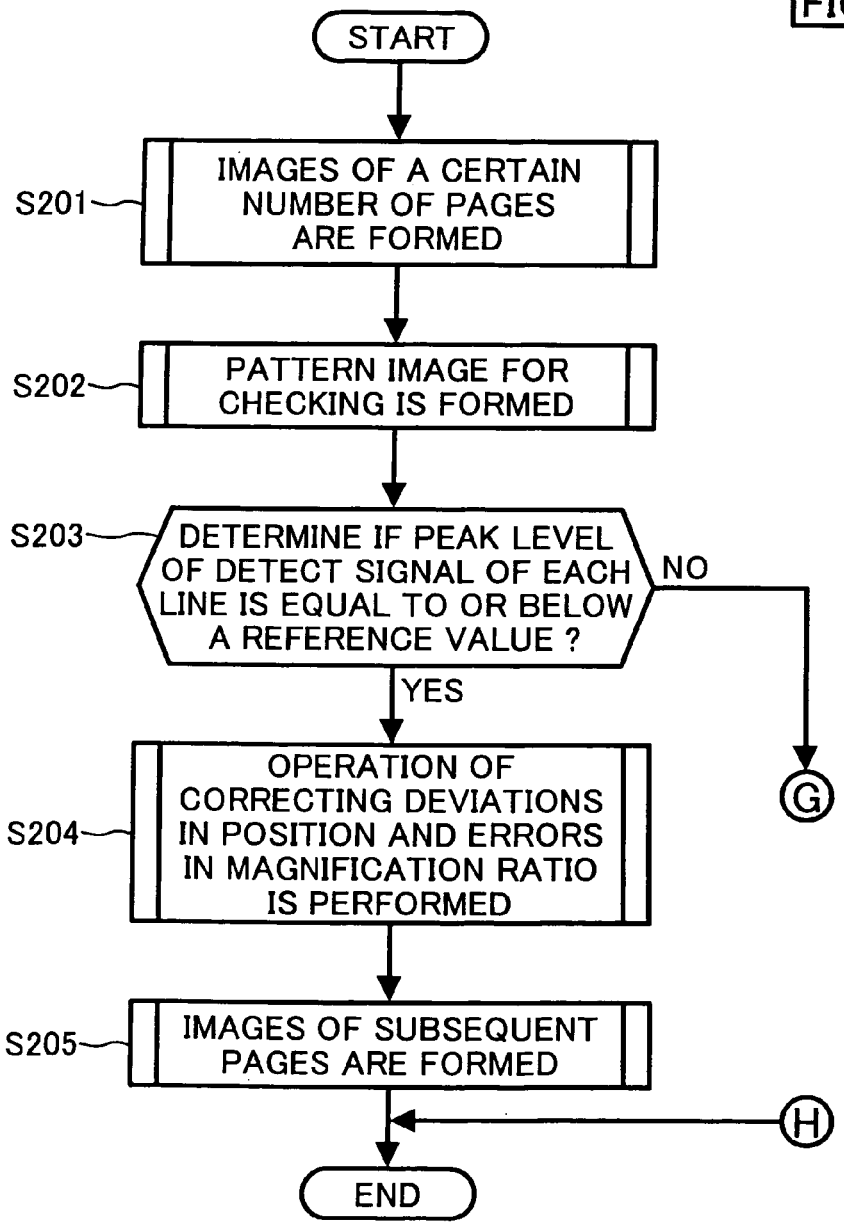
FIG. 28A and FIG. 28B are flowcharts of an operation of correcting deviations in position and errors in magnification ratio of images of individual colors that are superimposed on top of one another to form a full color image, according to a fourteenth preferred embodiment of the present invention.
Figure 28B:
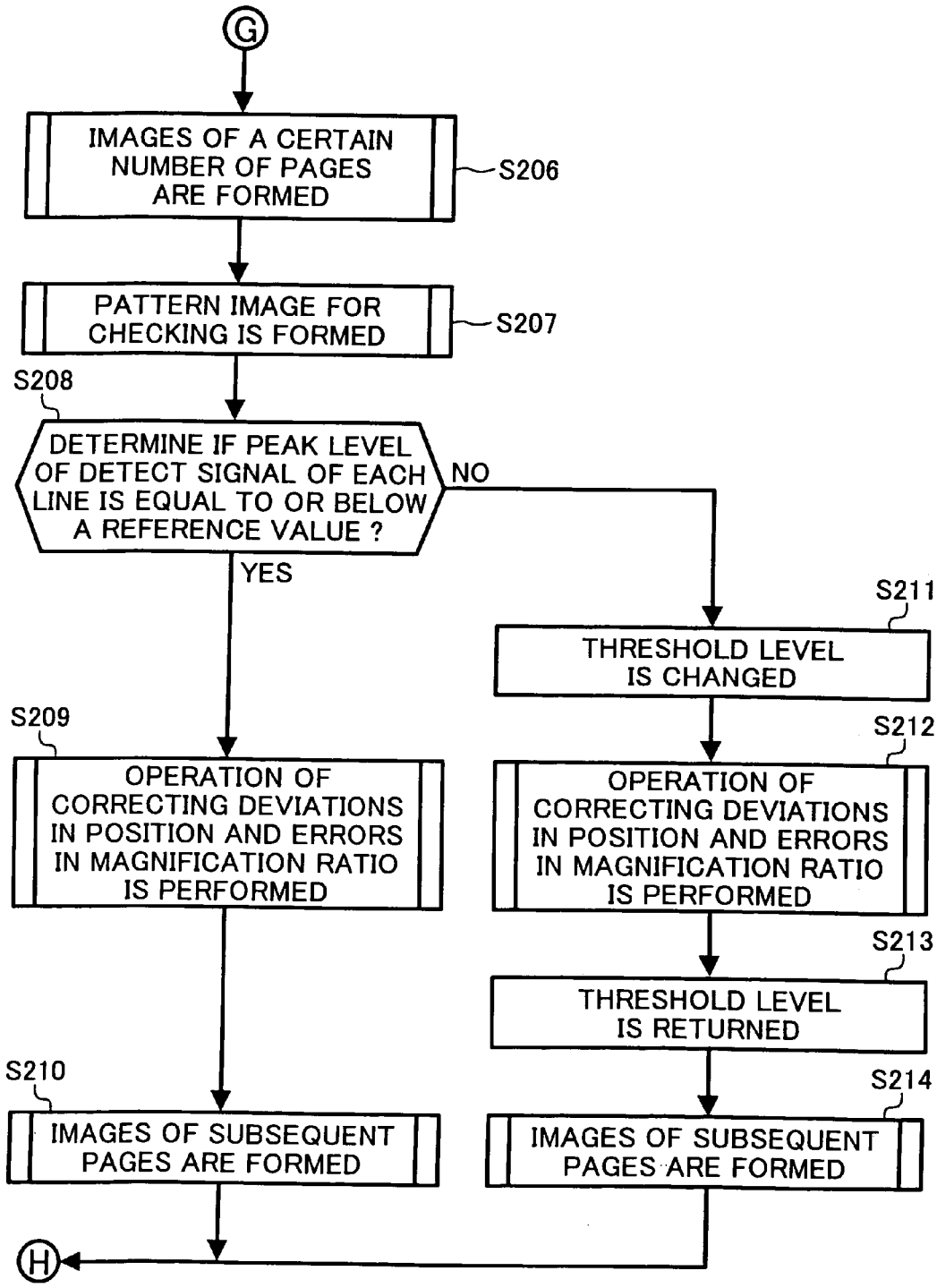

FIG. 28A and FIG. 28B illustrate an exemplary operation flow of an operation of correcting deviations in position and errors in magnification ratio of images of individual colors that are superimposed on top of one another to form a full color image according to this embodiment. The operation flow is different from that of the thirteenth embodiment in that when a peak level of the detection signal of each line of the pattern of lines of the pattern image for checking formed on the transfer belt 11 is not equal to or below a predetermined reference value, after forming images of a predetermined quantity, the pattern image for checking is formed again on the transfer belt 11, and whether or not a peak level of the detection signal of each line of the pattern of lines of the pattern image for checking is equal to or below the predetermined reference value is determined again. This is because the development unit 3 of each image forming device 1 may be replenished with toner while images are being formed and in such a case, there is a possibility that the peak level of the detection signal of each line of the pattern of lines of the pattern image for checking subsequently formed on the transfer belt 11 will be equal to or below the reference value. Thus, in this embodiment, when a peak level of the detection signal of each line of the pattern of lines of the pattern image for checking formed on the transfer belt 11 is not equal to or below a predetermined reference value, by determining whether or not a peak level of the detection signal of each line of the pattern of lines of the pattern image for checking is equal to or below the predetermined reference value again after forming images of a predetermined quantity, changing of the threshold level is avoided as much as possible.

In this embodiment, after forming images of a certain number of pages (in this example, 100 pages) since the operation of correcting deviations in position and errors in magnification ratio of images of individual colors has been performed last (S201), the pattern image for checking illustrated in FIG. 8 is formed on the transfer belt 11 at a part of the transfer belt 11 between parts of the transfer belt 11 conveying recording sheets, respectively, as in the first embodiment (S202). The pattern image for checking formed on the transfer belt 11 is detected by the first sensor 13 and the second sensor 14 to output a detection signal of each line of the pattern of lines of the pattern image for checking, and the printer controller 24 determines if a peak level of the detection signal of each line of the pattern of lines of the pattern image for checking formed on the transfer belt 11 is equal to or below a predetermined reference value (S203).

When the peak level of the detection signal of each line of the pattern of lines of the pattern image for checking formed on the transfer belt 11 is equal to or below the reference value (Yes in S203), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S204). When the next page after the last page of a certain number of pages (in this example, after the 100th page of 100 pages) for which an operation of forming an image has not been started exists, the operation of correcting deviations in position and errors in magnification ratio of images of individual colors of step S204 is executed after interrupting the operation of forming the image of the next page, and when the operation of forming the image of the next page has been already started, the operation of correcting deviations in position and errors in magnification of images of individual colors of step S204 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S205).

When the peak level of the detection signal of any one line of the pattern of lines of the pattern image for checking formed on the transfer belt 11 is not equal to or below the reference value (No in S203), it is determined that deviations in position and errors in magnification ratio of images of individual colors that are superimposed on top of one another to form a full color image cannot be correctly corrected. Images of a predetermined quantity are formed (S206), and then the pattern image for checking is formed on the transfer belt 11 again (S207). The pattern image for checking formed on the transfer belt 11 is detected by the first sensor 13 and the second sensor 14 to output a detection signal of each line of the pattern of lines of the pattern image for checking, and the printer controller 24 determines if a peak level of the detection signal of each line of the pattern of lines of the pattern image for checking formed on the transfer belt 11 again is equal to or below a predetermined reference value (S208).

When the peak level of the detection signal of each line of the pattern of lines of the pattern image for checking formed on the transfer belt 11 again is equal to or below the reference value (Yes in S208), it is determined that deviations in position and errors in magnification ratio of images of individual colors that are superimposed on top of one another to form a full color image can be correctly corrected, and the operation of correcting deviations in position and errors in magnification ratio of images of individual colors illustrated in FIG. 7 is executed (S209). When the next page after the last page of a certain number of pages (in this example, after the 100th page of 100 pages) for which an operation of forming an image has not been started exists, the operation of correcting deviations in position and errors in magnification ratio of images of individual colors of step S209 is executed after interrupting the operation of forming the image of the next page, and when the operation of forming the image of the next page has been already started, the operation of correcting deviations in position and errors in magnification of images of individual colors of step S209 is executed after the image of the next page has been formed. Thereafter, images of subsequent pages (including the image of the next page when the operation of forming the image of the next page has been interrupted) are formed in a state that correction data for correcting deviations in position and errors in magnification ratio of images of individual colors is set (S210).

When the peak level of the detection signal of any one line of the pattern of lines of the pattern image for checking formed on the transfer belt 11 again is not equal to or below the reference value (No in S208), it is determined that deviations in position and errors in magnification ratio of images of individual colors that are superimposed on top of one another to form a full color image cannot be correctly corrected. The threshold level is then changed (S211). When the operation of forming an image of the next page has been already started, the threshold level is changed after the image of the next page has been formed. Then, the operation of correcting deviations in position and errors in magnification ratio of images of individual colors illustrated in FIG. 7 is executed (S212). The threshold level is returned (S213), and images of subsequent pages are formed (S214).

Thus, according to this embodiment, when the peak level of the detection signal of any one line of the pattern of lines of the pattern image for checking formed on the transfer belt 11 is not equal to or below the predetermined reference value and thereby it is determined that deviations in position and errors in magnification ratio of images of individual colors that are superimposed on top of one another to form a full color image cannot be correctly corrected, the threshold level is not changed immediately. Instead, after images of a predetermined quantity have been formed, the pattern image for checking is formed on the transfer belt 11 again and whether or not the peak level of the detection signal of each line of the pattern of lines of the pattern image for checking is equal to or below a predetermined reference value is determined again, and when the peak level of the detection signal of any one line of the pattern of lines of the pattern image for checking is again not equal to or below a predetermined reference value, then the threshold level is changed. Thus, the frequency of changing the threshold level can be decreased.

In the above-described embodiments, the image formation controller 12 is configured such that the phase synchronization clock generation device 18, the synchronization detection lighting controller 19, the writing start position controller 20, the writing clock generation device 21, then LD controller 22, and the polygon motor drive controller 23 control each of the optical beam scan devices 6, and the charge potential controller 25, the development bias controller 26, the transfer bias controller 27, and the toner density controller 28 control each of the image forming devices 1. However, the image formation controller 12 may be configured to include the phase synchronization clock generation device 18, the synchronization detection lighting controller 19, the writing start position controller 20, the writing clock generation device 21, the LD controller 22, and the polygon motor drive controller 23 for each of the optical beam scan devices 6, and the charge potential controller 25, the development bias controller 26, the transfer bias controller 27, and the toner density controller 28 for each of the image forming devices 1.

Obviously, numerous additional modifications and variations of the present invention are possible in light of the above teachings. It is therefore to be understood that within the scope of the appended claims, the present invention can be practiced otherwise than as specifically described herein.

The invention claimed is:

1. A color image forming apparatus, comprising:

a pattern image forming device configured to form pattern images of lines of individual colors for checking and correcting on image bearing members;

a transfer device configured to transfer the pattern images for correcting and checking onto a transfer member;

a detection device configured to detect each line of the pattern images for correcting and configured to output detection signals;

a correction device configured to correct deviation in position of images of individual colors to be superimposed on top of one another based upon a detection result of the detection device; and a correction possibility determination device configured to determine if the deviation is to be corrected by detecting a condition of the each line of the pattern images for checking.

2. The color image forming apparatus as claimed in claim 1, wherein said condition is detected by checking if a width of each line of the pattern images for checking is equal to or greater than a prescribed reference value, and wherein the correction possibility determination device determines that the deviation is to be corrected when the width is equal to or greater than the prescribed reference value.

3. The color image forming apparatus as claimed in claim 2, wherein said checking is executed by comparing a detection signal obtained from the each line for checking with a prescribed threshold level.

4. The color image forming apparatus as claimed in claim 3, wherein said threshold level can be changed when the pattern images of lines for correcting are detected to correct deviation.

5. The color image forming apparatus as claimed in claim 2, wherein said checking is executed by comparing a peak level of the detection signal of each line of the pattern images for checking with a prescribed reference value.

6. The color image forming apparatus according to claim 1, wherein said determination is executed by a plurality of times at certain intervals.

7. The color image forming apparatus according to claim 1, wherein the pattern images for correcting and the pattern images for checking have substantially a same shape to each other.

8. The color image forming apparatus according to claim 1, wherein each line of the pattern images for detecting and that for correcting are arranged on the transfer member between recording sheets successively conveyed by the transfer member, and wherein the each line for checking is formed downstream of that for correcting in a recording sheet conveyance direction.

9. A method of forming a full color image by superimposing images of individual colors, comprising:

forming lines of pattern images for checking and correcting on a transfer member;

detecting each line of the pattern images for checking to output a detection signal indicating a condition of the each line;

determining if a width of the each line is equal to or greater than a prescribed reference value based on the detection signal; and determining that a deviation in position of images of individual colors to be superimposed on top of one another can be correctly corrected when the width is equal to or greater than the reference value.

10. A method of forming a full color image by superimposing images of individual colors, comprising:

forming lines of pattern images for correcting and checking on a transfer member;

detecting each line of the pattern images for checking to output a detection signal indicating a condition of the each line;

determining if a peak level of the detection signal of the each line is equal to or less than a prescribed reference value; and determining that deviation in position of images of individual colors to be superimposed on top of one another cannot be corrected when the peak level is not equal to or less than the prescribed reference value.

11. A color image forming apparatus, comprising:

means for forming pattern images of lines of individual colors for correcting and checking on image bearing members;

means for transferring the pattern images for correcting and checking onto a transfer member;

means for detecting each line of the pattern images for checking and outputting a detection signal indicating a condition of the each line;

means for determining if deviations in position of images of individual colors to be superimposed on top of one another can be corrected based on the detection result; and means for correcting the deviations;

wherein said means for correcting checks if a width of each line of the pattern images for checking is equal to or greater than a prescribed reference value, and determines that the deviations can be correctly corrected when the width is equal to or greater than the prescribed reference value.

* * * * *